US011566444B2

(12) United States Patent
Chu

(10) Patent No.: US 11,566,444 B2
(45) Date of Patent: Jan. 31, 2023

(54) METHOD FOR MUTUALLY CONTROLLING AND UNLOCKING A DUAL PLUG IN A LOCK AND A LOCK WITH A DUAL PLUG

(71) Applicant: Kapan Chu, Wanchai (HK)

(72) Inventor: Kapan Chu, Wanchai (HK)

(73) Assignee: Kapan Chu, Wanchai (HK)

( * ) Notice: Subject to any disclaimer, the term of this patent is extended or adjusted under 35 U.S.C. 154(b) by 251 days.

(21) Appl. No.: 17/130,288

(22) Filed: Dec. 22, 2020

(65) Prior Publication Data

US 2021/0108446 A1 Apr. 15, 2021

Related U.S. Application Data

(62) Division of application No. 15/561,424, filed as application No. PCT/CN2016/073360 on Feb. 3, 2016, now Pat. No. 10,900,257.

(30) Foreign Application Priority Data

Mar. 24, 2015 (CN) ..... 201510130241.2
Jul. 3, 2015 (CN) ..... 201510386558.2
(Continued)

(51) Int. Cl.
*E05B 27/00* (2006.01)
*E05B 29/00* (2006.01)
(Continued)

(52) U.S. Cl.
CPC ..... *E05B 27/0075* (2013.01); *E05B 27/00* (2013.01); *E05B 27/001* (2013.01);
(Continued)

(58) Field of Classification Search
CPC .... E05B 27/00; E05B 27/0075; E05B 27/001; E05B 27/0046; E05B 29/006;
(Continued)

(56) References Cited

U.S. PATENT DOCUMENTS 4,104,898 A * 8/1978 Fois ..... E05B 27/08 70/423
5,148,690 A * 9/1992 Wang ..... E05B 67/24 70/DIG. 37
(Continued)

FOREIGN PATENT DOCUMENTS

DE 2900992 A * 7/1980 ..... E05B 27/001

*Primary Examiner* — Suzanne L Barrett
(74) *Attorney, Agent, or Firm* — Cooper Legal Group, LLC

(57) ABSTRACT

A method for mutually controlling and unlocking a dual plug in a lock, comprising: unlocking a code of a first plug first, the first plug restricting unlocking of a second plug, the second plug restricting rotating of the first plug before the code of the first plug is unlocked; after unlocking the code of the first plug, the first plug translating to a second position from a first position using a preset position difference, the first plug being unable to rotate during the translation; after moving the first plug to the second position, the first plug releasing a restriction on the second plug, the second plug still restricting the rotating of the first plug; and unlocking the code of the second plug, the first plug and the second plug being able to rotate synchronously so as to unlock the lock after unlocking the code of the second plug. The present invention further relates to a lock with a dual plug.

10 Claims, 43 Drawing Sheets

(30) Foreign Application Priority Data

| | | |
|---|---|---|
| Aug. 6, 2015 | (CN) | 201510476069.6 |
| Aug. 10, 2015 | (CN) | 201510485977.1 |
| Aug. 10, 2015 | (CN) | 201510486222.3 |
| Aug. 13, 2015 | (CN) | 201510495818.X |

(51) Int. Cl.

| | |
|---|---|
| ***E05B 35/14*** | (2006.01) |
| *E05B 17/14* | (2006.01) |
| *E05B 19/00* | (2006.01) |
| *E05B 43/00* | (2006.01) |

(52) U.S. Cl.
CPC ..... *E05B 27/0046* (2013.01); *E05B 29/006* (2013.01); *E05B 29/0026* (2013.01); *E05B 35/14* (2013.01); *E05B 17/14* (2013.01); *E05B 17/142* (2013.01); *E05B 19/0052* (2013.01); *E05B 27/0017* (2013.01); *E05B 29/0066* (2013.01); *E05B 43/00* (2013.01); *E05B 2043/007* (2013.01)

(58) Field of Classification Search
CPC ..... E05B 29/0026; E05B 35/14; E05B 17/14; E05B 17/142; E05B 19/0052; E05B 27/0017; E05B 29/0066; E05B 43/00; E05B 2043/007; Y10T 70/7605; Y10T 70/7684; Y10T 70/7932
USPC ..... 70/375, 419, 493, DIG. 35, DIG. 60
See application file for complete search history.

(56) References Cited

U.S. PATENT DOCUMENTS

| | | | | |
|---|---|---|---|---|
| 5,475,997 | A * | 12/1995 | Chung | E05B 35/14 70/358 |
| 5,921,121 | A * | 7/1999 | Tang | E05B 27/0053 70/382 |
| 5,964,111 | A * | 10/1999 | Lambert | E05B 27/083 70/381 |
| 6,758,073 | B2 * | 7/2004 | Yu | E05B 27/001 70/423 |
| 2006/0096345 | A1 * | 5/2006 | Chen | E05B 27/001 70/493 |

* cited by examiner

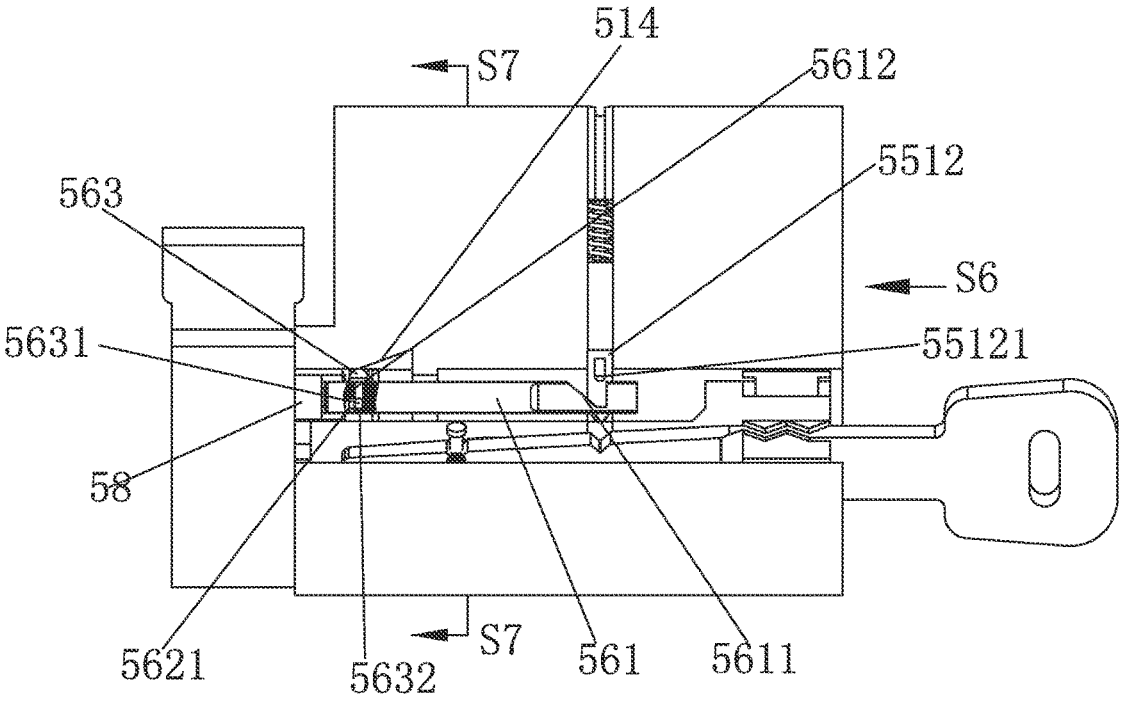
FIG. 68
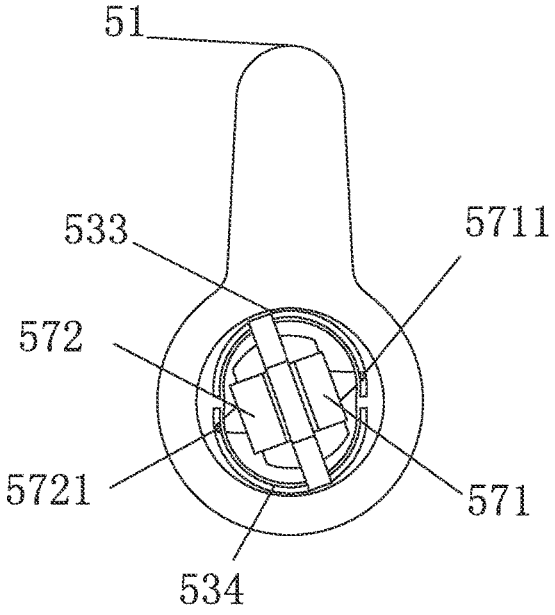
FIG,.69
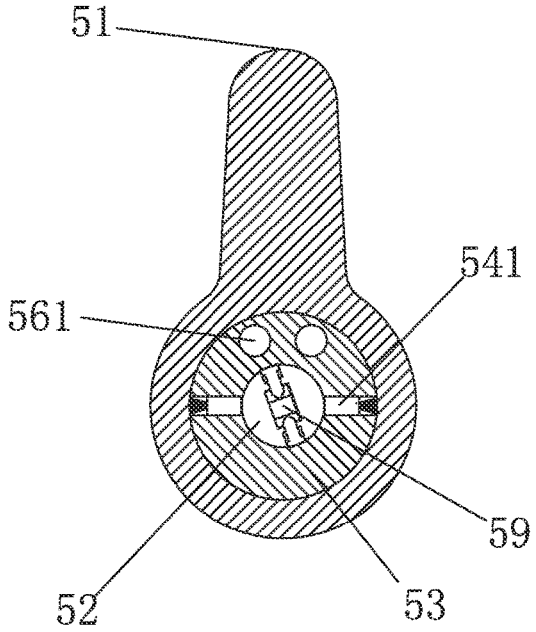
FIG.70

METHOD FOR MUTUALLY CONTROLLING AND UNLOCKING A DUAL PLUG IN A LOCK AND A LOCK WITH A DUAL PLUG

CROSS-REFERENCE TO RELATED APPLICATIONS

This application is a divisional of and claims priority to U.S. patent application Ser. No. 15/561,424, filed Sep. 25, 2017, which is a national stage entry of International Patent Application PCT/CN2016/073360, filed Feb. 3, 2016, which claims priority to Chinese Patent Application 201510495818.X, filed Aug. 13, 2015, Chinese Patent Application 201510485977.1, filed Aug. 10, 2015, Chinese Patent Application 201510130241.2, filed on Mar. 24, 2015, Chinese Patent Application 201510476069.6, filed Aug. 6, 2015, Chinese Patent Application 201510386558.2, filed Jul. 3, 2015, and Chinese Patent Application 201510486222.3, filed Aug. 10, 2015. U.S. patent application Ser. No. 15/561,424, International Patent Application PCT/CN2016/073360, and Chinese Patent Applications 201510495818.X, 201510485977.1, 201510130241.2, 201510476069.6, 201510386558.2, and 201510486222.3 are incorporated herein by reference.

FIELD OF THE DISCLOSURE

The present invention relates to a lock with dual plug, particularly to method for mutually controlling and unlocking a dual plug in a lock and a lock with a dual plug.

BACKGROUND OF THE DISCLOSURE

Pin tumbler locks are most widely used in the various locks that are recently available. The pin tumbler locks have many shortcomings in practical use as they are easily unlocked by specialized key picking devices. The unlocking methods are simple: a person uses a steel hook to stir the pins between the lock body and the plug to the coupling surface between the plug and the lock body one by one, and then rotates the plug to unlock the lock. A key with tinfoil can also be used to insert into the lock hole, after shaking, the tinfoil is printed by the pins to make the pin drop to the coupling surface of the plug and the lock body, and the spindle can be rotated to unlock the lock. Another method is to shock or stir the pins back and forth by a toothed device. Some illegal lock picking person uses flipping device to rotate the spindle with force to unlock the lock. Evidently, there are many methods to unlock a pin tumbler lock by techniques or by brute force. The traditional pin tumbler locks have many shortcomings, resulting in low security and frequent theft cases. To improve the security, existing technology uses a lock with dual spindle, for example, those disclosed in the Chinese patents publications CN203925006U, CN203603627U and CN203769466U. However, these dual-spindle locks have their two spindles arranged side by side, the locks are unlocked by two keys. The locks are still easily unlocked by techniques or by brute force.

BRIEF SUMMARY OF THE DISCLOSURE

To overcome the disadvantages of the existing known technology, the present invention is provided with method for mutually controlling and unlocking a dual plug in a lock and a lock with dual plug, in which two plugs are mutually controlled. The present invention greatly increases the difficulty of unlocking a lock by techniques or by brute force, also greatly increases the lock security.

The technical solution of the present invention is that:

Method for mutually controlling and unlocking dual plug of a lock, wherein comprising the steps:

unlocking a code of a first plug first, the first plug restricting unlocking of a second plug, the second plug restricting rotating of the first plug before the code of the first plug is unlocked;

after unlocking the code of the first plug, the first plug translating to a second position from a first position using a preset position difference, the first plug being unable to rotate during the translation;

after moving the first plug to the second position, the first plug releasing a restriction on the second plug, the second plug still restricting the rotating of the first plug; and unlocking the code of the second plug, the first plug and the second plug being able to rotate synchronously so as to unlock the lock after unlocking the code of the second plug.

In another preferred embodiment, during the translation of the first plug from the first position to the second position, the first plug utilizes a time difference caused by the translation from the first position to the second position to gradually transit an entrance of the second plug for insertion by an unlock device to a partially closed state or a complete closed state.

In another preferred embodiment, the unlocking of the code of the first plug and the unlocking of the code of the second plug are implemented using different unlocking areas of an unlock device.

In another preferred embodiment, when in a situation where a valid unlocking device is used, when the first plug translates to the second position, and the first plug releases restriction on the unlocking of the second plug, the valid unlock device also unlocks the code of the second plug.

In another preferred embodiment, the first plug is unable to rotate after the code of the first plug is unlocked; further comprising restricting the first plug from self-rotating, and releasing the first plug from the self-rotating only when the first plug translates to the second position.

In another preferred embodiment, the first plug utilizes an action part associated to the code of the second plug to restrict the unlocking of the second plug; before the first plug moves, the plug is unable to be unlocked by a valid unlock device; after the first plug moves to the second position, the action part of the first plug releases the restriction on the second plug, making the code of the second plug can be unlocked by a valid unlock device.

In another preferred embodiment, the rotation of the second plug is associated to the rotation of the first plug to restrict the rotating of the first plug; the first plug is unable to rotate in a situation when the second plug is unable to rotate.

In another preferred embodiment, when the first plug translates to the second position, an entrance of the second plug for inserting of an unlock device is gradually partially closed or completely closed; to achieve this object, the action part of the first plug is associated to the second plug; before the first plug moves, the first plug does not act on the second plug; after the first plug translates to the second position, the second plug is acted by the action part of the first plug, causing the entrance of the second plug gradually partially closed or completely closed.

A lock with dual mutually control spindles, comprising a lock head and a key; the lock head comprises:

a lock body;

a first plug and a second plug rotatably assembled in the lock body; and a first lock mechanism and a second lock mechanism, which can be unlocked by the key, being respectively assembled between the first plug, the second plug and the lock body so as to restrict the rotating of the first plug and the second plug in relation to the lock body;

wherein the first plug and the second plug are mutually controllably connected; the first plug is disposed with a control mechanism to control the second plug, the first plug utilizes a time difference caused by the translation from a first position to a second position; before the first plug translates to the second position, the second lock mechanism is unable to be unlocked; when the key is inserted into the key hole, the key unlocks the first lock mechanism first, then the key pushes the first plug to translate using the preset position difference; when the first plug translates to the second position, the control mechanism releases translation on the second lock mechanism, making the key be able to unlock the second lock mechanism; the first plug and the second plug rotate synchronously by the driving of the key to unlock the lock.

In another preferred embodiment, the first plug and the second plug are located front to back, the first plug is a rear plug and the second plug is a front plug; the first lock mechanism and the second lock mechanism are respectively a rear lock mechanism and a front lock mechanism; the front plug and the rear plug are rotatably assembled in the lock body; the front lock mechanism and the rear lock mechanism, which can be unlocked by the key, are respectively between the front and rear plug and the lock body to restrict the front and rear plug to rotate in relation to the lock body; the front plug and the rear plug are mutually controllably connected; the rear plug is further assembled with the control mechanism to control the front lock mechanism; before the rear plug translates to the second position, the front lock mechanism can not be unlocked; when the key is inserted into the key hole, the key unlocks the rear lock mechanism first, and then pushes the rear plug to move backward to the second position, the control mechanism releases translation on the front lock mechanism, making the key able to unlock the front lock mechanism; the front and rear plug rotate synchronously by the driving of the key to unlock the lock.

In another preferred embodiment, the first plug and the second plug are half cylinder structural, the first plug is a lower plug, the second plug is an upper plug, the first and second lock mechanism are respectively an upper lock mechanism and a lower lock mechanism; the key is disposed with an upper key slot and a lower key slot to unlock the upper and lower lock mechanism; when the key is inserted into the key hole, the lower key slot unlocks the lower lock mechanism first, the key then pushes the lower key spindle to move backward axially to the second position, the control mechanism releases translation on the upper lock mechanism, making the upper key slot able to unlock the upper lock mechanism; the upper and lower plug rotate synchronously by the driving of the key to unlock the lock.

In another preferred embodiment, the first plug and the second plug are arranged inside and outside, the first plug is an inner plug, the second plug is an outer plug, the first and second lock mechanism are respectively an inner lock mechanism and an outer lock mechanism; the outer plug is rotatably assembled in the lock body, the outer lock mechanism, which can be unlocked by the key, is assembled between the outer plug and the lock body to restrict the outer plug to rotate in relation to the lock body; the inner plug is rotatably assembled in the outer plug, the inner lock mechanism, which can be unlocked by the key, is assembled between the inner plug and the lock body to restrict the inner plug to rotate in relation to the lock body; the inner and outer plug are mutually controllably connected; the inner plug is assembled with the control mechanism to control the outer lock mechanism; before the inner plug rotates to the second position, the outer lock mechanism can not be unlocked; when the key is inserted into the key hole, the key unlocks the inner lock mechanism first, then pushes the inner plug to rotate; when the inner plug rotates to the second position, the control mechanism releases translation on the outer lock mechanism, making the key able to unlock the outer lock mechanism; the inner and outer plug rotate synchronously by the driving of the key to unlock the lock.

In another preferred embodiment, further comprising a gate disposed at the front of the key hole, the gate is linked to the first plug; the gate makes the key hole closed during the first plug moving from the first position to the second position using the preset position difference.

In another preferred embodiment, the gate comprises a upper gate at the upper side of the front portion of the key hole and a lower gate at the lower side of the front portion of the key hole; the first plug is linked to the upper and lower gate by a linkage part, when the first plug translates to the second position from the first position using the preset position difference, the upper and lower gate respectively move in the gate closing direction until the key hole is closed.

In another preferred embodiment, the linkage part comprises an upper gate push rode and the lower gate push rod arranged in the axis of the key hole, the upper and lower gate push rod and the upper and lower gate are coupled by an incline surface.

In another preferred embodiment, further comprising a delayer assembled between the lock body and the control mechanism; when the first plug translates to the position in the position difference direction, the control mechanism pushes and compress the delayer to store energy; when the first plug and the second plug rotate synchronously, the delayer restricts the control mechanism from returning back; in a situation when the first plug and the second plug do not rotate synchronously, the delayer releases energy to push the control mechanism back to control the second lock mechanism after a preset period.

In another preferred embodiment, the delayer is selected from hydraulic delayer, mechanical friction delayer, clock delayer or damping delayer;

the hydraulic delayer compromises a main body, a piston, an inner tube, a spring and a spindle; the inner tube is fixed in the main body; an oil cavity is formed between the inner tube and the main body; the piston is slidably assembled in the inner tube by the spring; an inner tube cavity disposed between the piston and the inner tube is connected to a damping hole of the oil cavity; one end of the spindle is fixed to the piston, while the other end is connected to the control mechanism; the inner tube further comprises a check valve to achieve quick oil discharging from the inner tube cavity to the oil cavity;

the mechanical friction delayer compromises a push rod, a transition block a fixing base and a compressed spring; the push rod, the transition block and the compressed spring are slidably assembled in the inner chamber of the fixing base; a boss of the push rod is slidably assembled in a slide rail of the fixing base; a rear end of the compressed spring abuts against the inner wall of the rear end of the fixing base, the front end abuts against the end of the inner hole of the rear end of the transition block; the front end of the transition block is movably assembled to the end of the inner hole of the rear end of the push rod; the boss of the transition block is coupled to the slide rail of the fixing base; the front end of the push rod is connected to the control mechanism; the push rod is pushed to drive the transition block to move backward and the compressed spring is compressed to store energy; when the transition block drops out of the slide rail of the fixing base, the incline surface of the transition block is coupled to the incline surface of the push rod and the incline surface of the fixing base, causing the transition block rotating a certain angle; the rotation speed of the transition block is controllable by adjusting the inclination of the incline surface of the transition block, the push rod and fixing base and the friction coefficient; the transition block thus delays;

the clock delayer comprises a rack, a reducing mechanism, an escape mechanism, a shock mechanism, an energy storing mechanism and a unidirectional transmission mechanism; one end of the rack is connected to the control mechanism, the rack is coupled to the reducing mechanism; the reducing mechanism is linked to the escape mechanism; the energy storing mechanism is linked to the escape mechanism; the unidirectional transmission mechanism is assembled between the escape mechanism and the reducing mechanism; the escape mechanism is coupled to the shock mechanism;

the damping delayer comprises a rack, a damping gear, a compressed spring and a damper; one end of the rack is connected to the control mechanism; the compressed spring abuts against the other end of the rack; the teeth of the rack is coupled to the damping gear; the damper comprises a damping valve spindle and a housing, the valve spindle is assembled in the housing and is coaxially connected to the damping gear.

In another preferred embodiment, the second lock mechanism is a pin mechanism; the pin mechanism is assembled radically between the second plug and the lock body to restrict the rotating of the second plug; the second plug further comprises a push rod slide groove axially arranged, the slide groove is connected to the pin hole of the pin mechanism; the pin push rod of the control mechanism is assembled in the push rod slide groove of the second plug to control the pins of the pin mechanism, one end of the pin push rod of the control mechanism is linked to the second plug.

In another preferred embodiment, the pin push rod is disposed with a sloping slide groove, pins of the pin mechanism are disposed with a protruding portion coupled to the sloping slide groove of the pin push rod; when the pin push rod of the control mechanism moves in the horizontal direction, the pins move up and down by the coupling of the sloping slide groove of the pin push rod and the protruding portion of the pins, making the pin switched between a position the key can not unlock and a position the key can unlock.

In another preferred embodiment, the end of the pin push rod of the control mechanism is disposed with a lock groove, the first plug is disposed with a lock block fixing groove, one lock block is connected between the lock groove of the pin push rod of the control mechanism and the lock block fixing groove of the first plug to make the end of the pin push rod of the control mechanism linked to the first plug; when the first plug moves in the position difference direction, the first plug drives the pin push rod of the control mechanism to move axially through the lock block.

In another preferred embodiment, the second plug is further disposed with a protruding portion, which is disposed between the lock block fixing groove of the first plug and the lock groove of the pin push rod of the control mechanism; the protruding portion of the second plug is disposed with a lock block slide groove, the lock block passes through the lock block slide groove of the protruding portion of the second plug and is coupled between the lock groove of the pin push rod of the control mechanism and the lock block fixing groove of the first plug; when the first plug drives the pin push rod of the control mechanism to move axially through the lock block, the lock block moves axially in the lock block slide groove of the protruding portion of the second plug.

In another preferred embodiment, the lock block slide groove of the protruding portion of the second plug is disposed with a sloping slide groove, to which the lock block is coupled to make the lock block move axially in the lock block slide groove of the second plug and further move radically; when the second plug translates to the second position in the position difference direction, the lock block escapes out of the lock groove of the pin push rod of the control mechanism.

In another preferred embodiment, at the same time, the bottom end of the lock block is disposed with a spring, two sides of the lock block are disposed with a wing, the sloping slide groove of the second plug is faced down, the lock block is assembled in the lock block fixing groove of the first plug through the spring; the wings of the lock block abut against the sloping slide groove of the lock block slide groove of the second plug.

In another preferred embodiment, the upper lock mechanism between the upper plug and the lock body is a blade mechanism, the blade mechanism comprises a tumbler radically assembled between the upper plug and the lock body to restrict the rotating of the upper plug and a blade components assembled in the upper plug and linked to the tumbler; the upper plug is further disposed with a push rod slide groove axially arranged and connected to the tumbler; the control mechanism comprises a tumbler push rod, which is assembled to the push rod slide groove of the upper plug to control the tumbler of the blade mechanism, the rear end of the tumbler push rod of the control mechanism is linked to the lower plug.

In another preferred embodiment, the tumbler push rod of the control mechanism is disposed with a slide groove axially movable in relation to the tumbler; the slide groove of the tumbler push rod of the control mechanism is disposed with an incline surface; the tumbler is disposed with a protruding portion; the incline surface of the tumbler push rod of the control mechanism is faced up and is coupled to the protruding portion of the tumbler so as to restrict the tumbler to fall down radically before the tumbler push rod of the control mechanism moves backward to the position.

In another preferred embodiment, the rear end of the tumbler push rod of the control mechanism is disposed with a lock groove, the lower plug is disposed with a lock block fixing groove, a lock block is connected between the lock groove of the tumbler push rod of the control mechanism and the lock block fixing groove of the lower plug to make the rear end of the tumbler push rod of the control mechanism linked to the lower plug; when the lower plug moves axially, the lower plug drives the tumbler push rod of the control mechanism to move axially by the lock block.

In another preferred embodiment, the groove bottom of the push rod slide groove of the upper plug is further disposed with a lock block slide groove in the axial direction; the lock block slide groove of the upper plug is disposed between the lock block fixing groove of the lower plug and the lock groove of the tumbler push rod of the control mechanism; the lock block passes through the lock block slide groove of the upper plug and is coupled between the lock groove of the tumbler push rod of the control mechanism and the lock block fixing groove of the lower plug; when the lower plug drives the tumbler push rod of the control mechanism to move axially through the lower plug, the lock block moves axially in the lock block slide groove of the upper plug.

In another preferred embodiment, the lock block slide groove of the upper plug is disposed with a sloping slide groove, to which the lock block is coupled to make the lock block move axially in the lock block slide groove of the upper plug and further move radically; when the lower plug translates to the second position in the position difference direction, the lock block escapes out of the lock groove of the tumbler push rod of the control mechanism In another preferred embodiment, the bottom end of the lock block is disposed with a spring, two sides of the lock block are disposed with a wing, the sloping slide groove of the upper plug is faced down, the lock block is assembled in the lock block fixing groove of the lower plug through the spring; the wings of the lock block abuts against the sloping slide groove of the lock block slide groove of the upper plug.

In another preferred embodiment, the outer lock mechanism between the outer plug and the lock body is a pin mechanism; the pin mechanism is assembled radically between the outer plug and the lock body to restrict the rotating of the outer plug; the outer plug is further disposed with a push rod slide groove axially arranged and connected to the pin hole of the pin mechanism; the control mechanism comprises a pin push rod and a spring bolt slide block, the pin push rod of the control mechanism is assembled in the push rod slide groove of the outer plug and controls the pins of the pin mechanism; the rear end of the pin push rod of the control mechanism is linked to the spring bolt slide block; the spring bolt slide block is assembled to the rear portion of the outer plug.

In another preferred embodiment, the front end face of the spring bolt slide block of the control mechanism is disposed with an incline surface; the inner plug is disposed with a protruding portion protruding axially; the incline surface of the spring bolt slide block of the control mechanism is coupled to the protruding portion of the inner plug, making that when the inner plug is rotated, the spring bolt slide block moves a position axially accordingly so as to drive the pin push rod of the control mechanism to move axially.

In another preferred embodiment, the first plug and the second plug are arrange front and back, the first plug is a rear plug, the second plug is a front plug; the first lock mechanism is a rear lock mechanism, and the second lock mechanism is a front lock mechanism; the front lock mechanism is a blade mechanism, the blade mechanism comprises a tumbler and at least a blade coupled to the bottom portion of the tumbler; the blade is disposed with a key groove and at least a trap groove; the rear plug is further assembled with a control mechanism to control the tumbler; before the rear plug translates to the second position, the tumbler can not fall down; when the key is inserted into the key hole, the key unlocks the rear lock mechanism first, then the key pushes the rear plug to move axially backward to the second position to make the tumbler fall down; when the tumbler drops to the key groove of the blade, the front lock mechanism is unlocked, the front and rear plug rotate synchronously by the key to unlock the lock; when the tumbler drops to the trap groove of the blade, the front lock mechanism can not be unlocked and the blade can not move.

In another preferred embodiment, the control mechanism comprises the tumbler push rod and a coupling mechanism disposed between the tumbler push rod and the tumbler; the front plug is disposed with a push rod groove arranged axially; the push rod groove of the front plug is connected to a tumbler groove, which is used to assemble the tumbler, of the front plug; the tumbler push rod of the control mechanism is slidably assembled in the push rod groove of the front plug and is coupled to the tumbler; the rear end of the tumbler push rod of the control mechanism is linked to the rear plug; before the rear lock mechanism is unlocked, the tumbler push rod of the control mechanism can not move; before the tumbler push rod of the control mechanism translates to the second position, the tumbler can not fall down.

In another preferred embodiment, the coupling mechanism between the tumbler push rod and the tumbler comprises:

a slide groove disposed at the tumbler push rod of the control mechanism, the tumbler being slidably coupled to the slide groove of the tumbler push rod, the tumbler push rod of the control mechanism and the tumbler being movable in a cross way;

a raised column disposed at the tumbler, an incline surface disposed at the slide groove of the tumbler push rod of the control mechanism and a clip coupled to the incline surface and arranged in the horizontal direction; the bottom section of the incline surface of the slide groove of the tumbler push rod of the control mechanism being disposed with a raised column; one end of the clip being fixed to the raised column of the bottom section of the incline surface of the slide groove of the tumbler push rod of the control mechanism, while the other end being freely put on the top portion of the incline surface of the slide groove of the tumbler push rod of the control mechanism.

In another preferred embodiment, the sum of the raising size of the raised column of the tumbler and the width of the raised column of the incline surface of the slide groove of the tumbler push rod of the control mechanism is not larger than the width of the incline surface of the slide groove of the tumbler push rod of the control mechanism; the width of the clip is equal to the width of the incline surface of the tumbler push rod of the control mechanism.

In another preferred embodiment, before the tumbler push rod of the control mechanism moves backward, the raised column of the tumbler is restricted by the clip and the tumbler is restricted from falling down; when the tumbler push rod of the control mechanism translates to its position, the raised column of the tumbler escapes from the restriction of the clip and the tumbler falls down; when the tumbler push rod of the control mechanism moves forward, the raised column of the tumbler moves upward along the incline surface of the slide groove of the tumbler push rod of the control mechanism; when the tumbler push rod of the control mechanism moves forward to its position, the raised column of the tumbler pushes the free end of the clip away and resets to the upper end of the clip.

In another preferred embodiment, the top portion of the tumbler is assembled with a press block, the top portion of the press block is assembled with a spring, the spring abuts between the top portion of the press block and the lock body.

In another preferred embodiment, the section of the key groove and the trap groove are rectangle, circle or trapezoid shaped.

Compared to the existing known technology, the technical solution of the present invention has following advantages:

1. Two plugs are mutually controlled; the first plug restricts the unlocking of the second plug before the code of the first plug is unlocked; after the first plug is unlocked, the first plug can translate but not rotate; when the first plug translates to the second position, the first plug releases its restriction on the second plug, but the second plug still restricts the rotating of the first plug; after the second plug is unlocked, the first plug and the second plug can rotate synchronously to unlock the lock. This greatly increases the difficulty of unlocking a lock by techniques or by brute force, and also greatly increases the lock security.

2. During the first plug translates to the second position, the first plug transits an entrance of the second plug for insertion by an unlock device to a gradually partially closed state or a complete closed state. The method and the structure ensure the difficulty of unlocking the second plug after the first plug is unlocked.

3. A delayer is further provided between the lock body and the control mechanism; when the first plug translates to the second position in the position difference direction, the control mechanism pushes and compresses the delayer to store energy; when the first plug and the second plug rotate synchronously, the delayer keeps the energy and does not push the control mechanism to return; if the first plug and the second plug do not rotate, the delayer releases energy and pushes the control mechanism to return to the position to control the second lock mechanism in a preset period. The present invention applies delay controlling, greatly increasing the lock security.

4. The present invention applies a new idea and a new method by changing position difference to time difference, which is new in the lock industry and has a leading position in the technology. The second plug can be unlocked only if the first plug translates to the second position (the position difference), and the translation of the first plug takes time (time difference); during this time period, there are a plurality of restrict conditions; in detailed, at the time the first plug pushes in, the gate of the entrance of the key hole is gradually closed, the delayer stores energy, the second plug can be unlocked after the first plug pushes to the second position, at this time, the gate is partially closed or completely closed, providing no passage for a person to stir the lock; at the same time, the delayer starts to work, the unlocking period is restricted to the time the delayer sets; if the time is out, the delayer releases energy, making the second plug reset to an invalid unlocking state. Therefore, the present invention presents technical unlocking by the time-space conversion, thus greatly increasing the lock security.

BRIEF DESCRIPTION OF THE DRAWINGS

The present invention will be further described with the drawings and embodiments; but it should be noted that, the scope of the present invention claims is not restricted to the embodiments.

FIG. 9 illustrates a schematic diagram of the lock of the second embodiment before a key is pushed in.

FIG. 10 illustrates a schematic diagram of the lock of the second embodiment that the rear plug does not move after the key is pushed in.

FIG. 11 illustrates a schematic diagram of the lock of the second embodiment that the rear plug moves in a first step after the key is pushed in.

FIG. 12 illustrates a schematic diagram of the lock of the second embodiment that the rear plug moves in a second step after the key is pushed in.

FIG. 13 illustrates a schematic diagram of the lock of the second embodiment that the rear plug moves in a third step after the key is pushed in.

FIG. 14 illustrates a schematic diagram of the lock of the second embodiment that the rear plug translates to the second position after the key is pushed in.

FIG. 26 illustrates a schematic diagram of the lock of the third embodiment before a key is inserted in.

FIG. 27 illustrates a schematic diagram of the lock of the third embodiment that the lower plug does not move after the key is inserted in.

FIG. 28 illustrates a schematic diagram of the lock of the third embodiment that the lower plug does not move to the second position after the key is inserted in.

FIG. 29 illustrates a schematic diagram of the lock of the third embodiment that the lower plug translates to the second position after the key is inserted in.

FIG. 38 illustrates a schematic diagram of the lock of the Fourth embodiment before the key is inserted in.

FIG. 40 illustrates a schematic diagram of the lock of the fourth embodiment that the lower plug does not move after the key is inserted in.

FIG. 57 illustrates a schematic diagram of the lock of the fifth embodiment that the inner plug does not rotate after the key is inserted in.

FIG. 58 illustrates a sectional diagram of the lock of the fifth embodiment that the inner plug does not rotate after the key is inserted in.

FIG. 61 illustrates a schematic diagram of the inner plug and the spring bolt slide block of the lock of the fifth embodiment that the inner plug does not rotate after the key is inserted in.

FIG. 62 illustrates a schematic diagram of the lock of the fifth embodiment that the inner plug rotates an angle but not to the second position after the key is inserted in.

FIG. 63 illustrates a sectional diagram of the lock of the fifth embodiment that the inner plug rotates an angle but not to the second position after the key is inserted in.

FIG. 66 illustrates a schematic diagram of the inner plug and the spring bolt slide block of the lock of the fifth embodiment that the inner plug rotates an angle but not to the second position after the key is inserted in.

FIG. 68 illustrates a sectional diagram of the lock of the fifth embodiment that the inner plug rotates to the second position after the key is inserted in and the outer lock mechanism does not unlock.

FIG. 69 illustrates a schematic diagram of FIG. 68 in S6 direction.

FIG. 70 illustrates a sectional diagram of S7-S7 line of FIG. 68.

FIG. 75 illustrates a schematic diagram of the lock of the sixth embodiment before a key is inserted in.

FIG. 79 illustrates a schematic diagram of a tumbler, a push rod and a front plug of the lock of the sixth embodiment before the key is inserted in.

FIG. 80 illustrates a schematic diagram of the lock of the sixth embodiment that the rear plug does not push in after the key is inserted in.

FIG. 82 illustrates a schematic diagram of the tumbler, the push rod and the front plug of the lock of the sixth embodiment that the rear plug does not push in after the key is inserted in.

FIG. 84 illustrates a schematic diagram of the lock of the sixth embodiment that the rear plug does not push to the second position after the key is inserted in.

FIG. 86 illustrates a schematic diagram of the tumbler, the push rod and the front plug of the lock of the sixth embodiment that the rear plug does not push to the second position after the key is inserted in.

DETAILED DESCRIPTION OF THE EMBODIMENTS

First Embodiment

Figure 1:
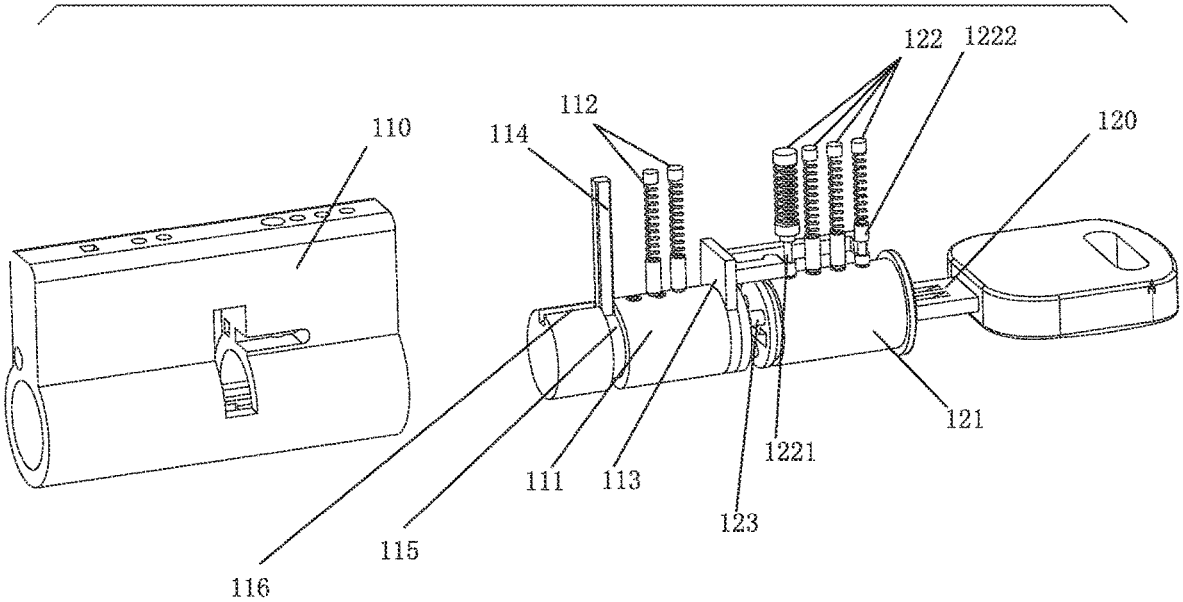
FIG. 1 illustrates a schematic diagram of a lock using the method for the present invention of a first embodiment.
Figure 2:
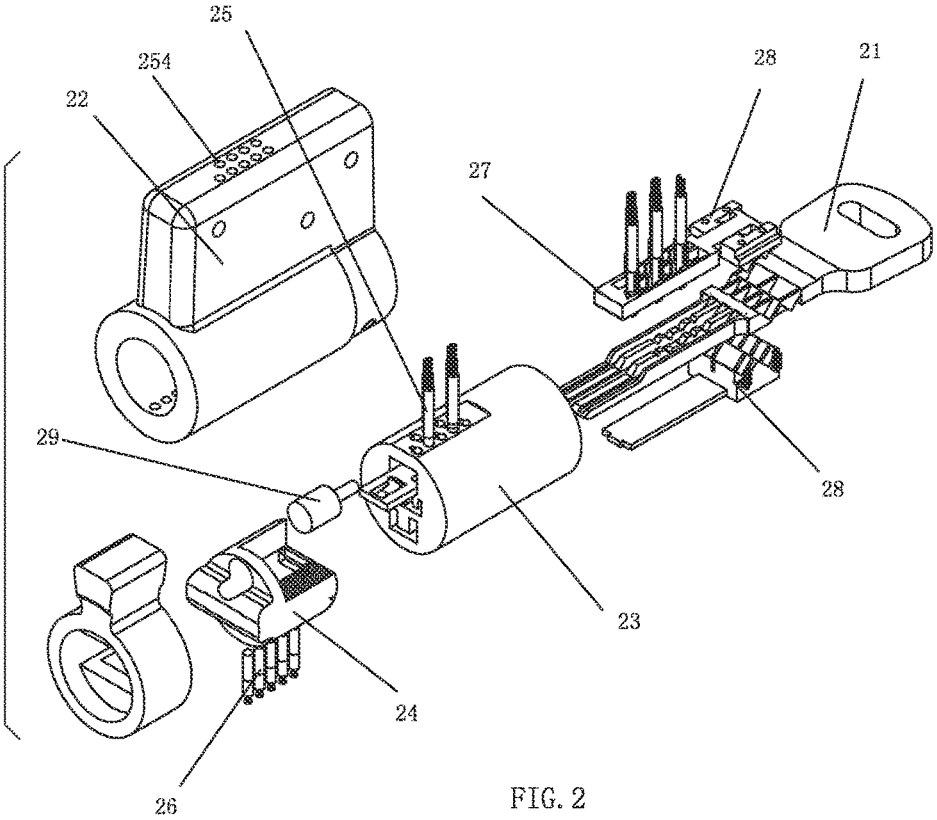
FIG. 2 illustrates a schematic and exploded diagram of a lock with dual plug of a second embodiment.
Figure 3:
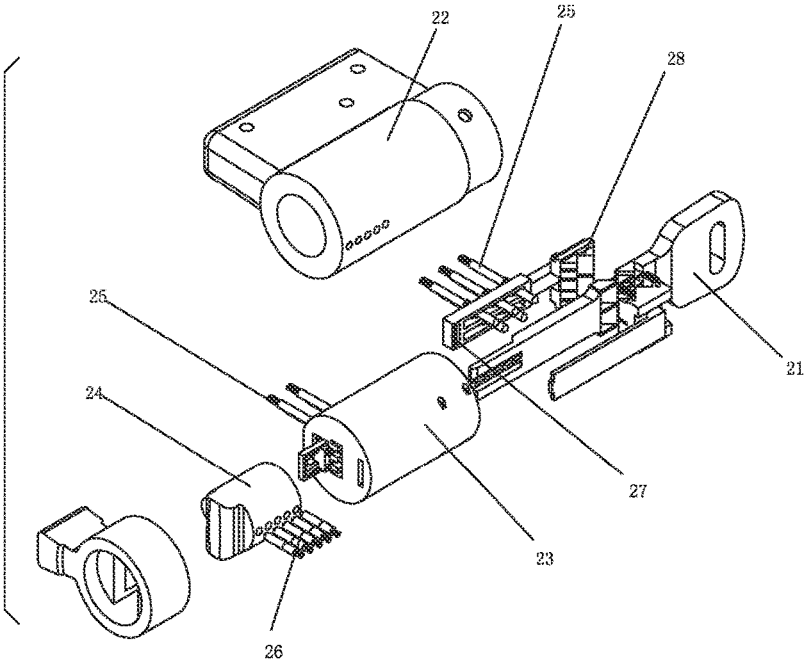
FIG. 3 illustrates a schematic and exploded diagram of the lock of the second embodiment in another view angle.
Figure 4:
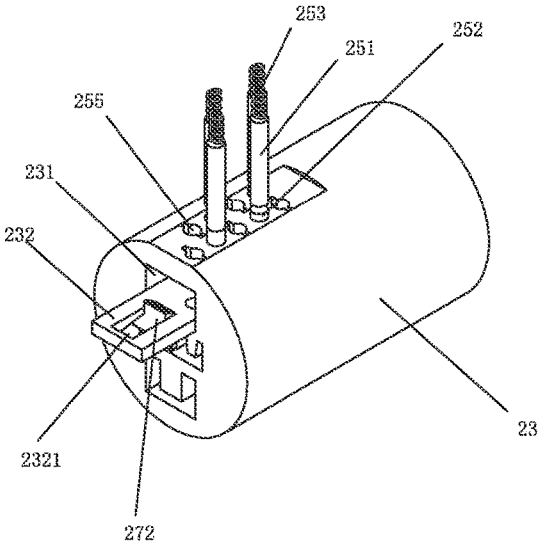
FIG. 4 illustrates a schematic diagram of a front plug of the lock of the second embodiment.
Figure 5:
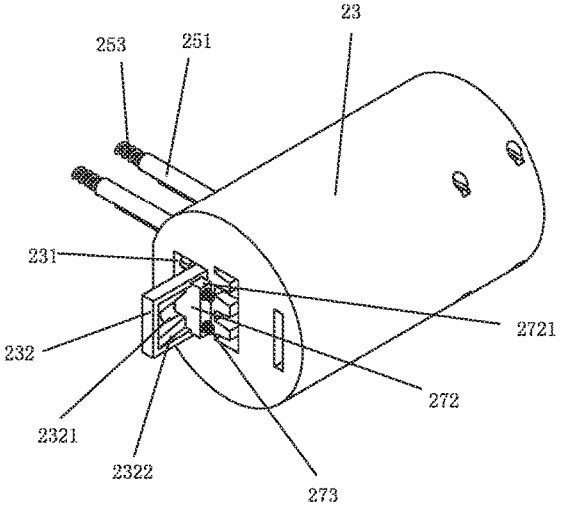
FIG. 5 illustrates a schematic diagram of the front plug of the lock of the second embodiment in another view angle.
Figure 6:
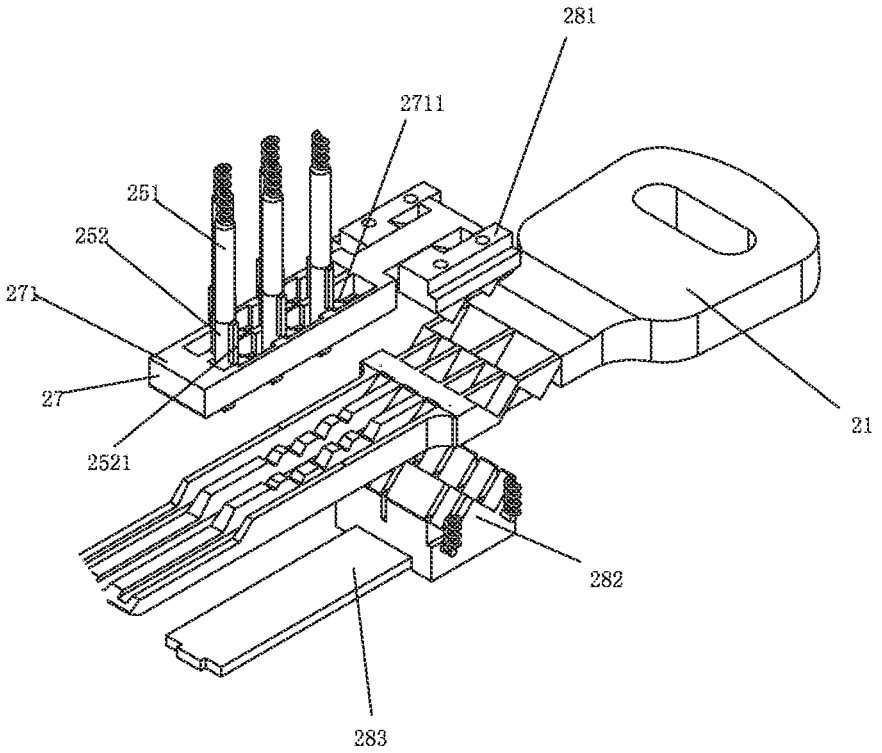
FIG. 6 illustrates a schematic diagram of a control mechanism and a font lock mechanism of the lock of the second embodiment.
Figure 7:
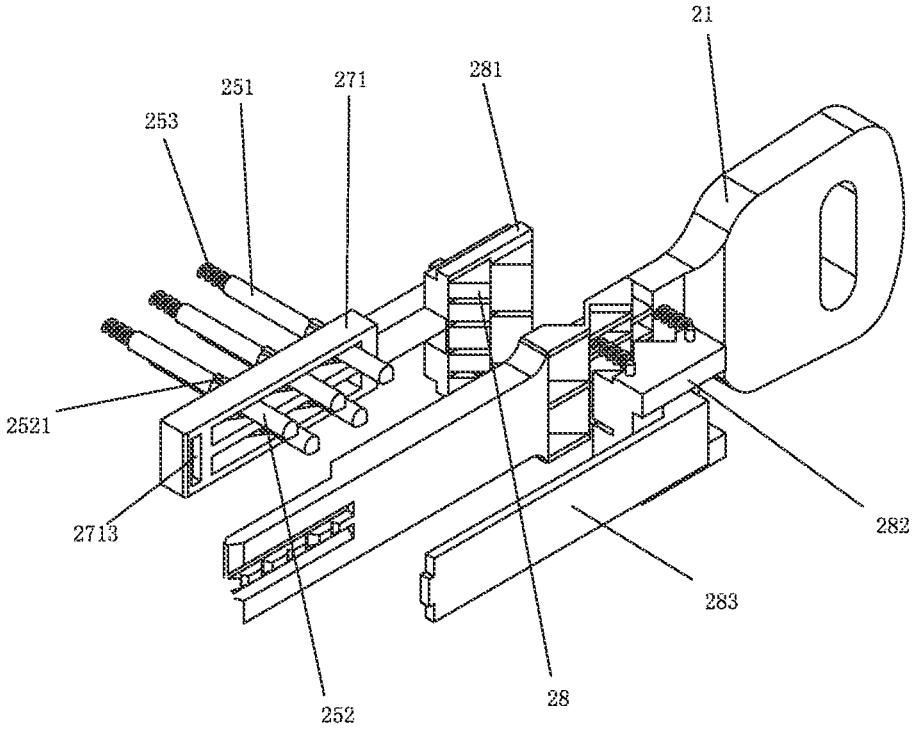
FIG. 7 illustrates a schematic diagram of the control mechanism and the font lock mechanism of the lock of the second embodiment in another view angle.
Figure 8:
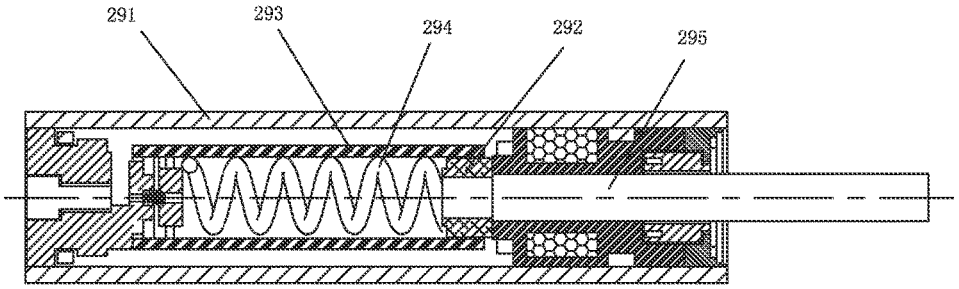
FIG. 8 illustrates a schematic diagram of a delayer of the lock of the second embodiment.
Figure 10:
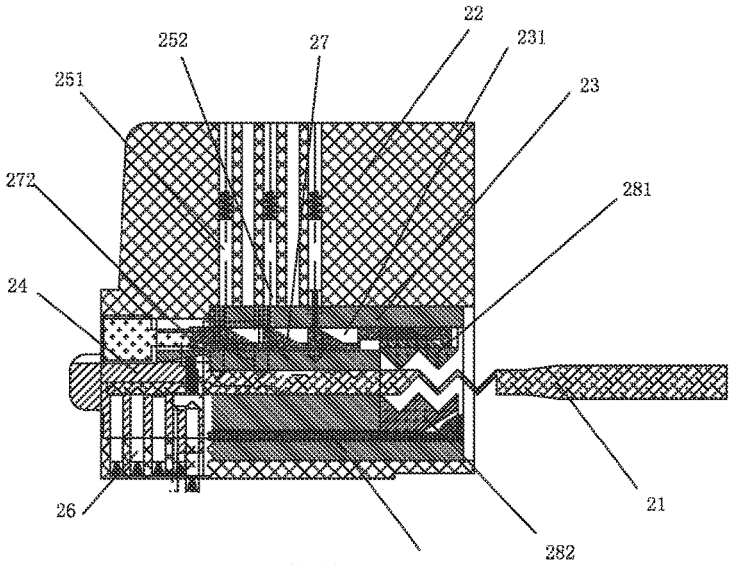
Figure 9:
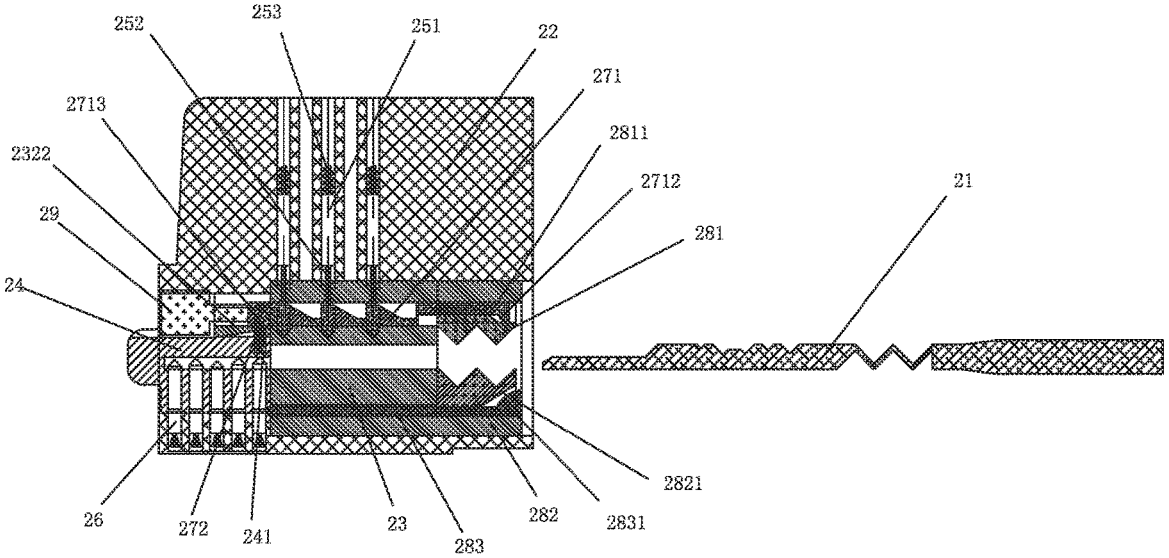
Figure 11:
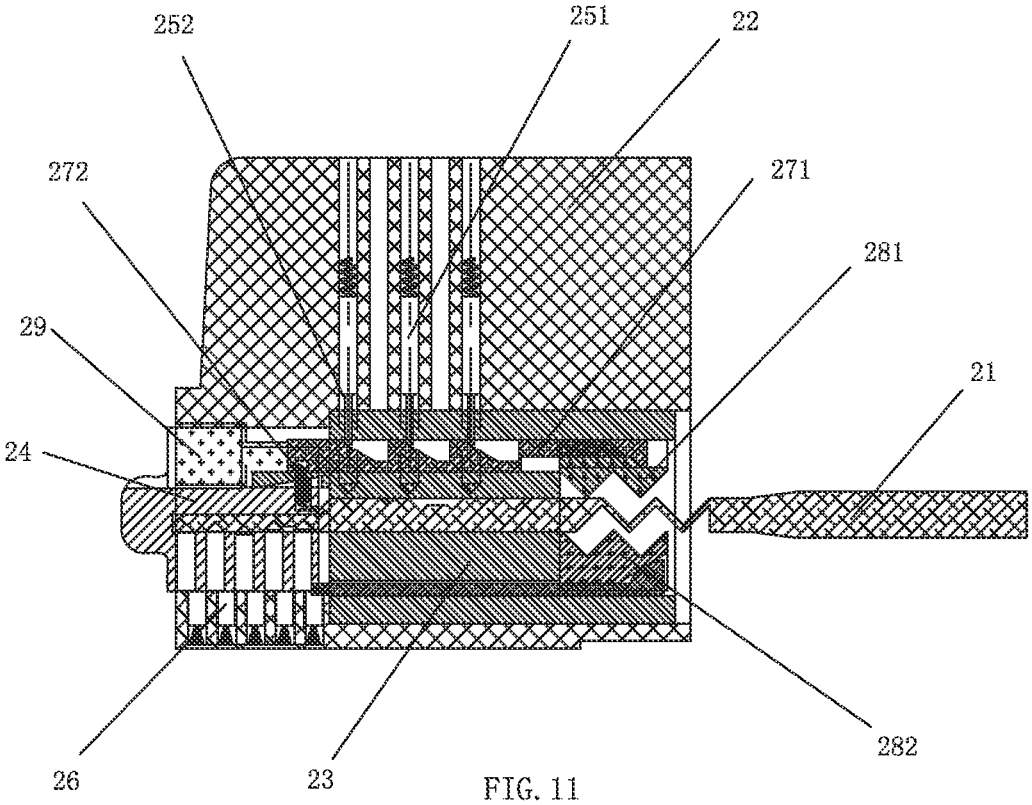
Figure 12:
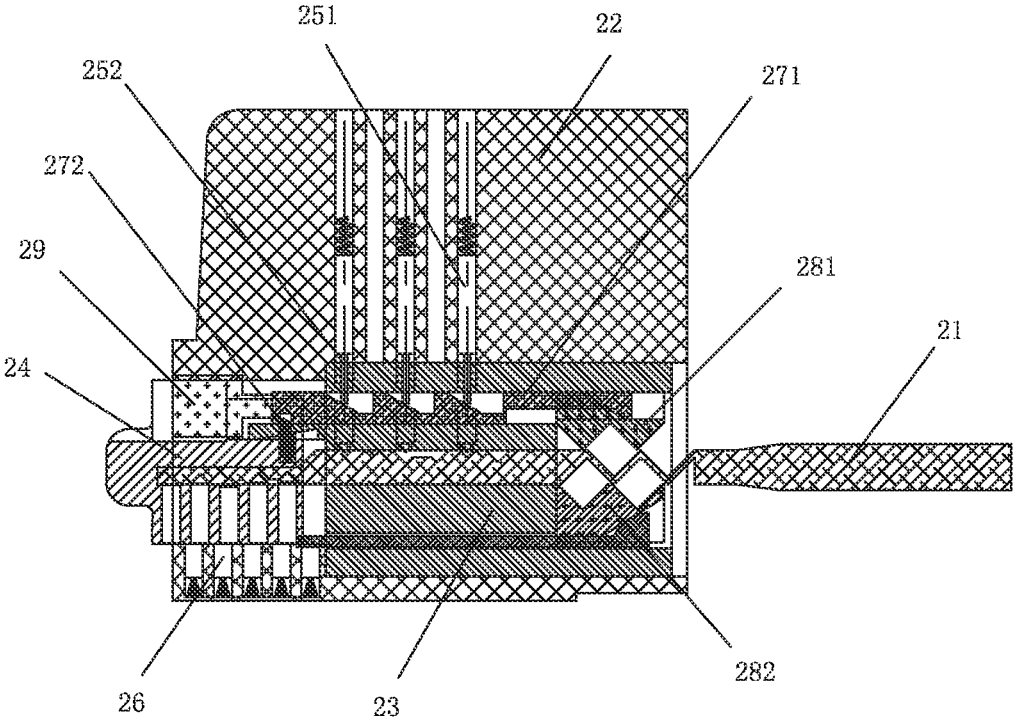
Figure 13:
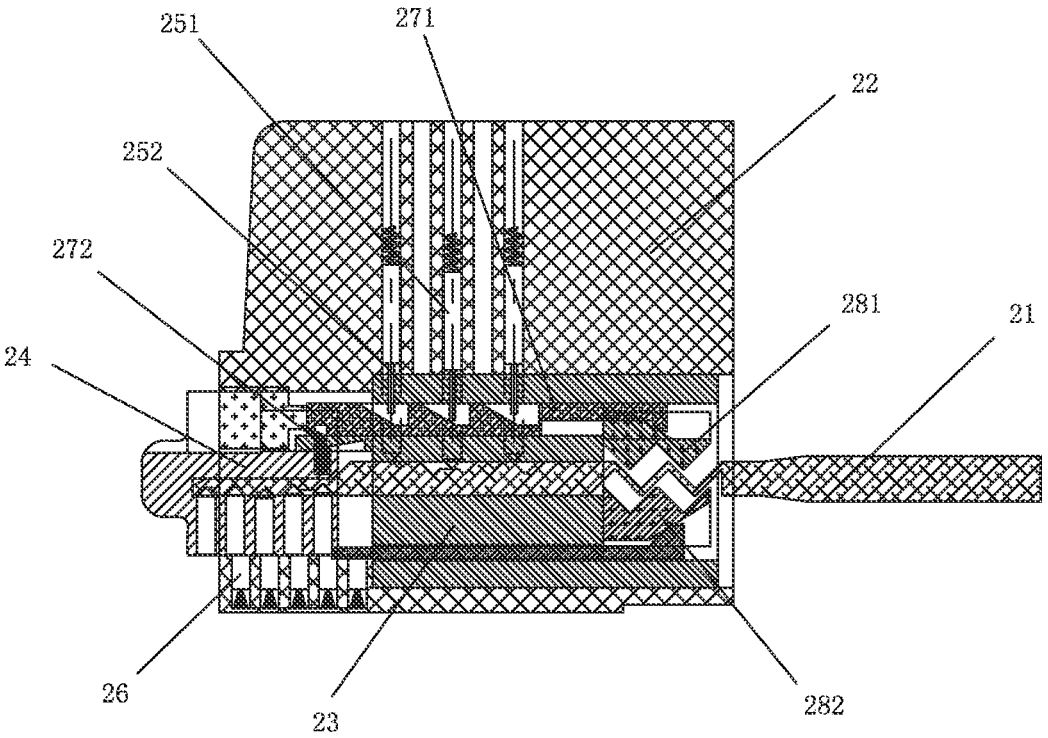
Figure 14:
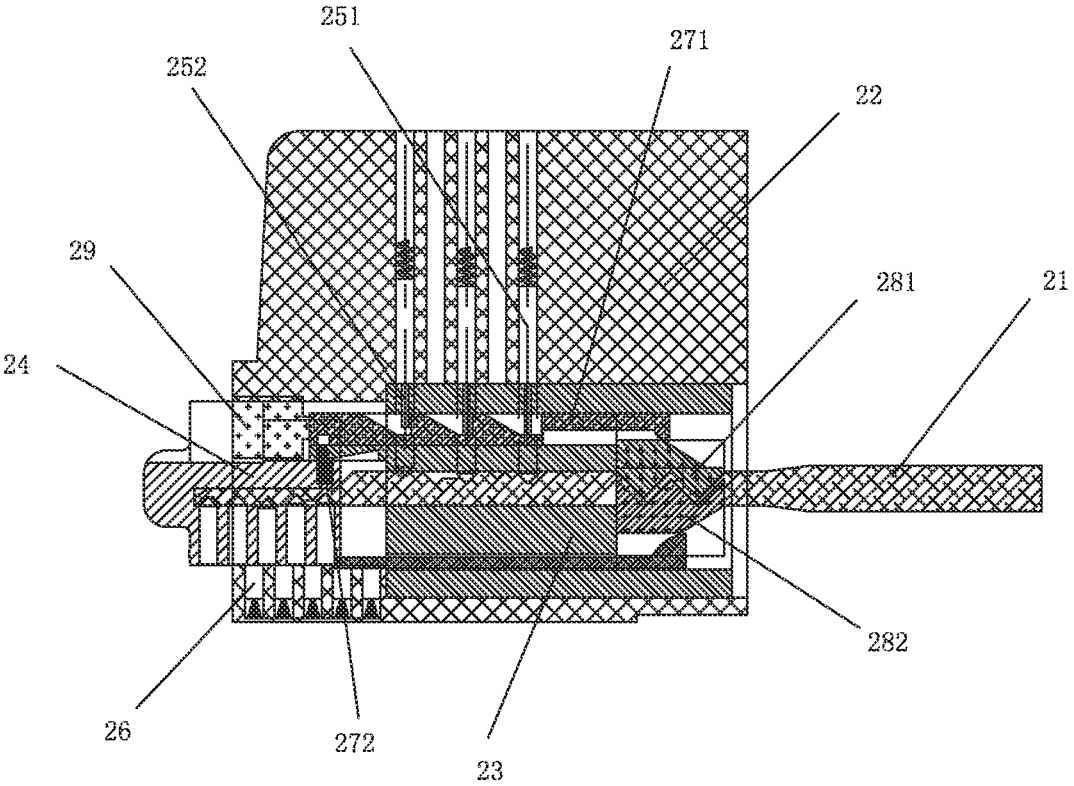
Figure 15:
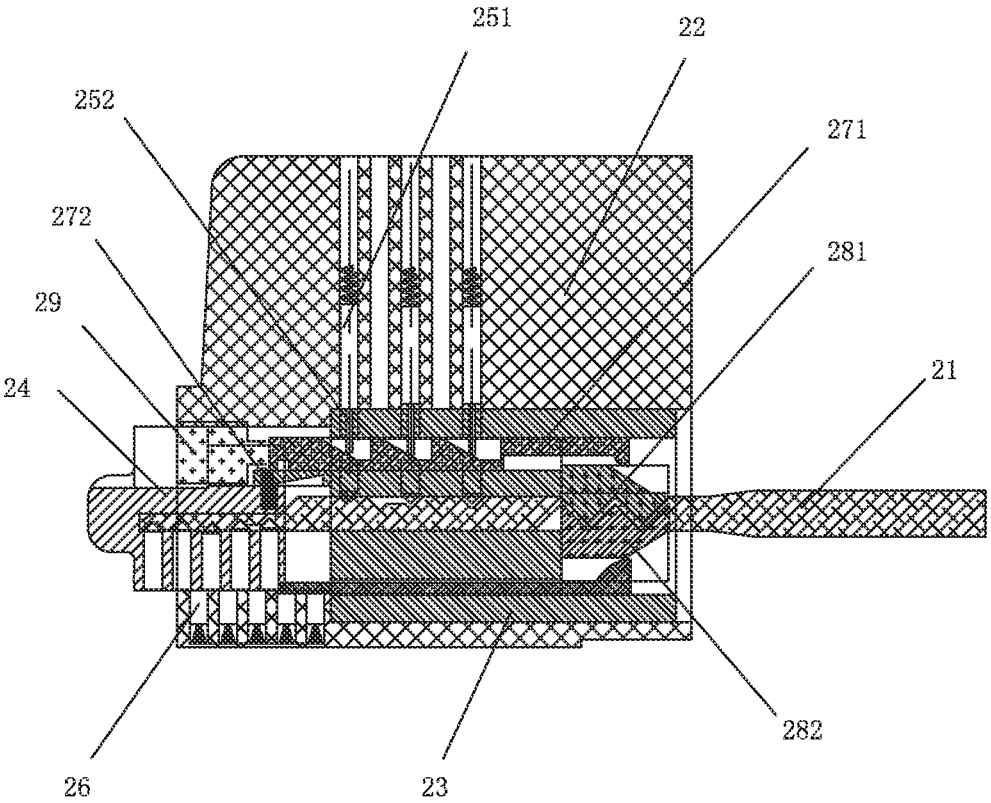
FIG. 15 illustrates a schematic diagram of the lock of the second embodiment that the rear plug translates to the second position after the key is pushed in, and the two plugs do not rotate and the delayer starts to work.
Figure 16:
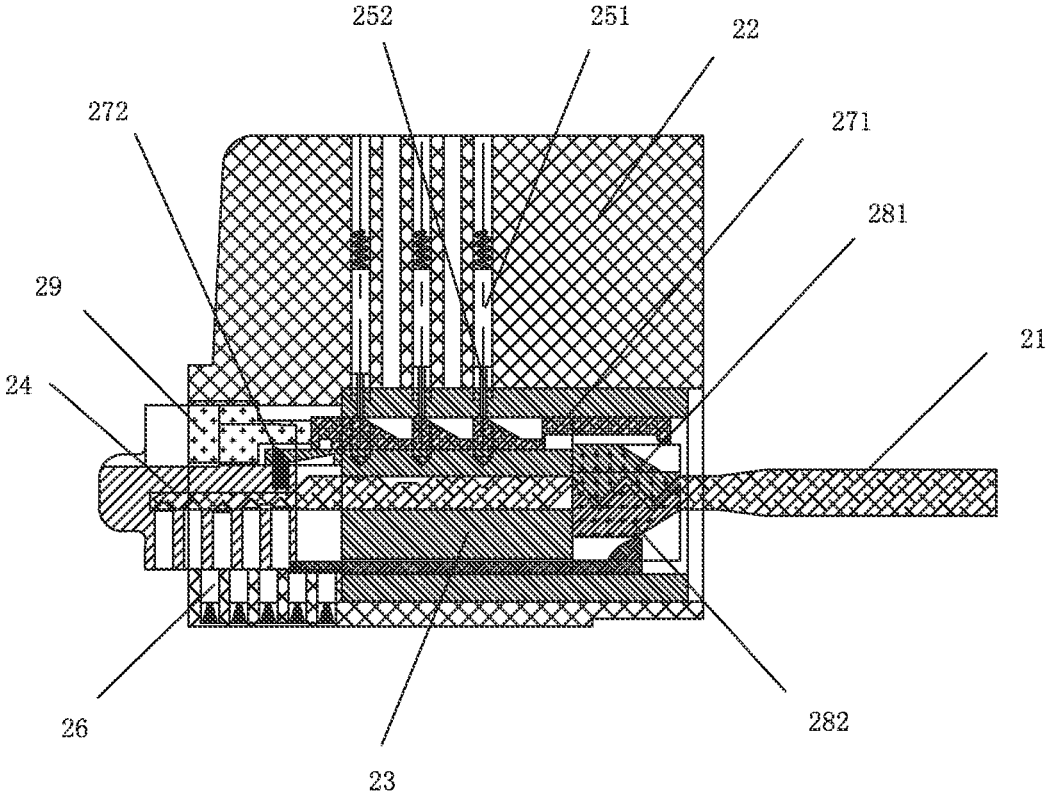
FIG. 16 illustrates a schematic diagram of the lock of the second embodiment that the delayer is pushed to the second position.
Figure 17:
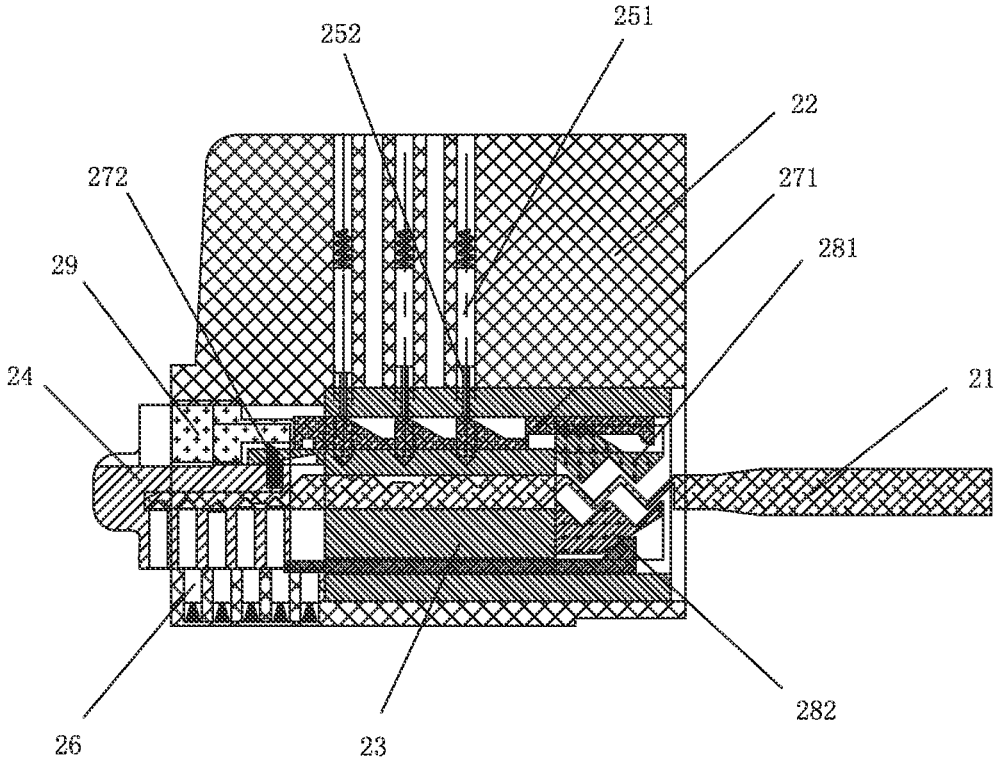
FIG. 17 illustrates a schematic diagram of the lock of the second embodiment that the rear plug moves in a first step.
Figure 18:
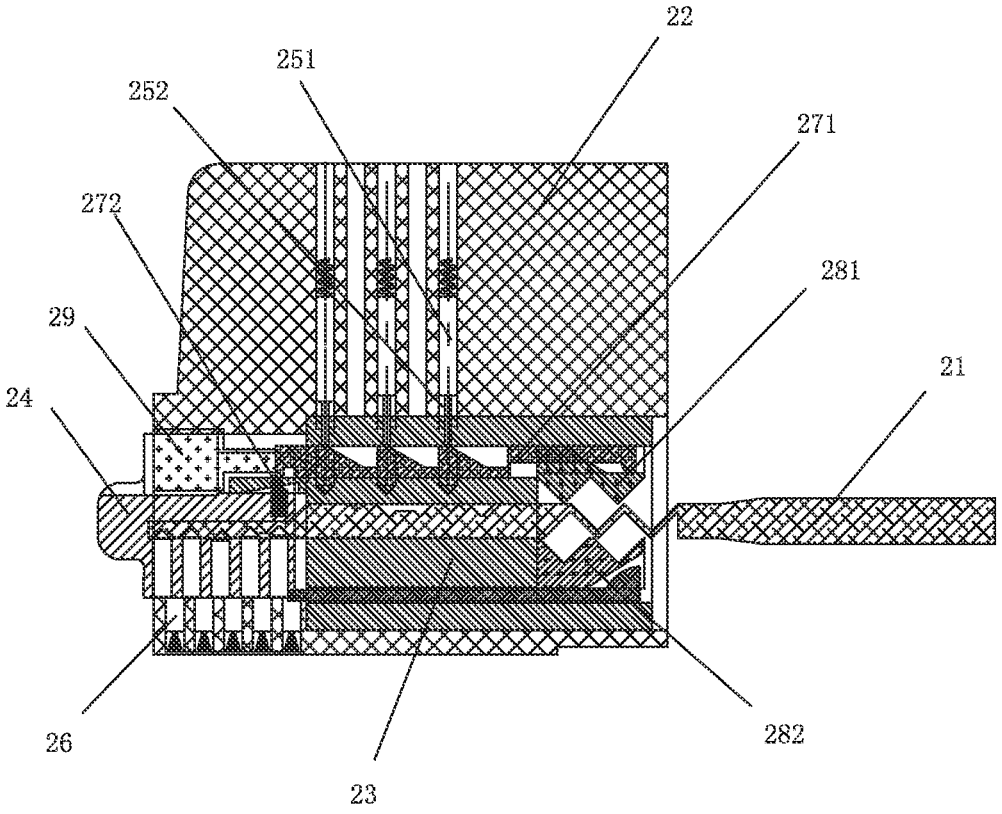
FIG. 18 illustrates a schematic diagram of the lock of the second embodiment that the rear plug moves in a second step.
Figure 19:
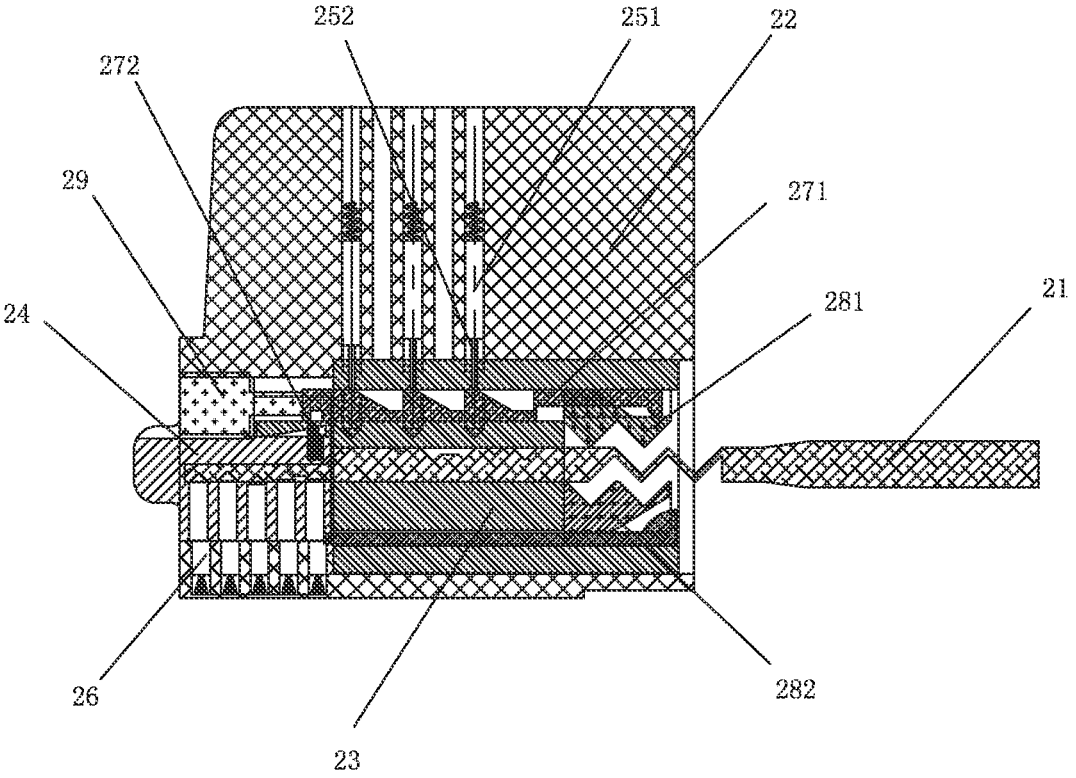
FIG. 19 illustrates a schematic diagram of the lock of the second embodiment that the rear plug moves in a third step.
Figure 20:
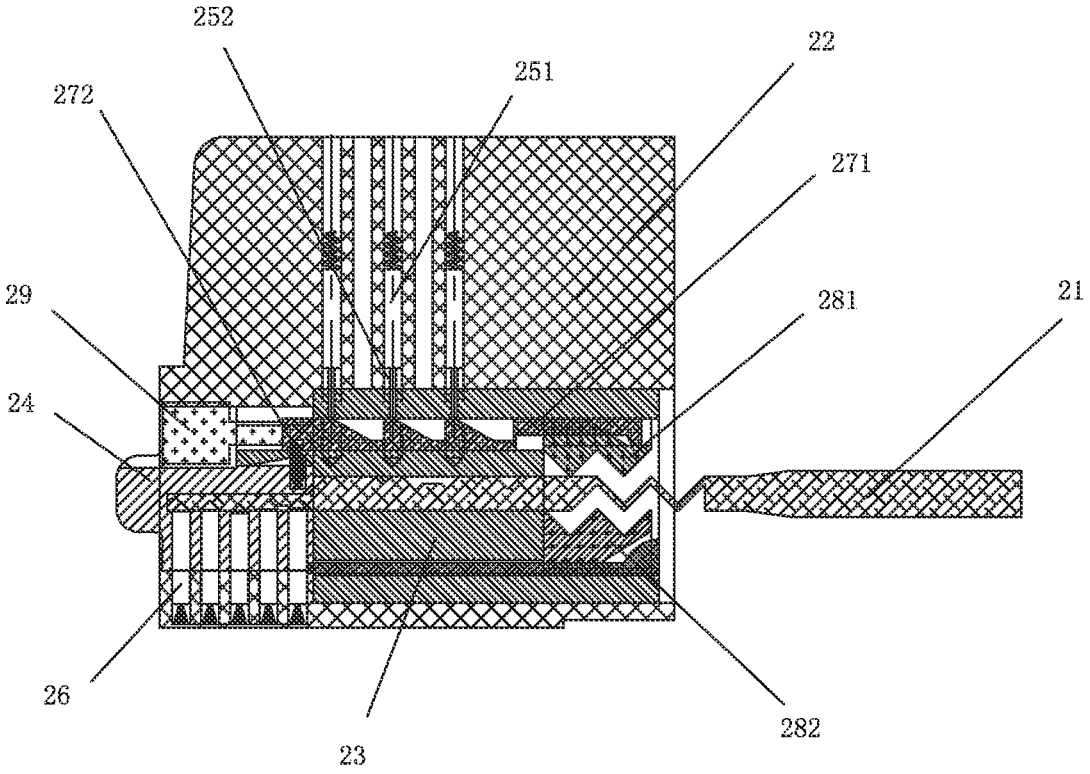
FIG. 20 illustrates a schematic diagram of the lock of the second embodiment that the rear plug returns to the initial position.
Figure 21:
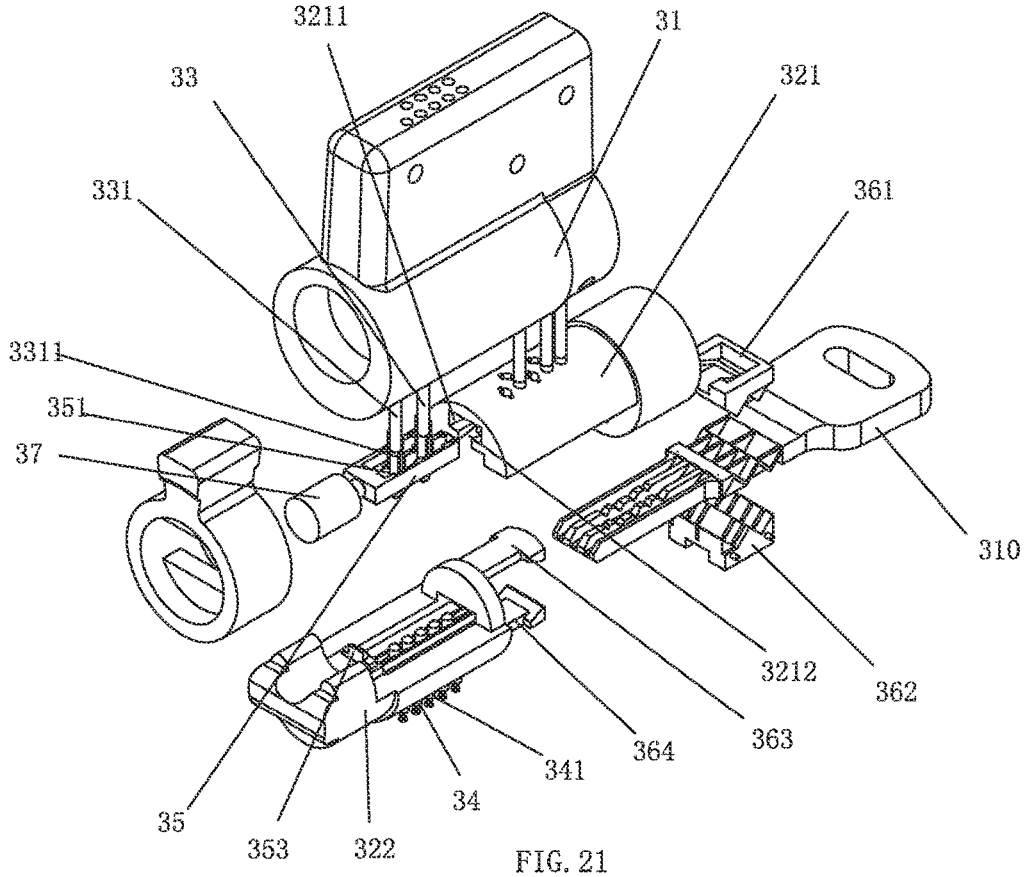
FIG. 21 illustrates a schematic and exploded diagram of a lock with dual plug in a third embodiment of the present invention.
Figure 26:
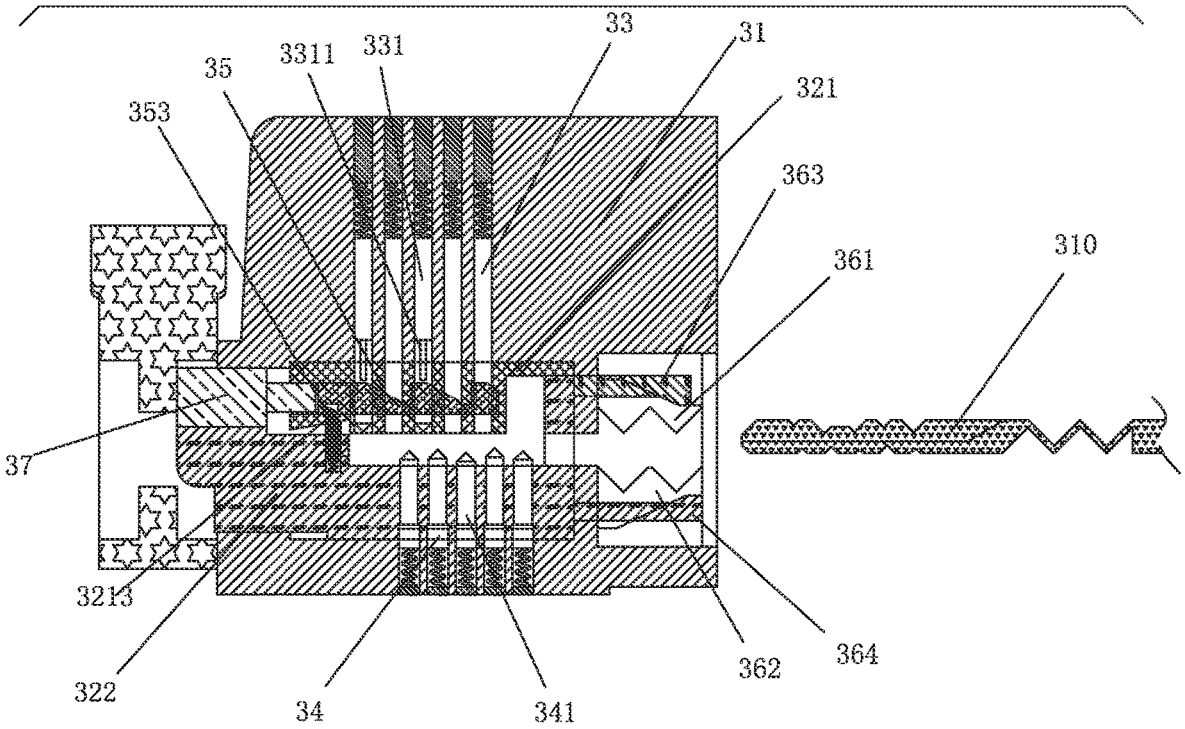
Figure 22:
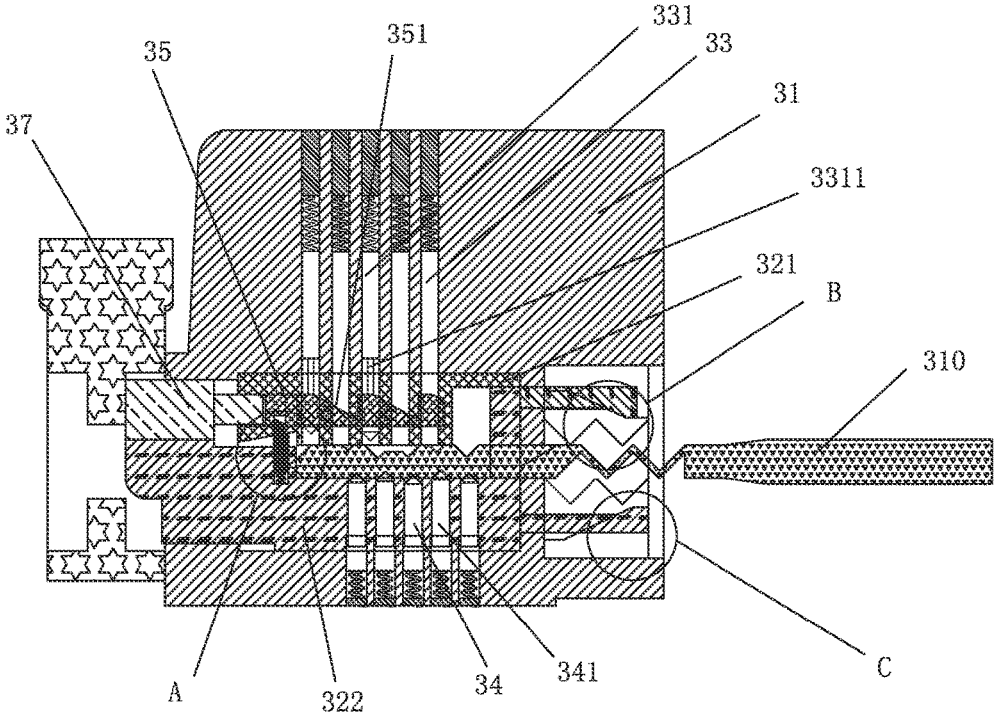
FIG. 22 illustrates a sectional diagram of the lock of the third embodiment.
Figure 23:
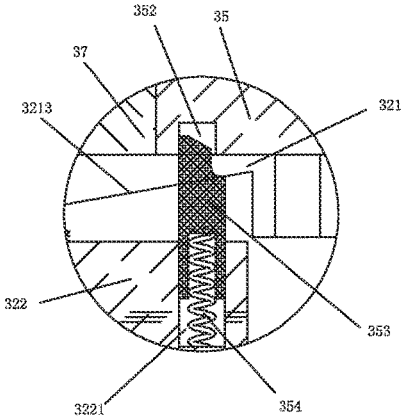
FIG. 23 illustrates an enlargement diagram of A of FIG. 22.
Figure 24:
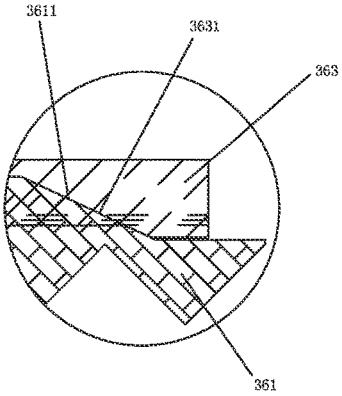
FIG. 24 illustrates an enlargement diagram of B of FIG. 22.
Figure 25:
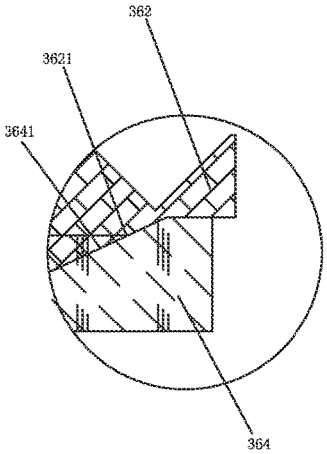
FIG. 25 illustrates an enlargement diagram of C of FIG. 22.
Figure 27:
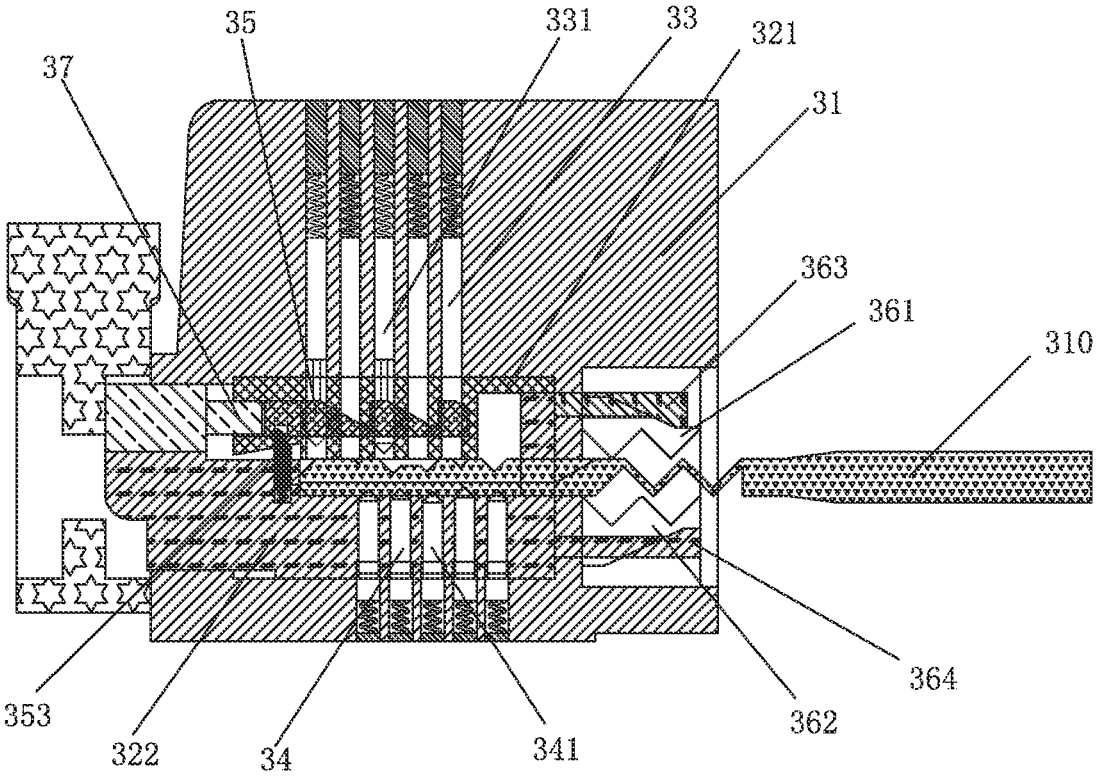
Figure 28:
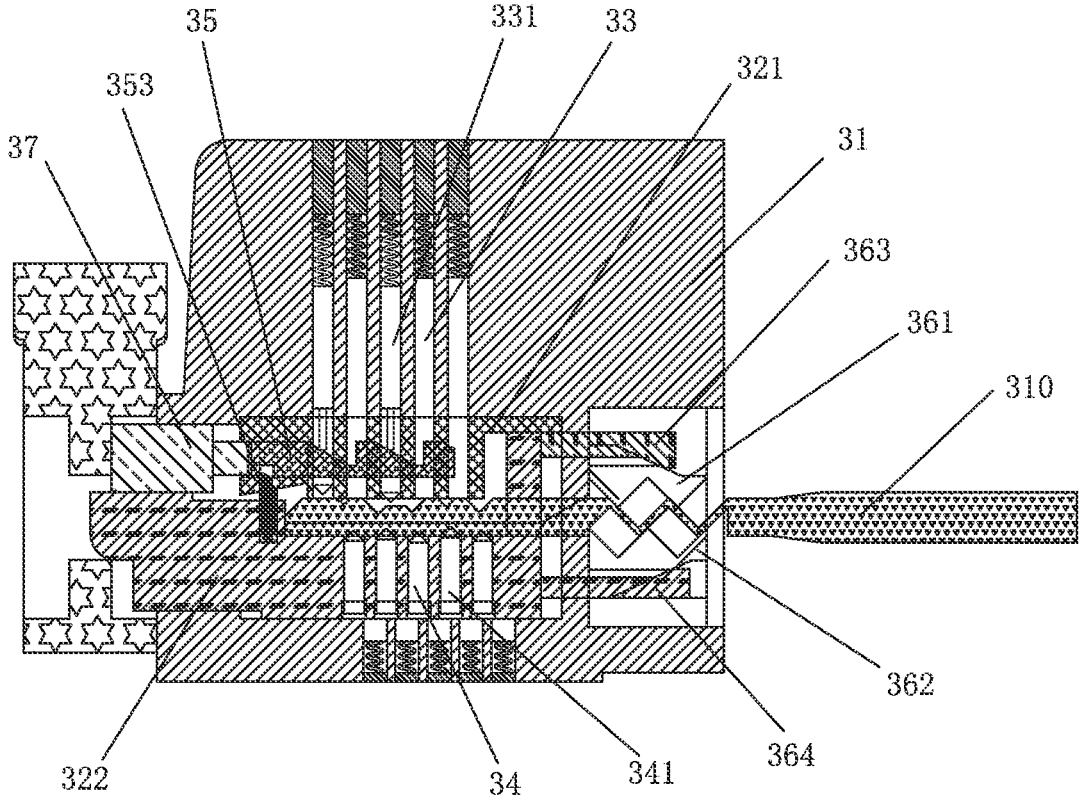
Figure 29:
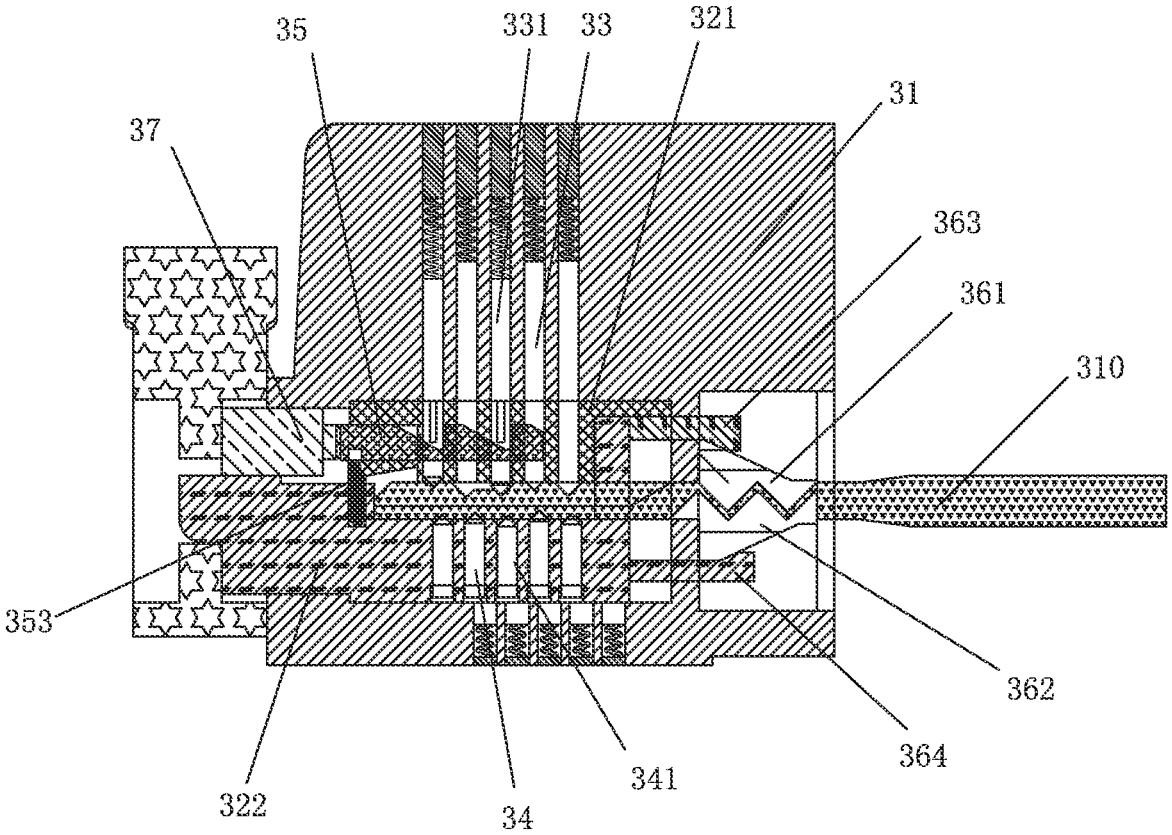
Figure 30:
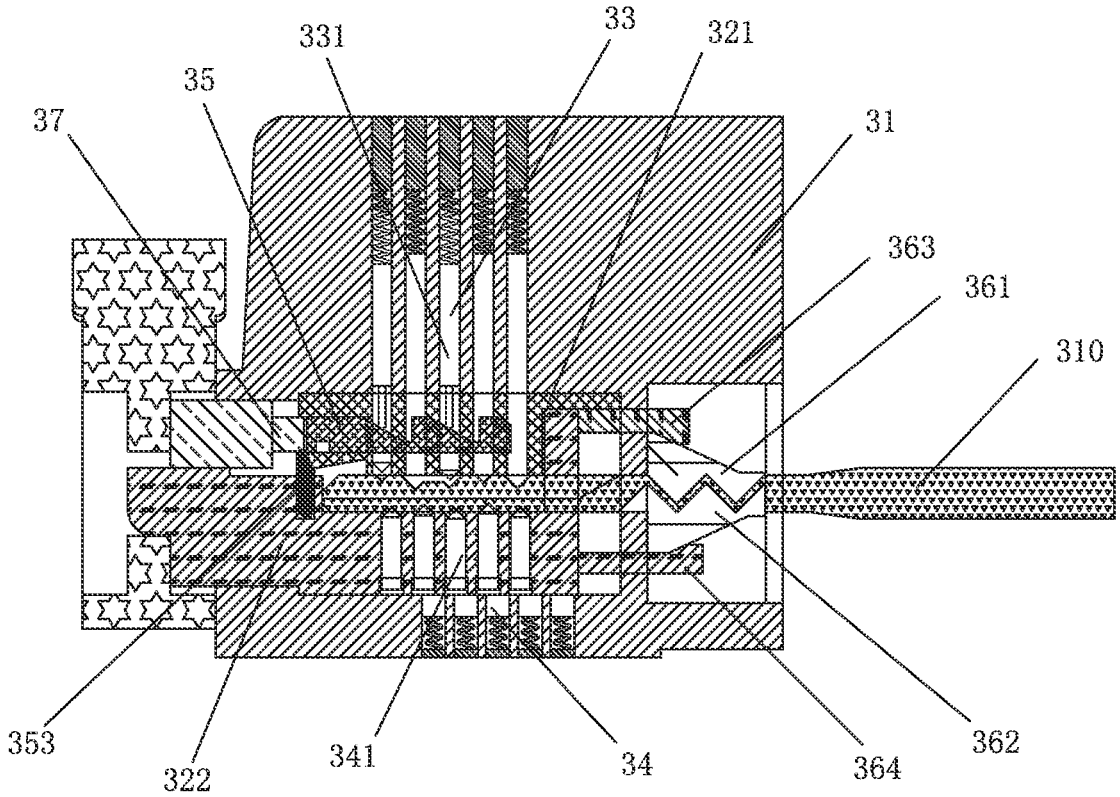
FIG. 30 illustrates a schematic diagram of the lock of the third embodiment that the lower plug translates to the second position after the key is inserted in, and the rear plug does not rotate and the delayer starts to work.
Figure 31:
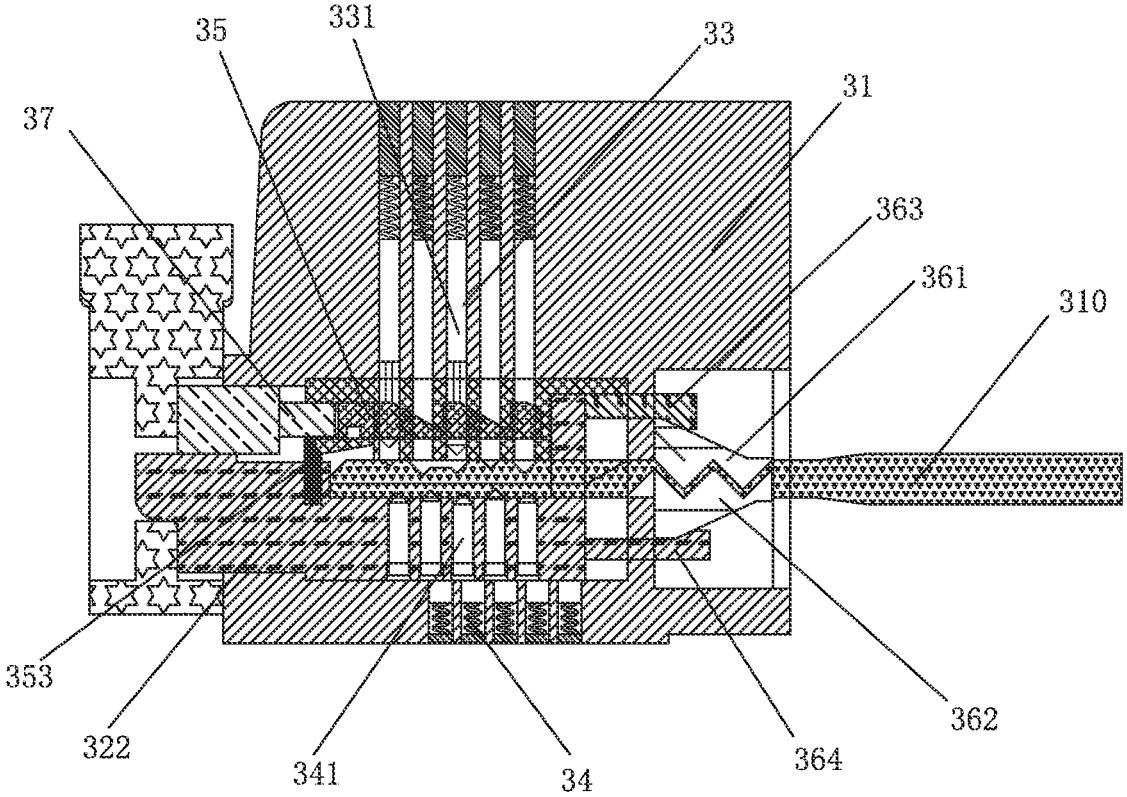
FIG. 31 illustrates a schematic diagram of the lock of the third embodiment that the delayer pushes in to the second position.
Figure 32:
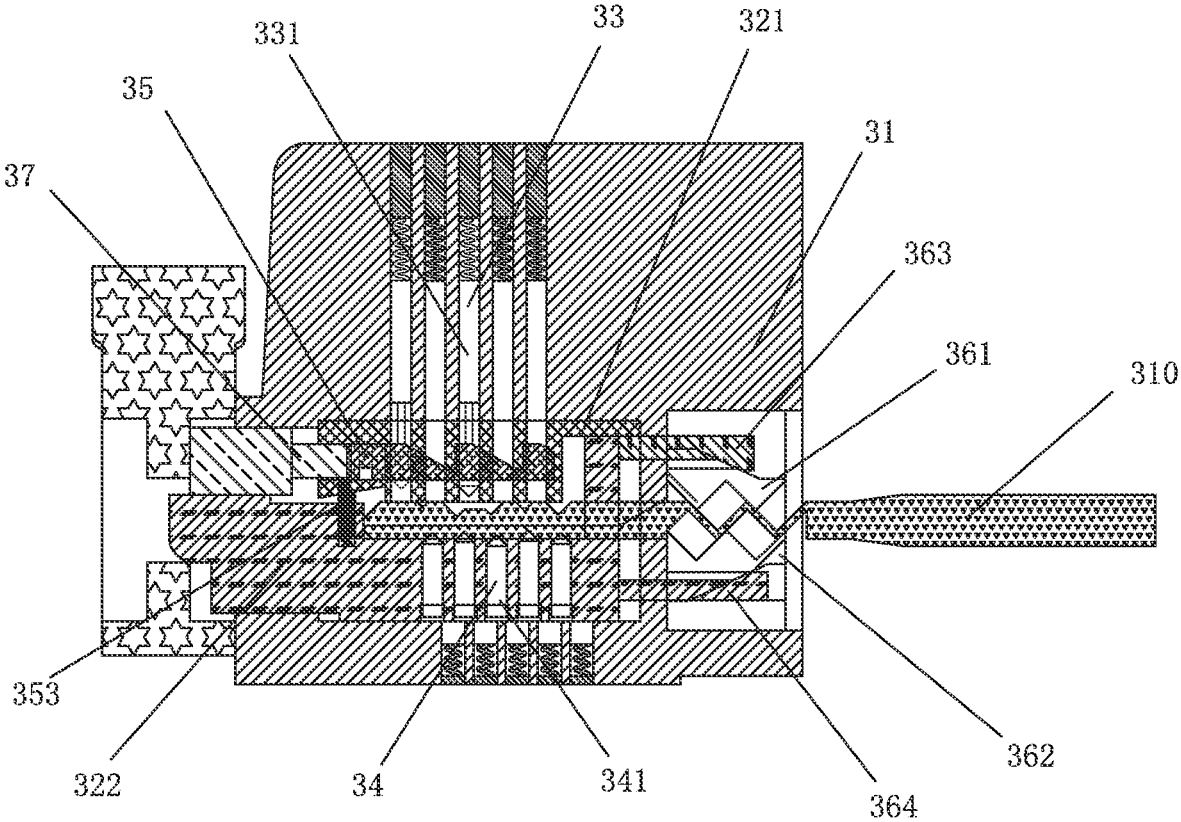
FIG. 32 illustrates a schematic diagram of the lock of the third embodiment that the lower plug is being reset.
Figure 33:
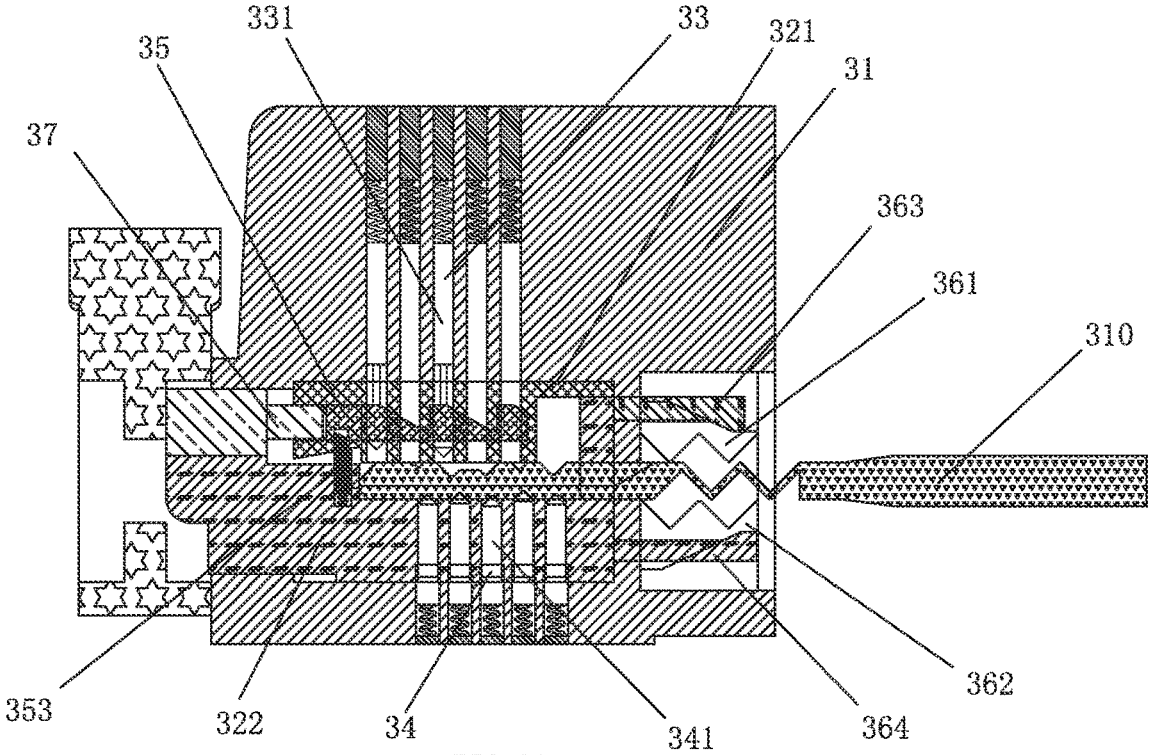
FIG. 33 illustrates a schematic diagram of the lock of the third embodiment that the lower plug resets to the second position.
Figure 34:
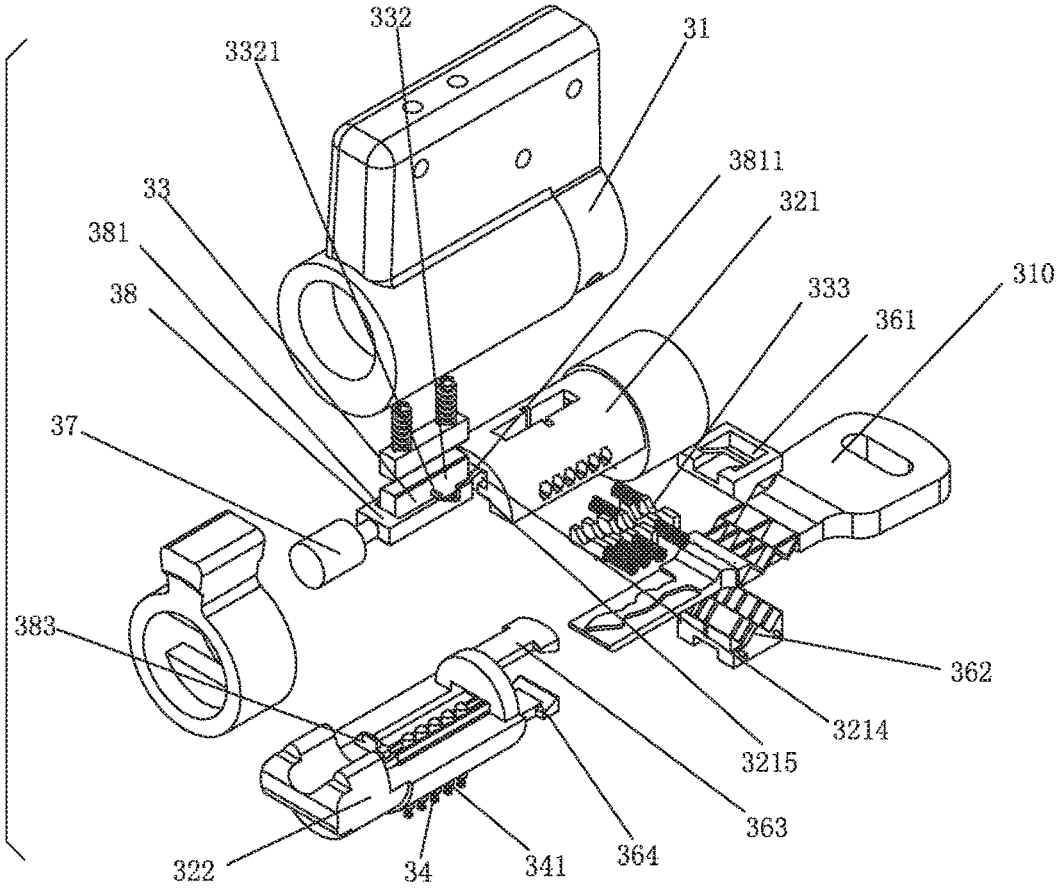
FIG. 34 illustrates a schematic and exploded diagram of the lock with dual plug of a fourth embodiment of the present invention.
Figure 35:
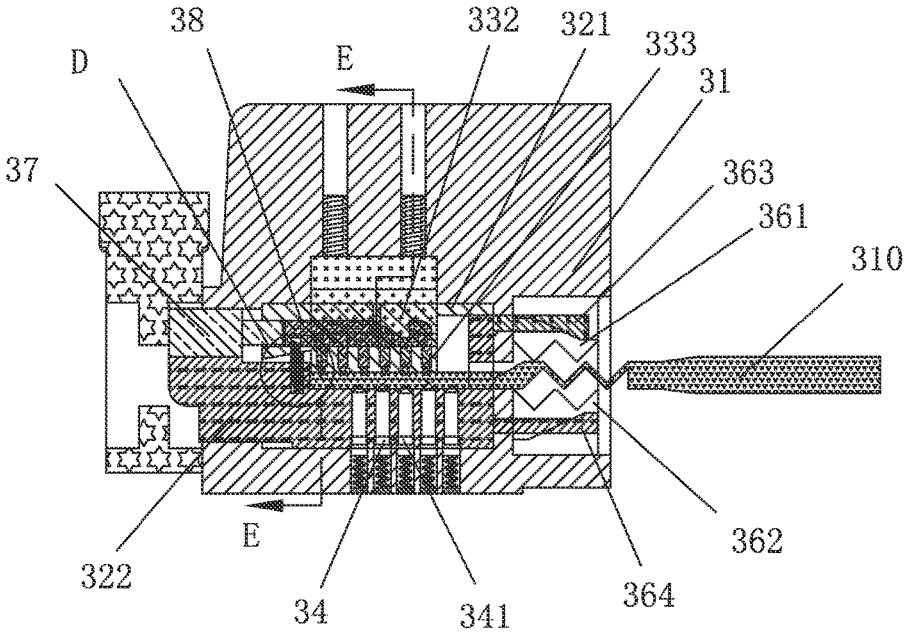
FIG. 35 illustrates a sectional diagram of the lock of the fourth embodiment.
Figure 36:
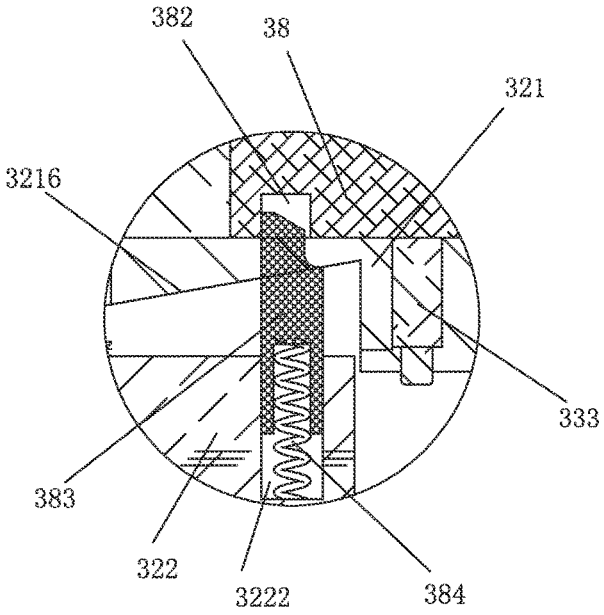
FIG. 36 illustrates an enlargement diagram of D of FIG. 35.
Figure 37:
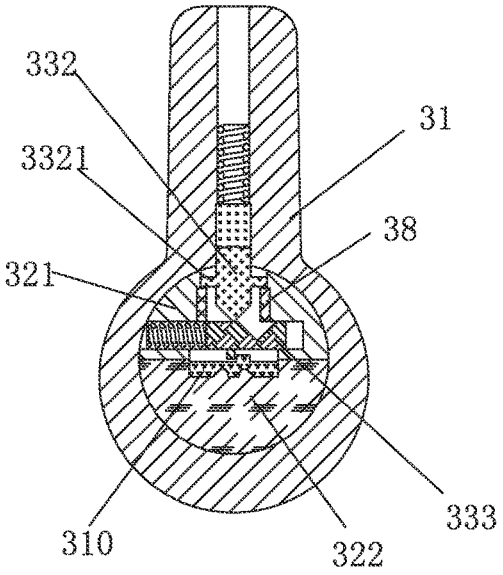
FIG. 37 illustrates a sectional diagram of E-E line of FIG. 35.
Figure 38:
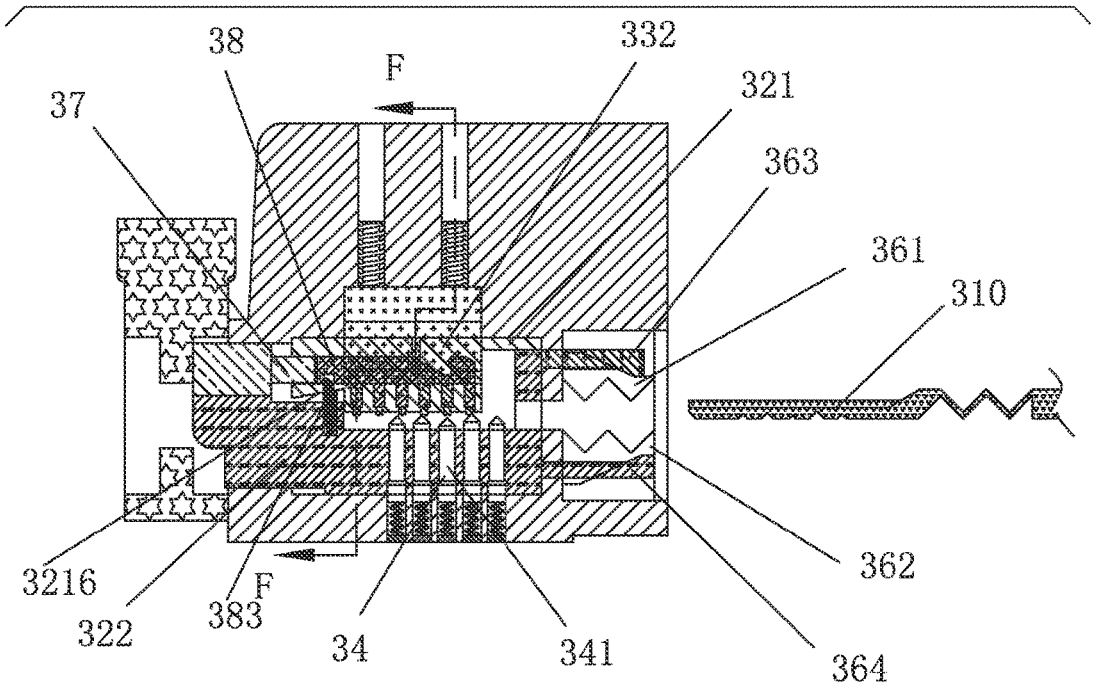
Figure 39:
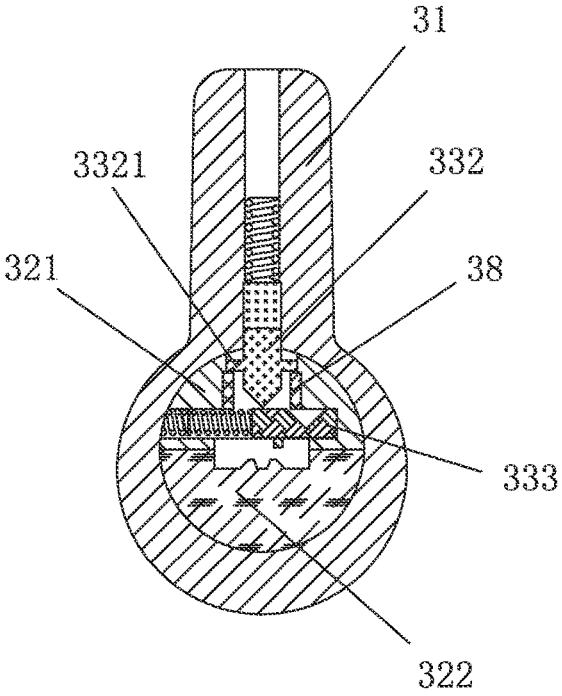
FIG. 39 illustrates a sectional diagram of F-F line of FIG. 38.
Figure 40:
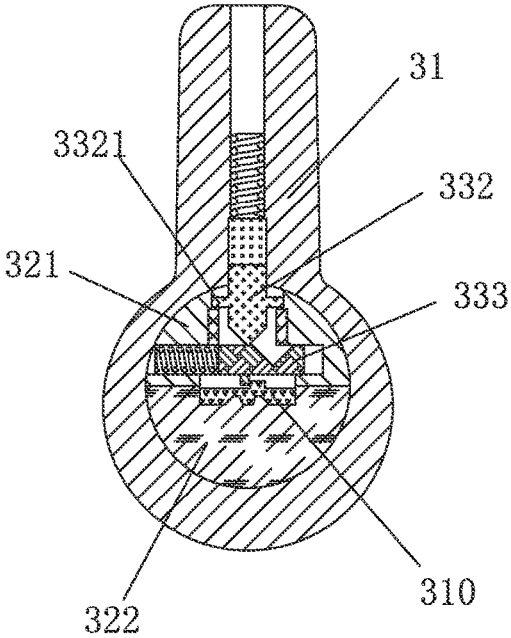
Figure 41:
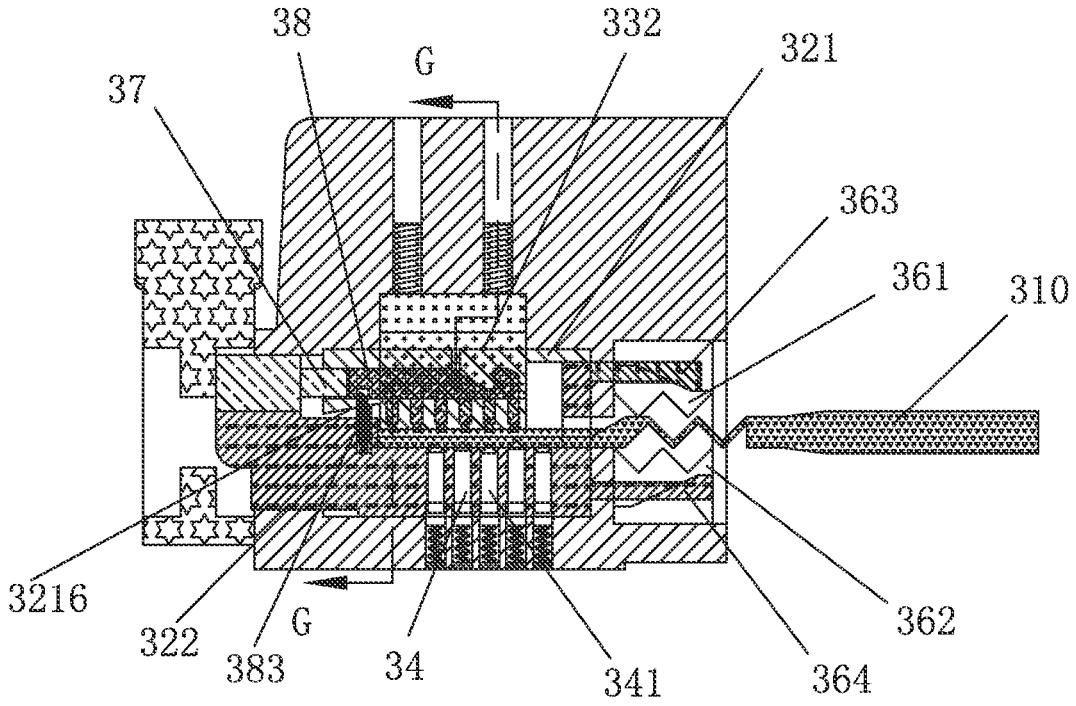
FIG. 41 illustrates a sectional diagram of G-G line of FIG. 40.
Figure 42:
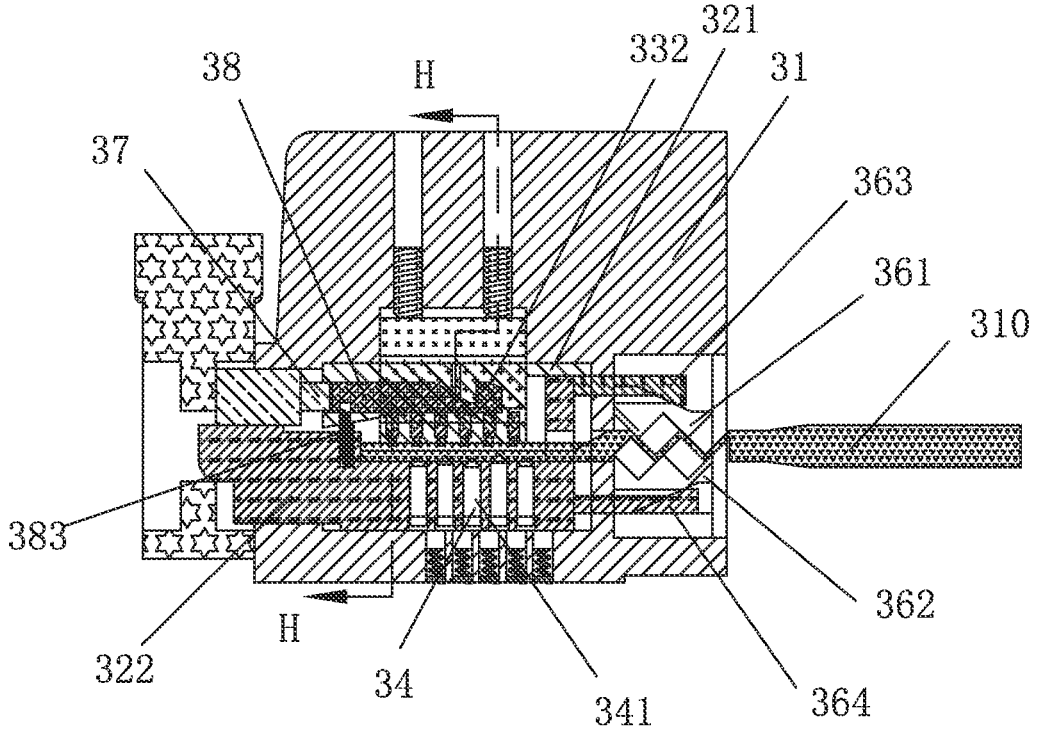
FIG. 42 illustrates a schematic diagram of the lock of the fourth embodiment that the lower plug does not move to the second position after the key is inserted into.
Figure 43:
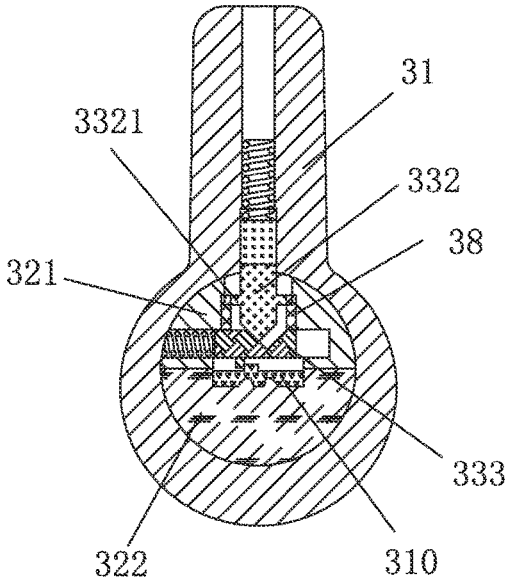
FIG. 43 illustrates a sectional diagram of H-H line of FIG. 42.
Figure 45:
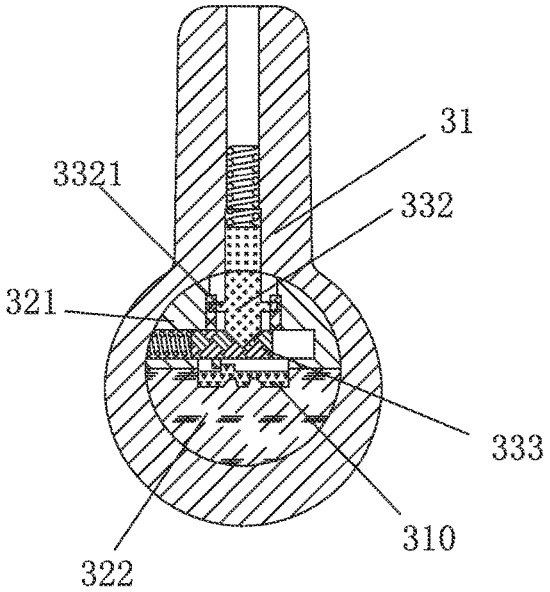
FIG. 45 illustrates a sectional diagram of I-I line of FIG. 44.
Figure 44:
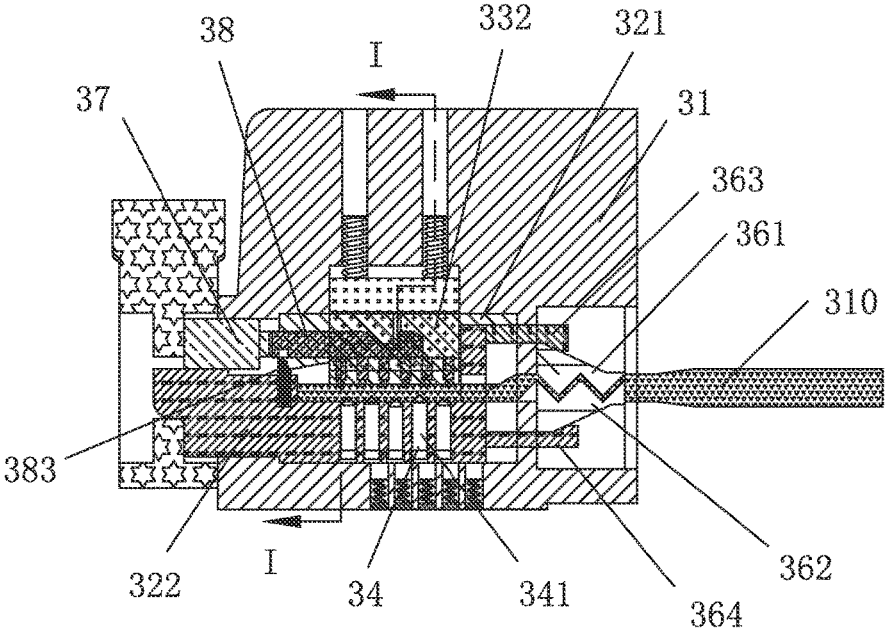
FIG. 44 illustrates a schematic diagram of the lock of the fourth embodiment that the lower plug translates to the second position after the key is inserted into.
Figure 46:
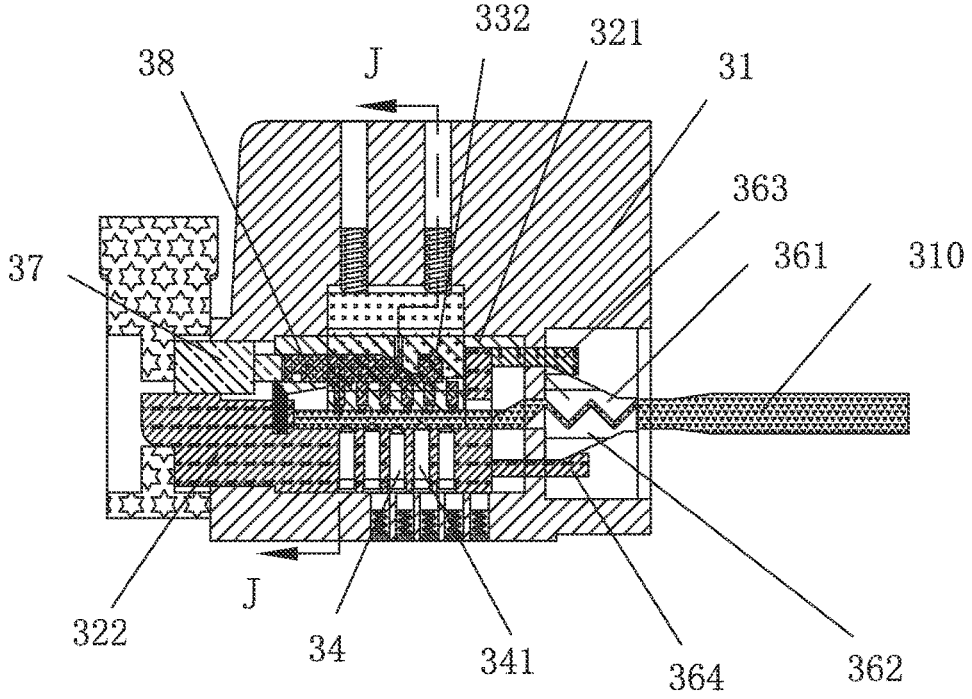
FIG. 46 a schematic diagram of the lock of the fourth embodiment that the lower plug translates to the second position after the key is inserted into and the rear plug does not move and the delayer starts to work.
Figure 47:
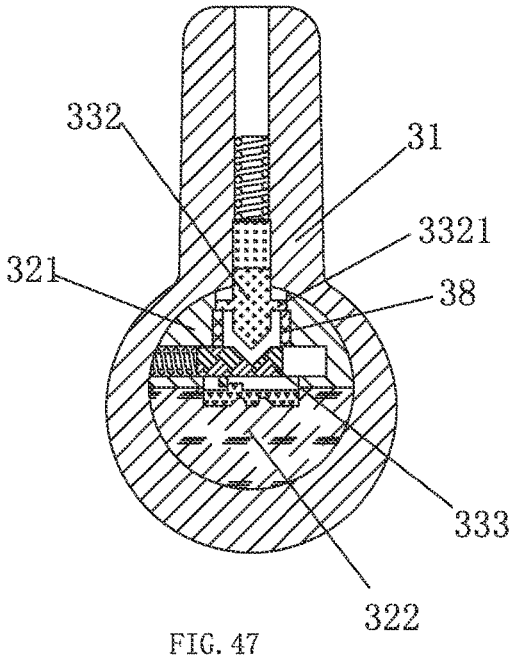
FIG. 47 illustrates a sectional diagram of J-J line of FIG. 46.
Figure 49:
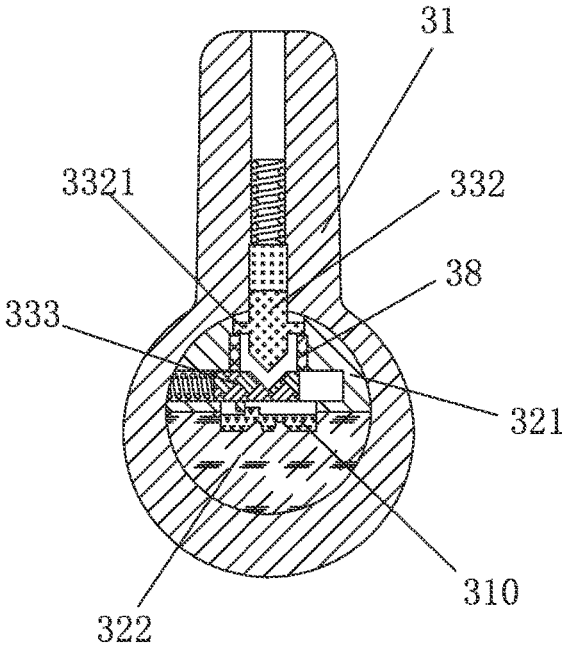
FIG. 49 illustrates a sectional diagram of K-K line of FIG. 48.
Figure 48:
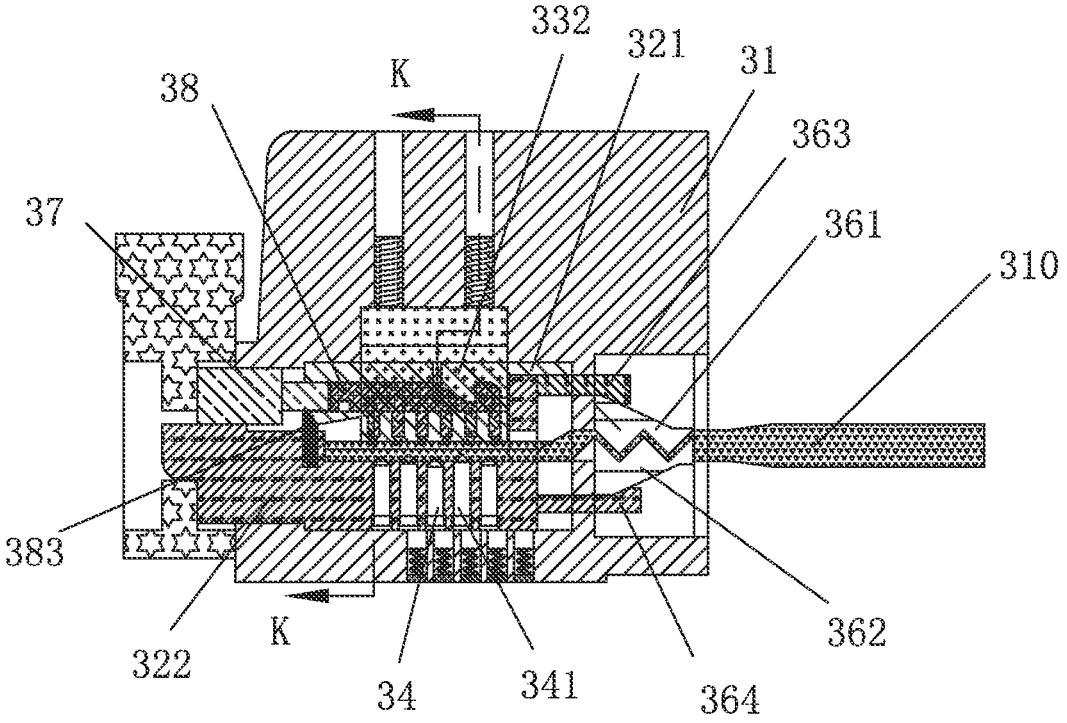
FIG. 48 illustrates a schematic diagram of the lock of the fourth embodiment that the delayer pushes in to the second position.
Figure 50:
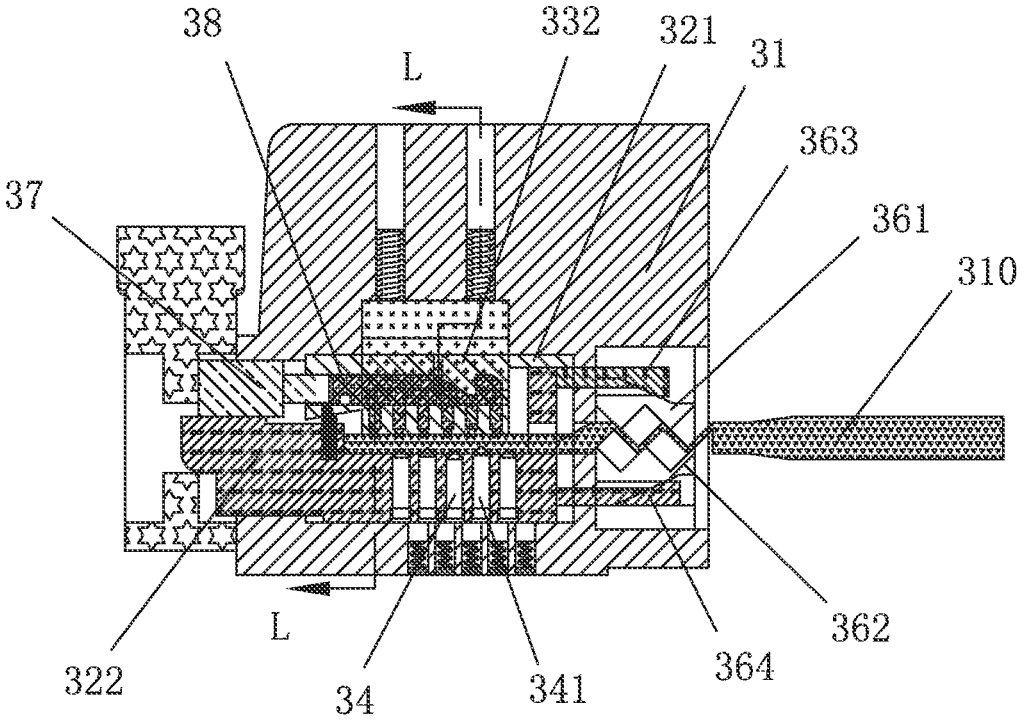
FIG. 50 illustrates a schematic diagram of the lock of the fourth embodiment that the lower plug is being reset.
Figure 51:
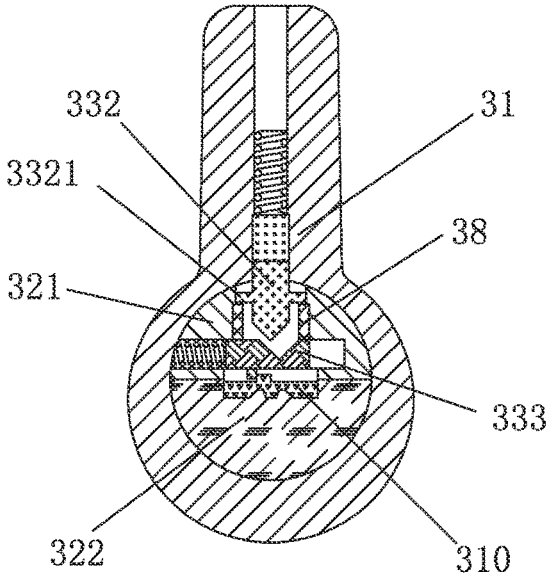
FIG. 51 illustrates a sectional diagram of L-L line of FIG. 50.
Figure 53:
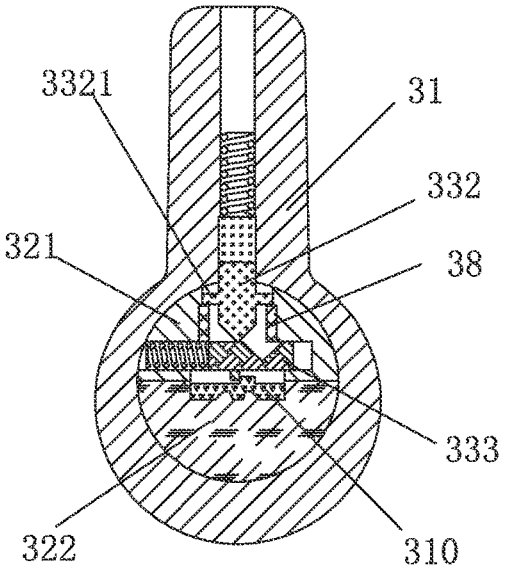
FIG. 53 illustrates a sectional diagram of M-M line of FIG. 52.
Figure 52:
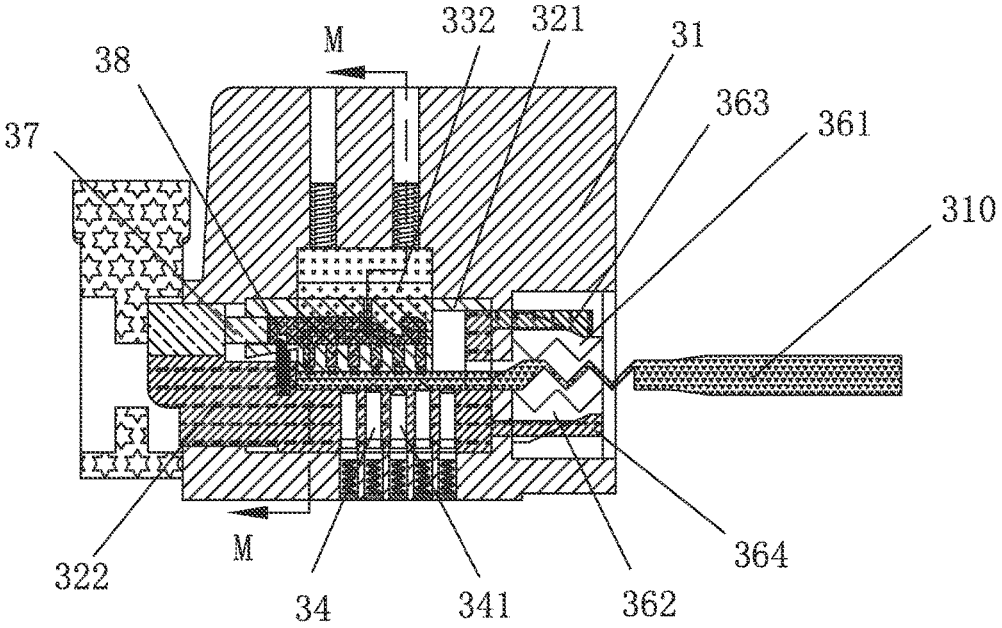
FIG. 52 illustrates a schematic diagram of the lock of the fourth embodiment that the lower plug is reset to the second position.
Figure 54:
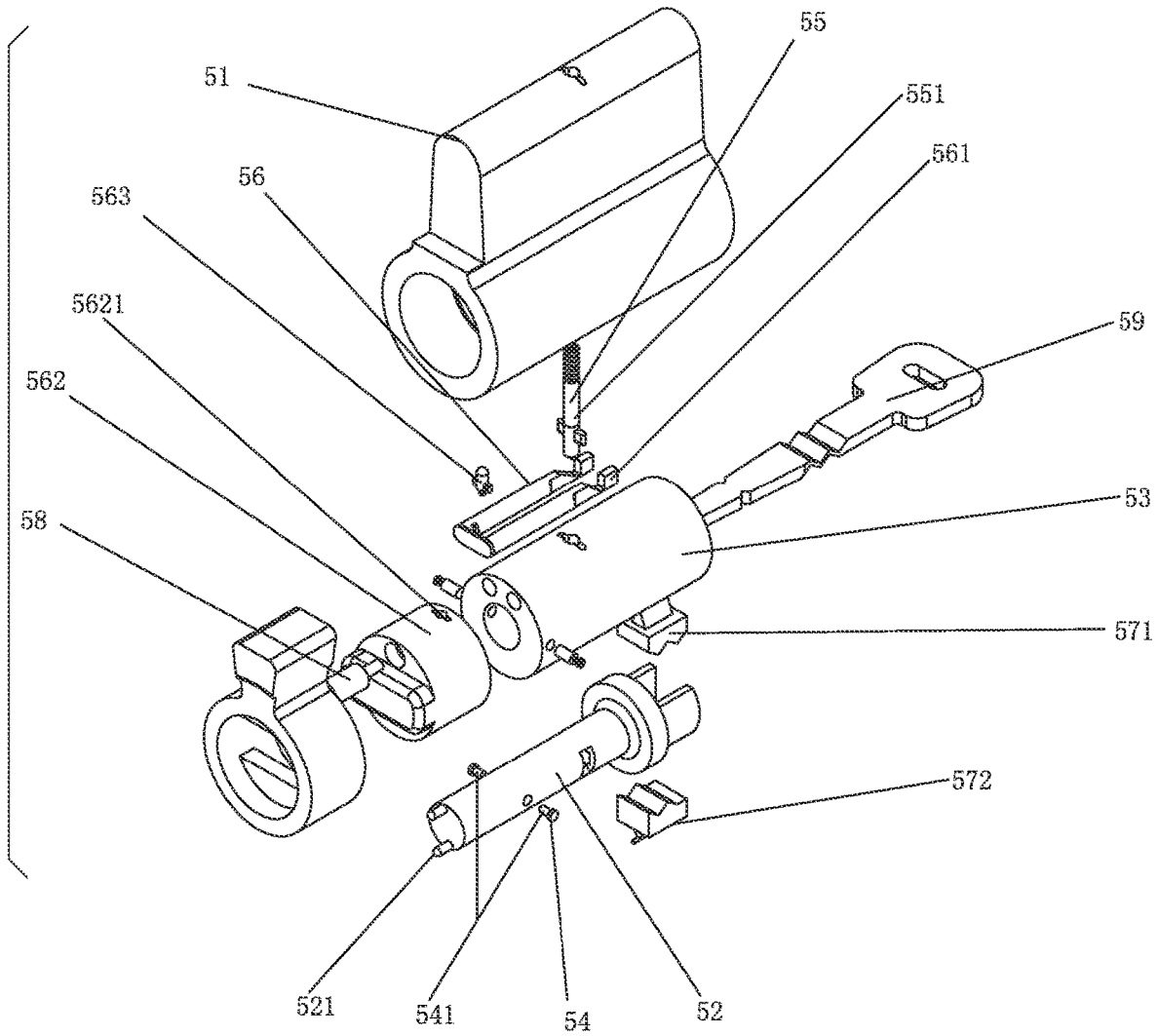
FIG. 54 illustrates a schematic and exploded diagram of a lock of a fifth embodiment of the present invention.
Figure 55:
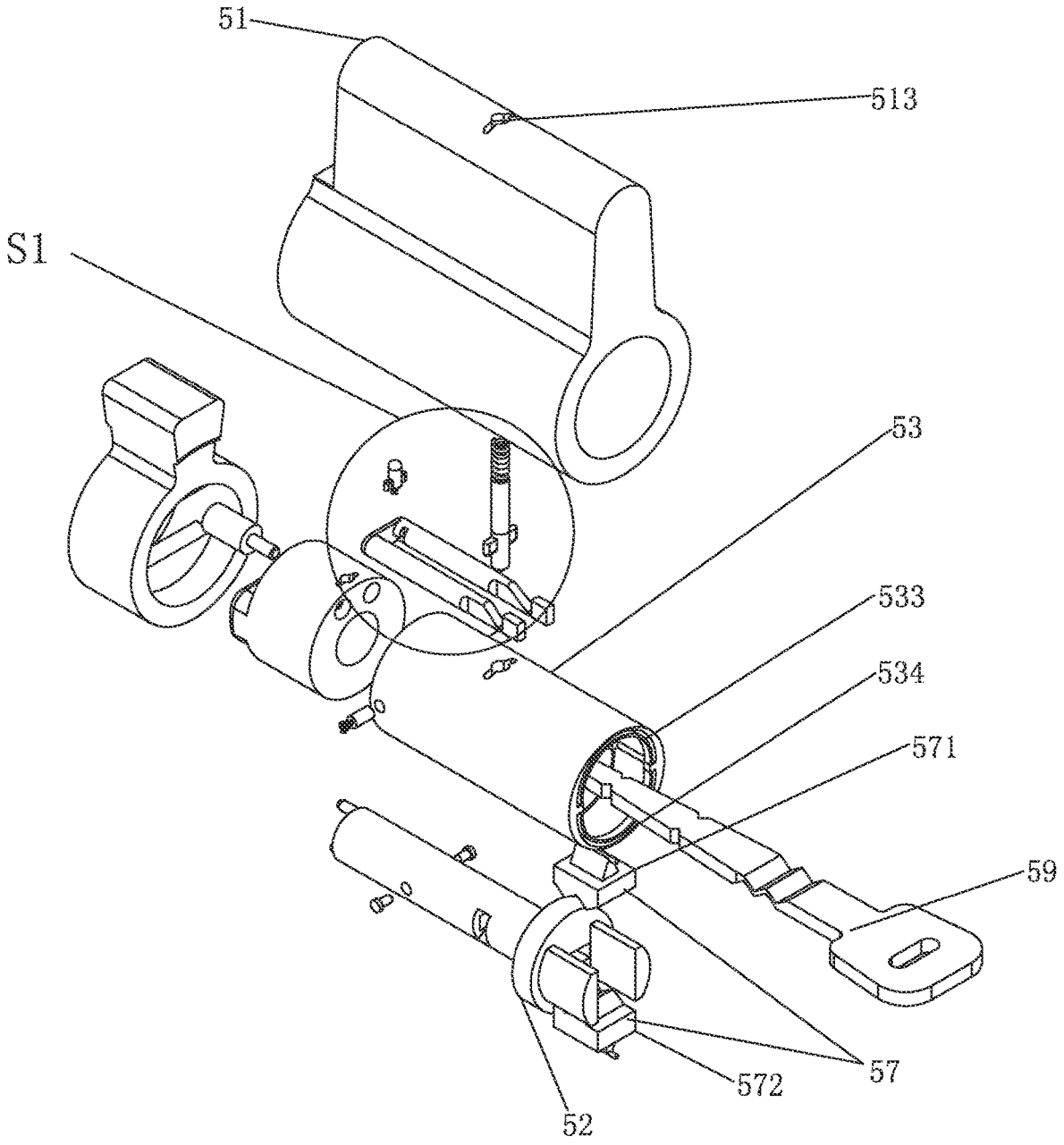
FIG. 55 illustrates a schematic and exploded diagram of the lock of the fifth embodiment of the present invention in another view angle.
Figure 56:
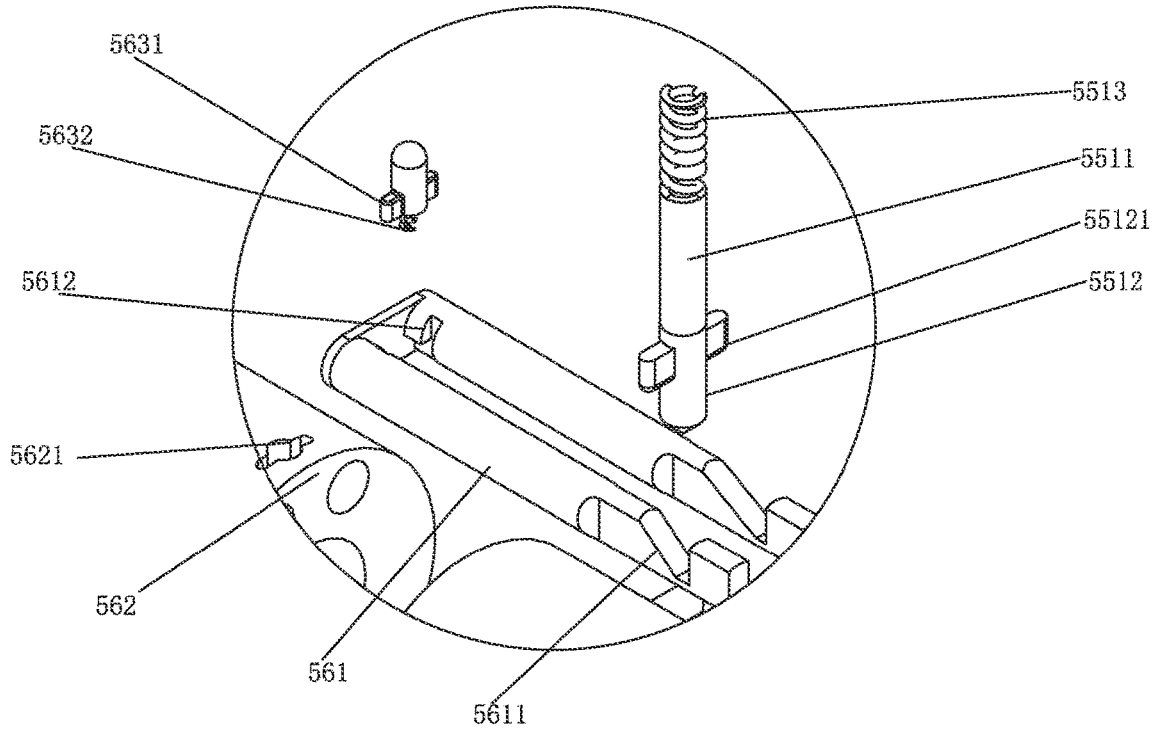
FIG. 56 illustrates a partial enlargement diagram of S1 of FIG. 55.
Figure 57:
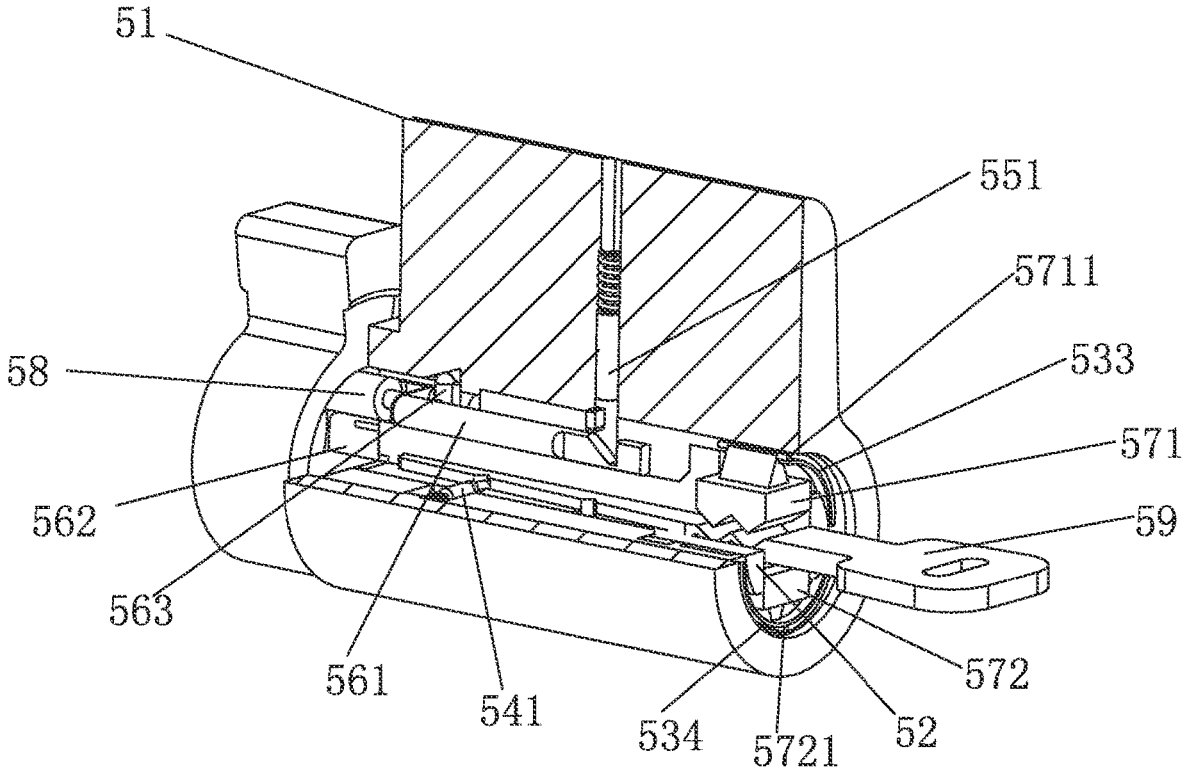
Figure 58:
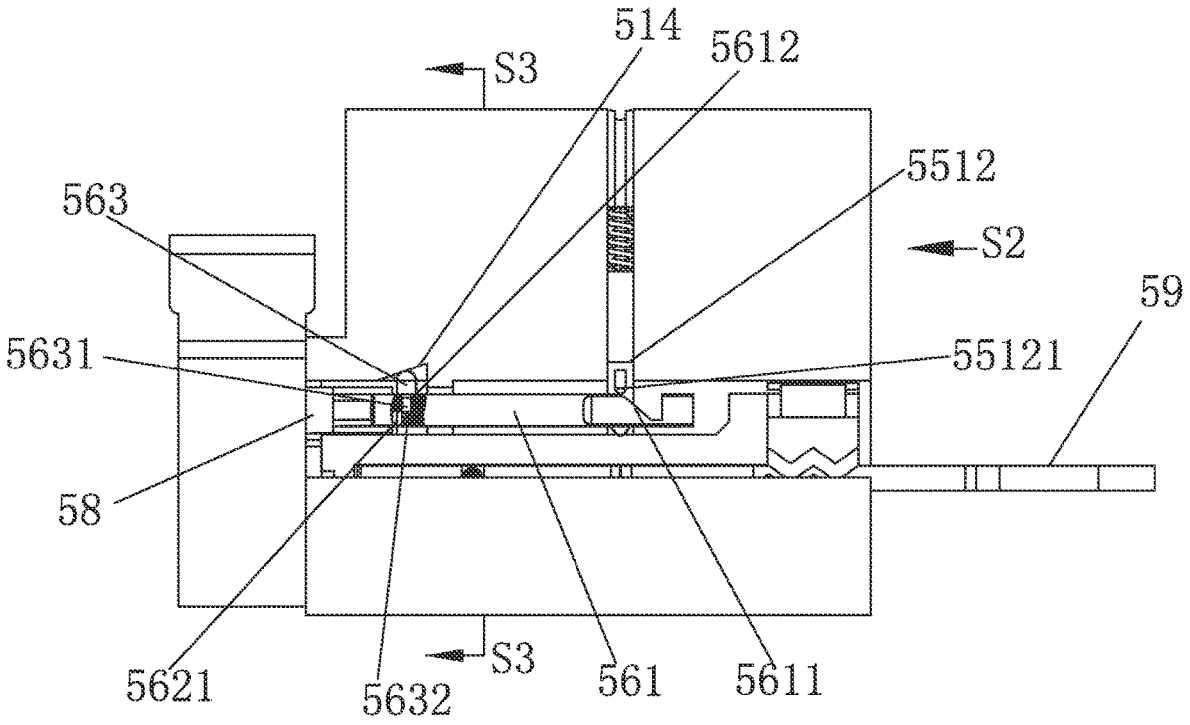
Figure 59:
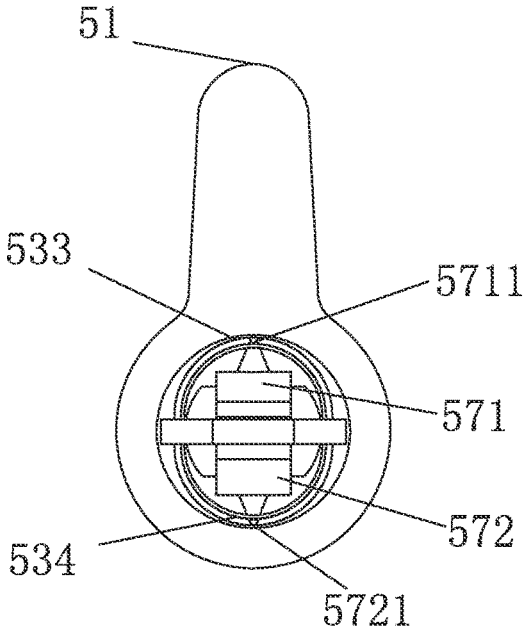
FIG. 59 illustrates a schematic diagram of FIG. 58 in S2 direction.
Figure 60:
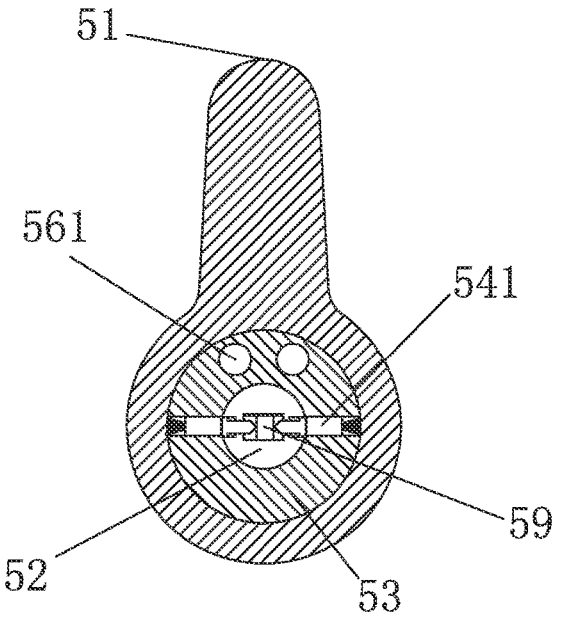
FIG. 60 illustrates a sectional diagram of S3-S3 line of FIG. 58.
Figure 61:
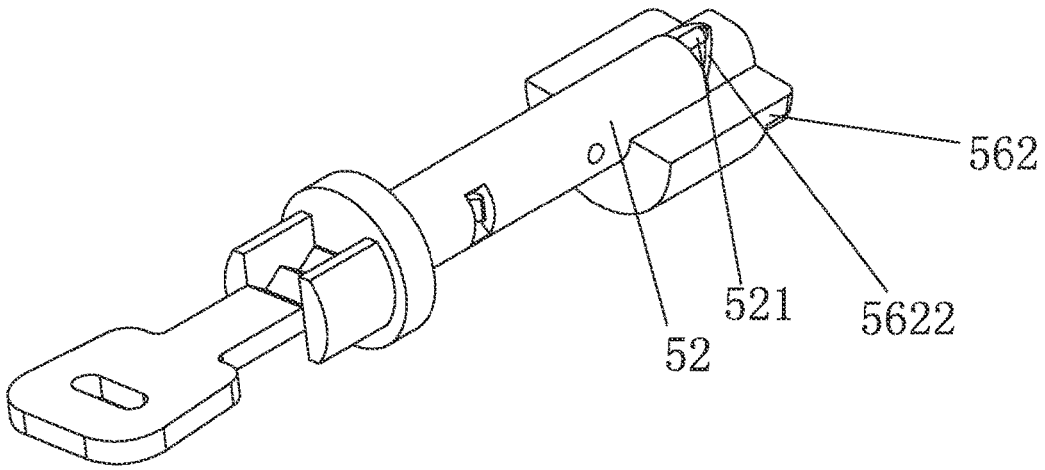
Figure 62:
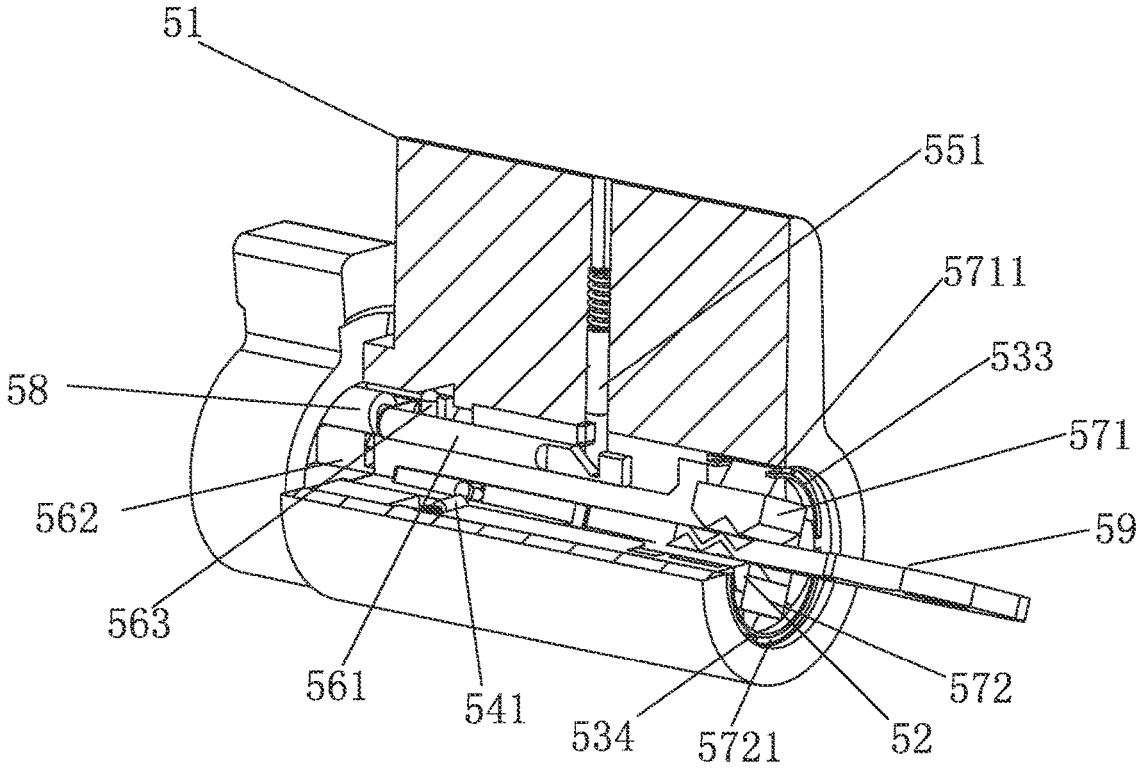
Figure 63:
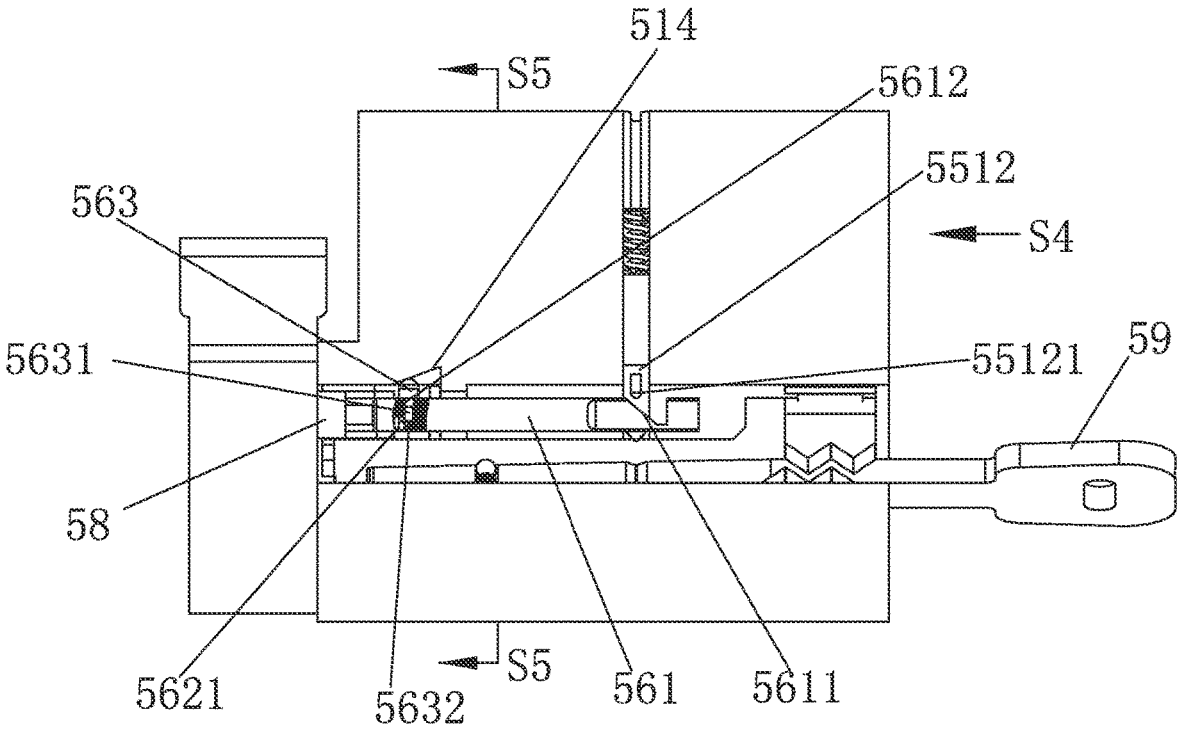
Figure 64:
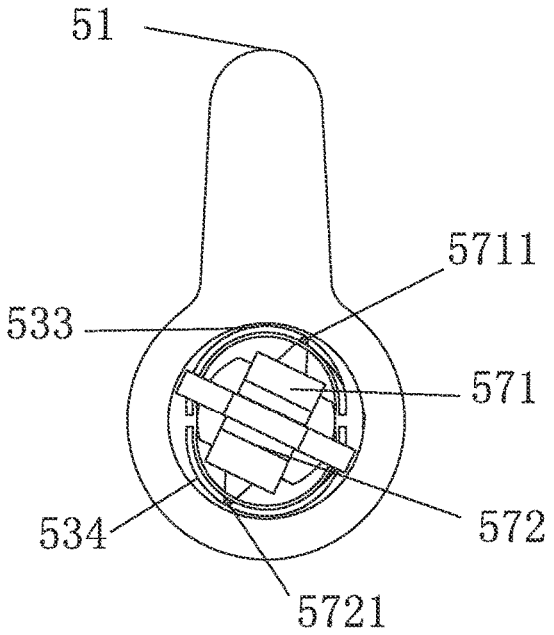
FIG. 64 illustrates a schematic diagram of FIG. 63 in S4 direction.
Figure 65:
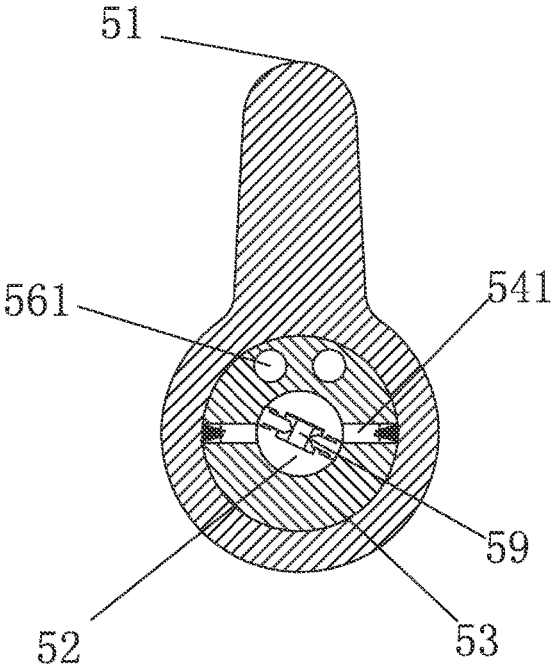
FIG. 65 illustrates a sectional diagram of S5-S5 line of FIG. 63.
Figure 66:
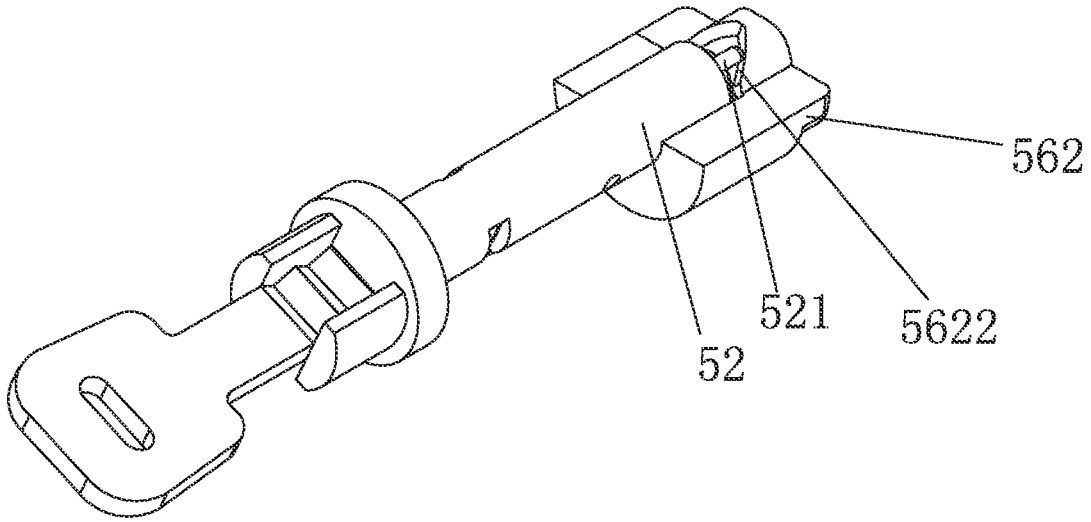
Figure 67:
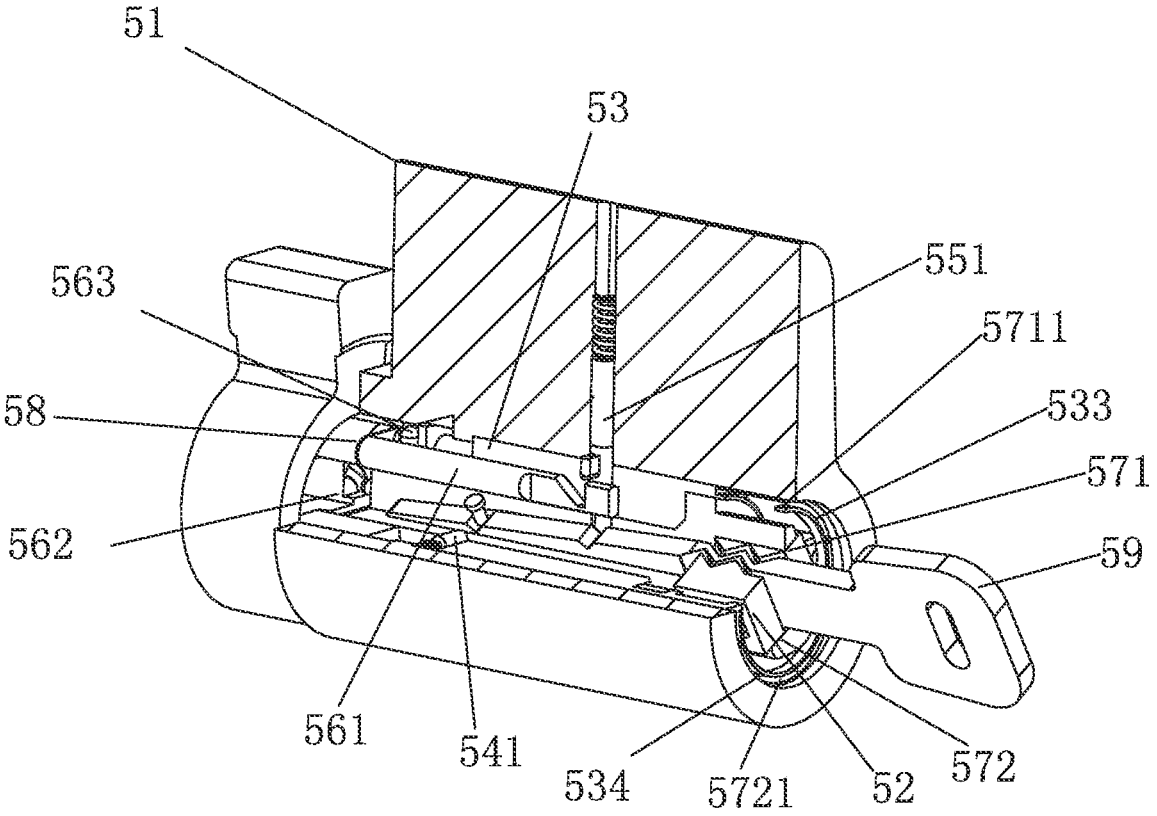
FIG. 67 illustrates a schematic diagram of the lock of the fifth embodiment that the inner plug rotates to the second position after the key is inserted in and the outer lock mechanism does not unlock.
Figure 71:
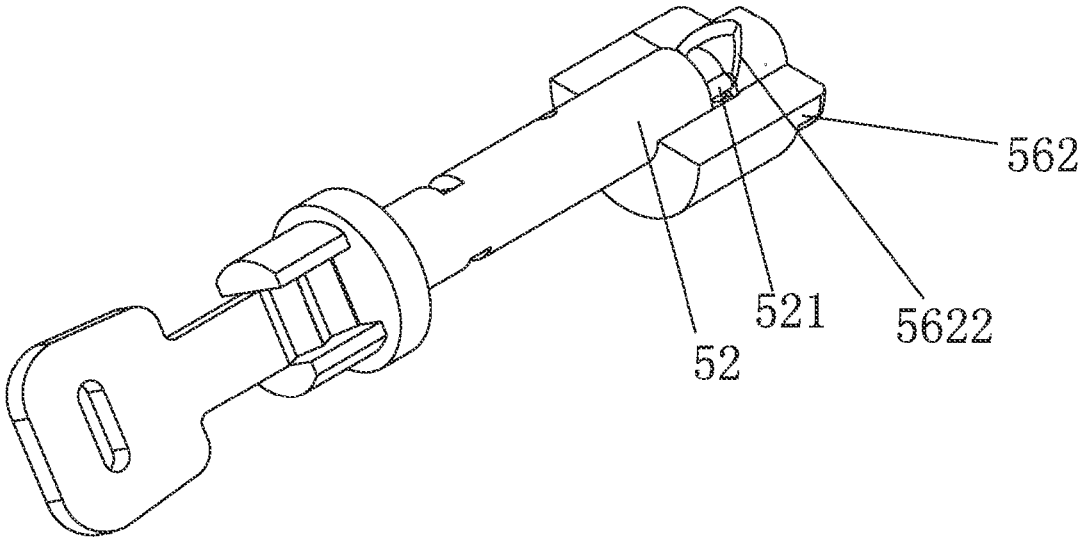
FIG. 71 illustrates a schematic diagram of the inner plug and the spring bolt slide block of the lock of the fifth embodiment that the inner plug rotates to the second position after the key is inserted in, and the outer lock mechanism does not unlock.
Figure 72:
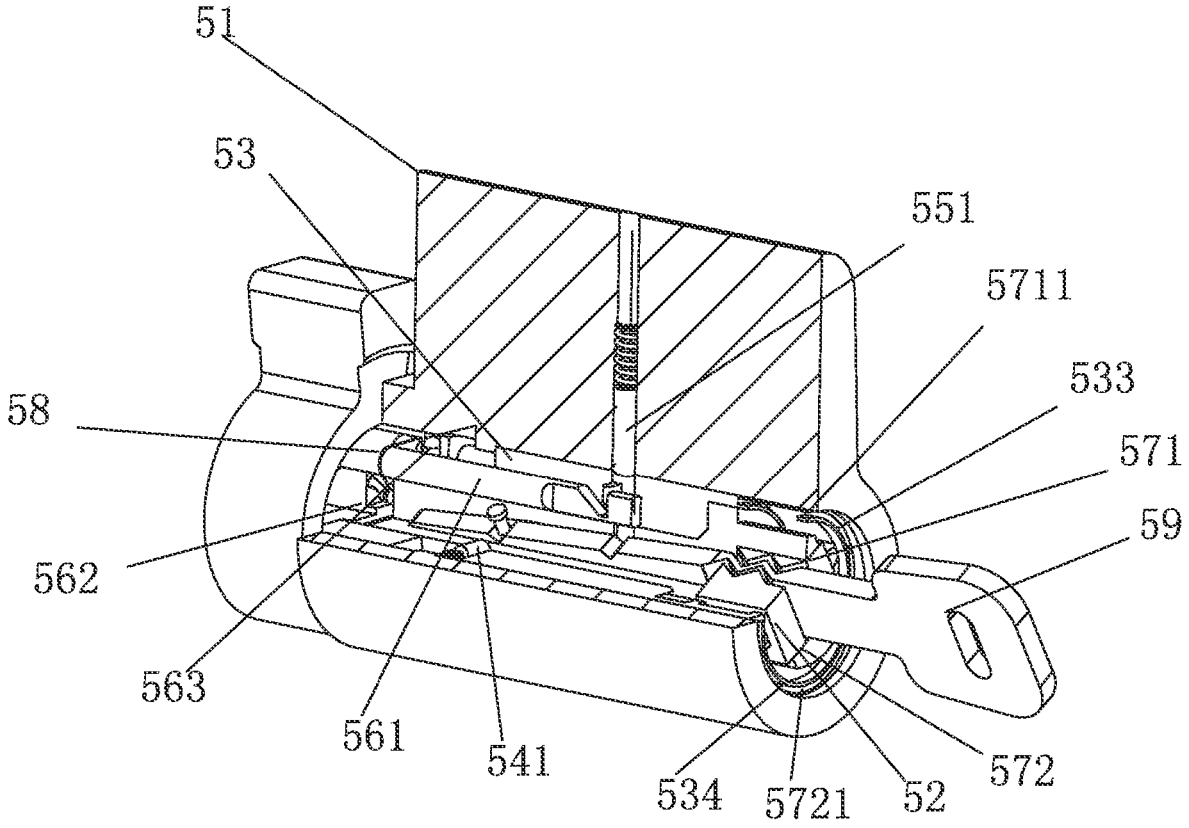
FIG. 72 illustrates a schematic diagram of the lock of the fifth embodiment that the inner plug rotates an angle to the second position after the key is inserted in, and the outer lock mechanism unlocks.
Figure 73:
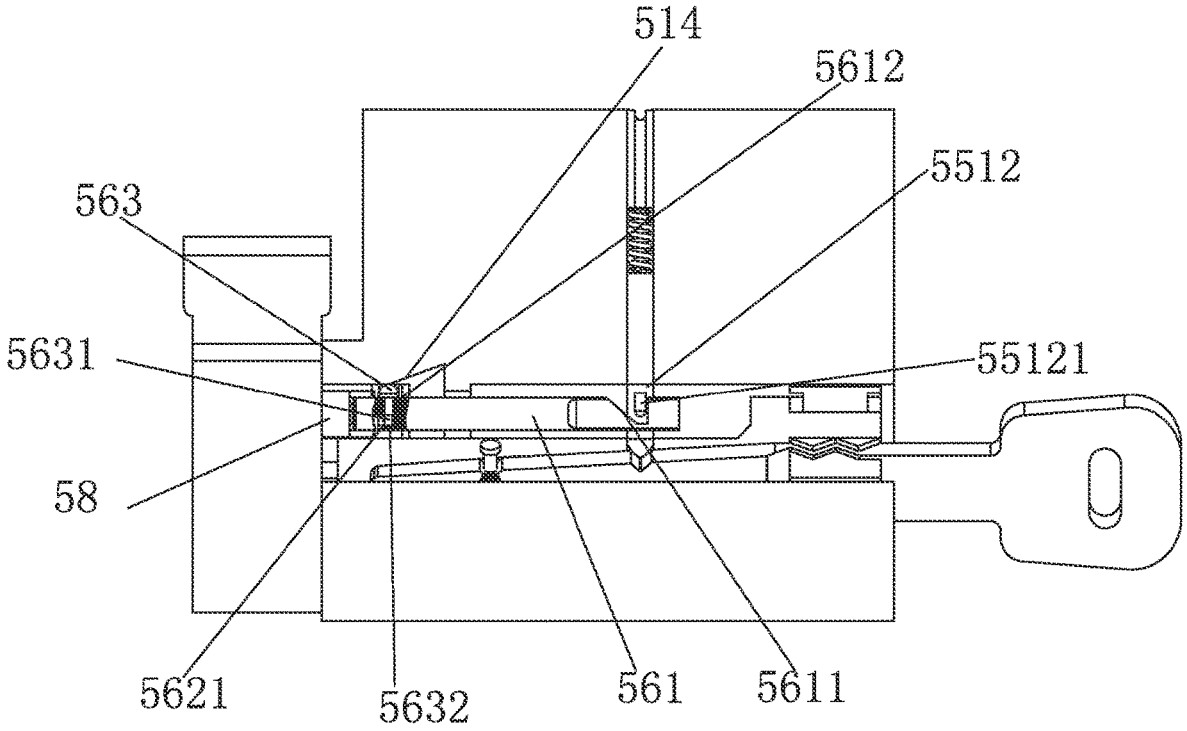
FIG. 73 illustrates a sectional diagram of the lock of the fifth embodiment that the inner plug rotates an angle to the second position after the key is inserted in, and the outer lock mechanism unlocks.
Figure 76:
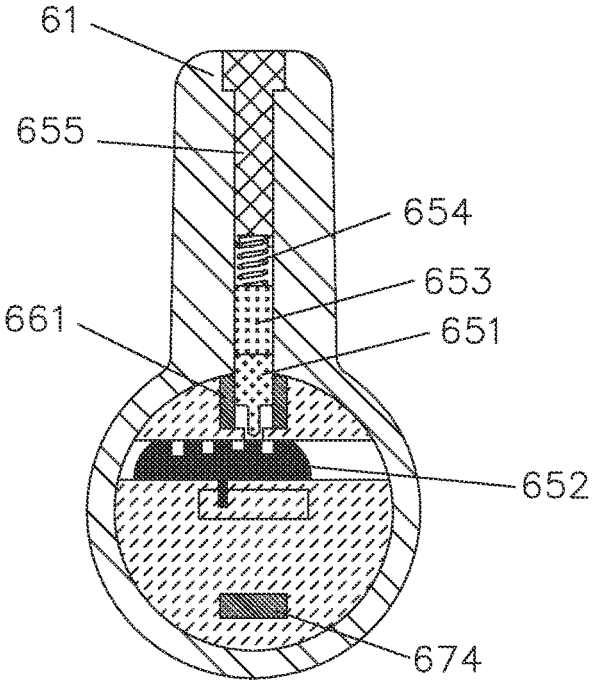
FIG. 76 illustrates a sectional diagram of R1-R1 line of FIG. 75.
Figure 77:
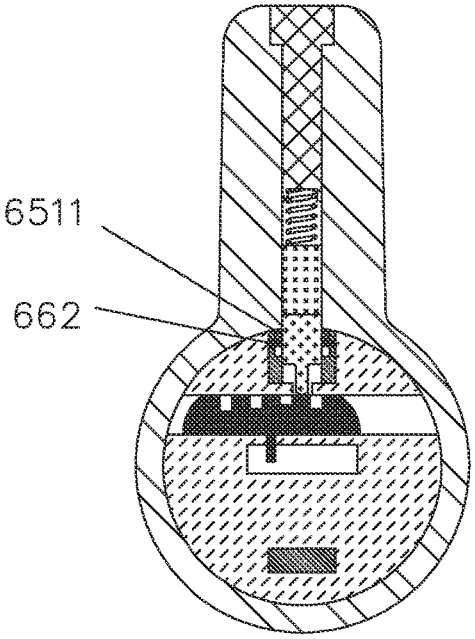
FIG. 77 illustrates a sectional diagram of R2-R2 line of FIG. 75.
Figures 74, 78:
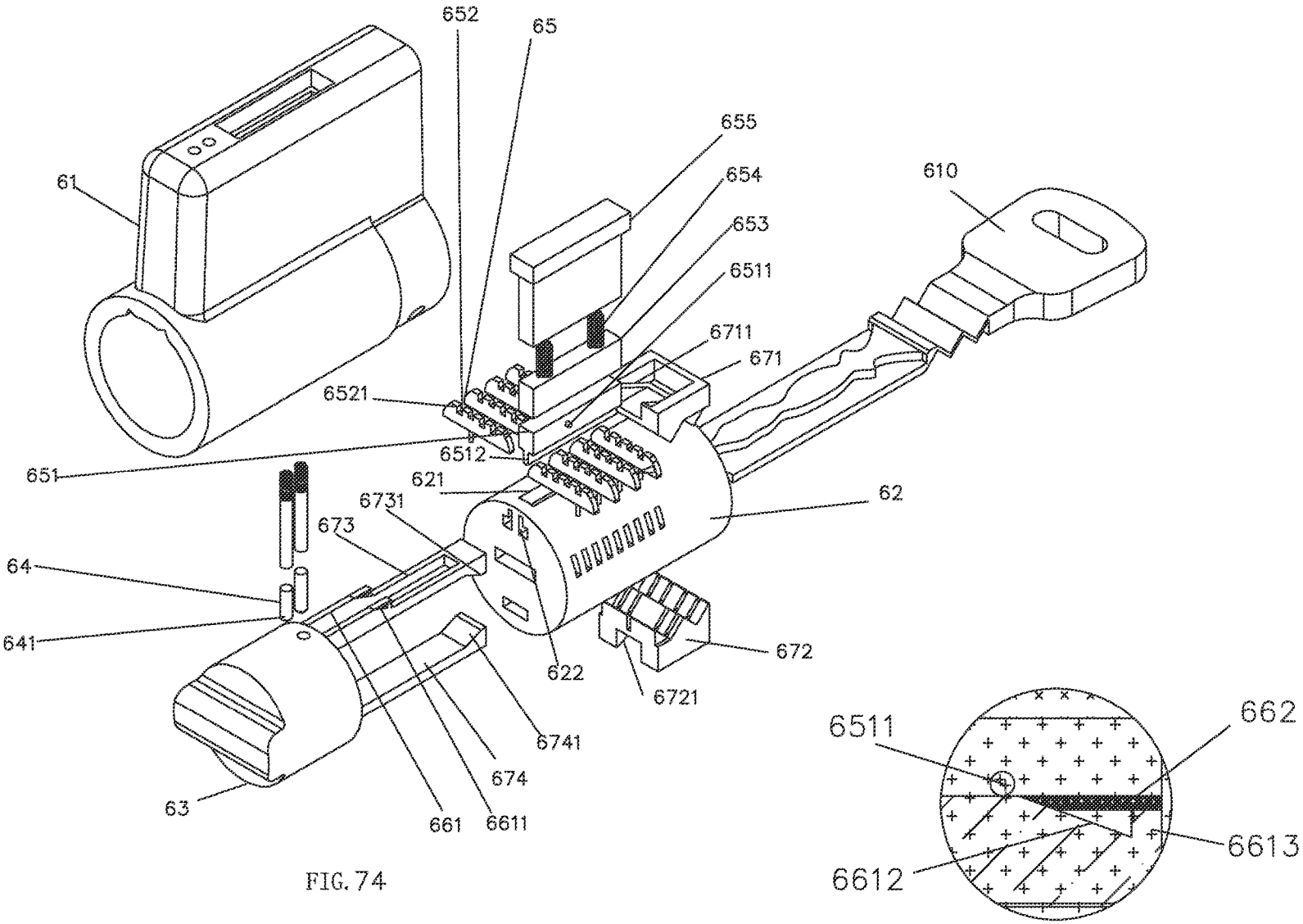
FIG. 74 illustrates a schematic and exploded diagram of a lock with dual plug of a sixth embodiment of the present invention.
FIG. 78 illustrates an enlargement diagram of R3 of FIG. 75.
Figure 79:
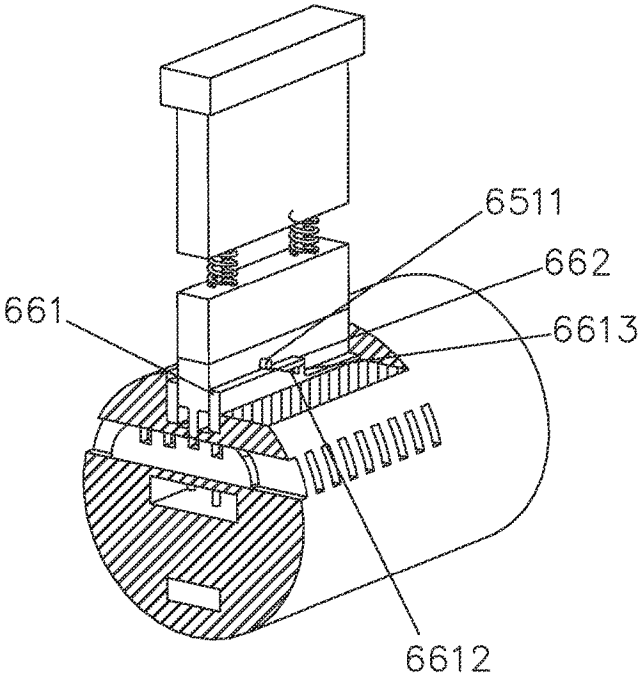
Figure 75:
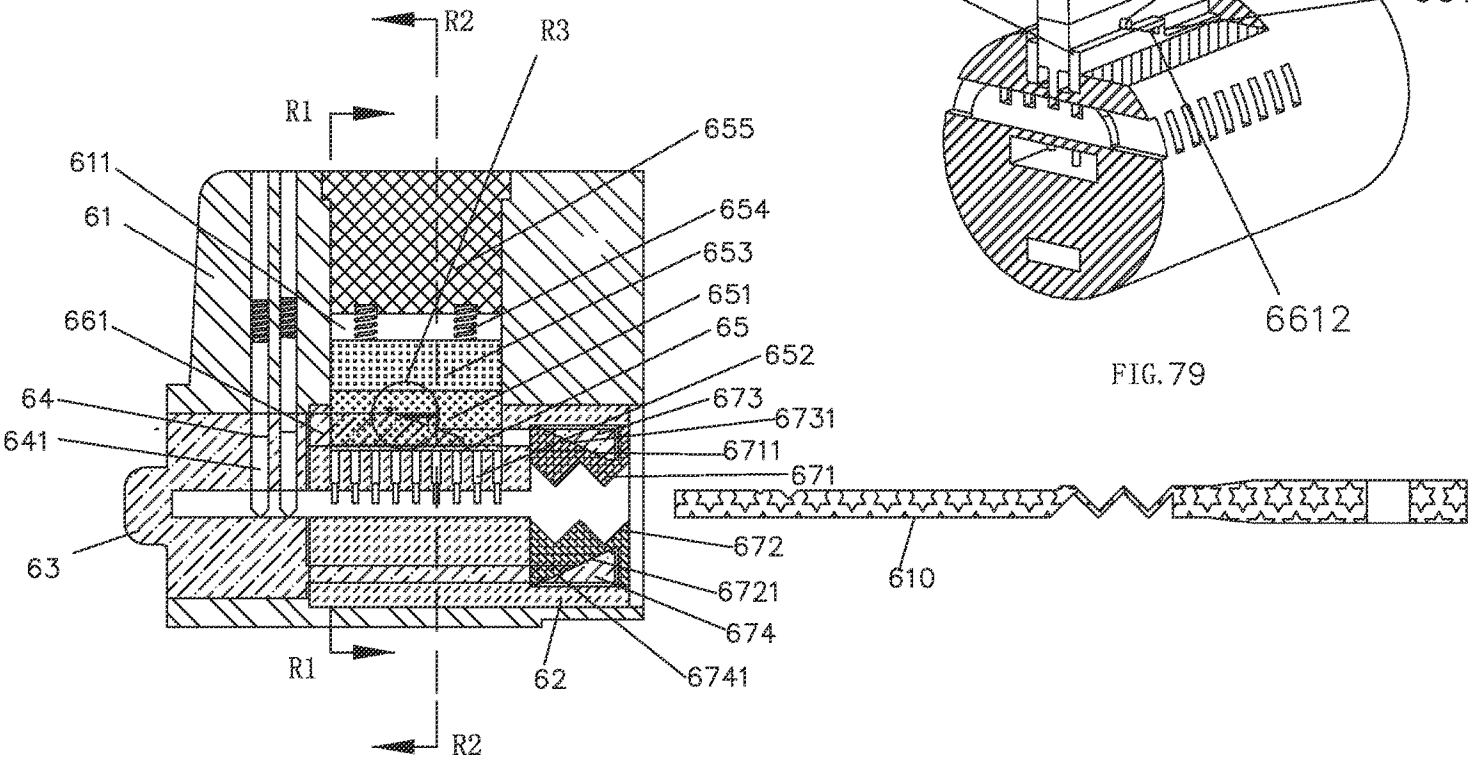
Figure 80:
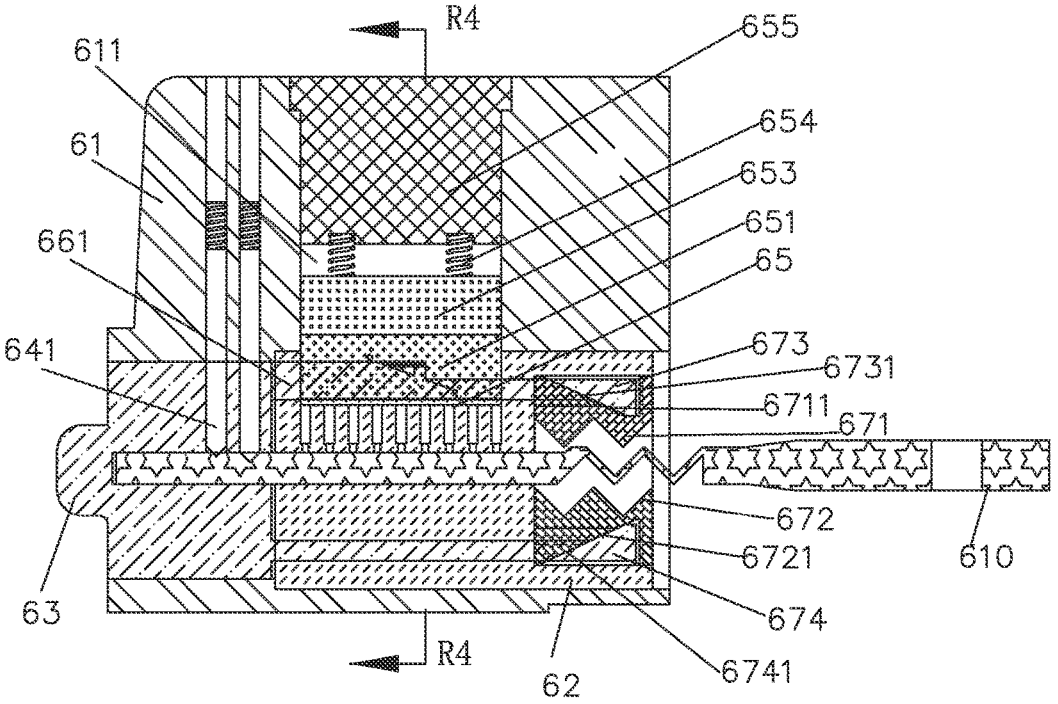
Figure 81:
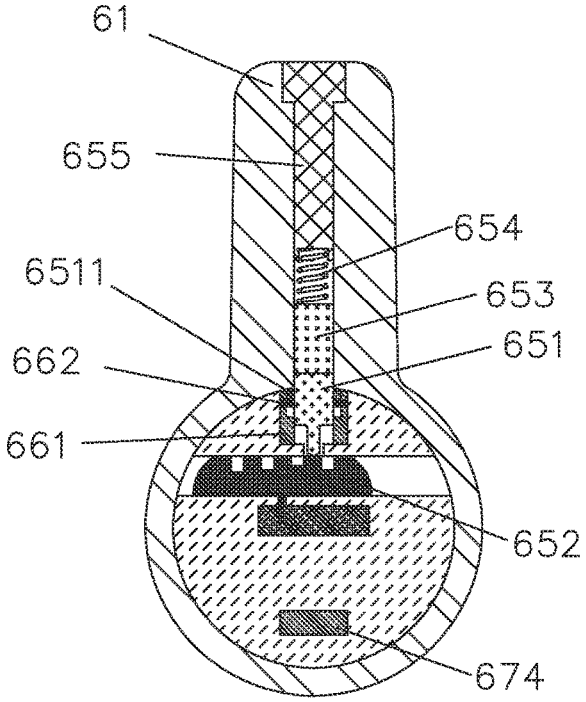
FIG. 81 illustrates a sectional diagram of R4-R4 line of FIG. 80.
Figure 82:
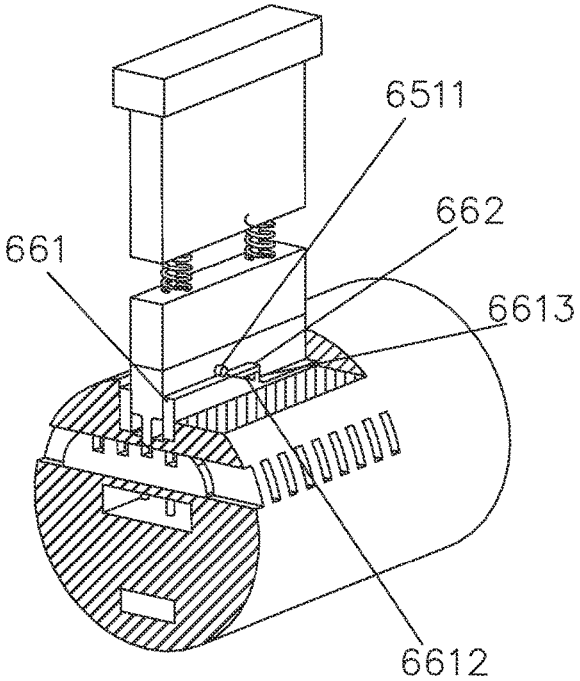
Figure 83:
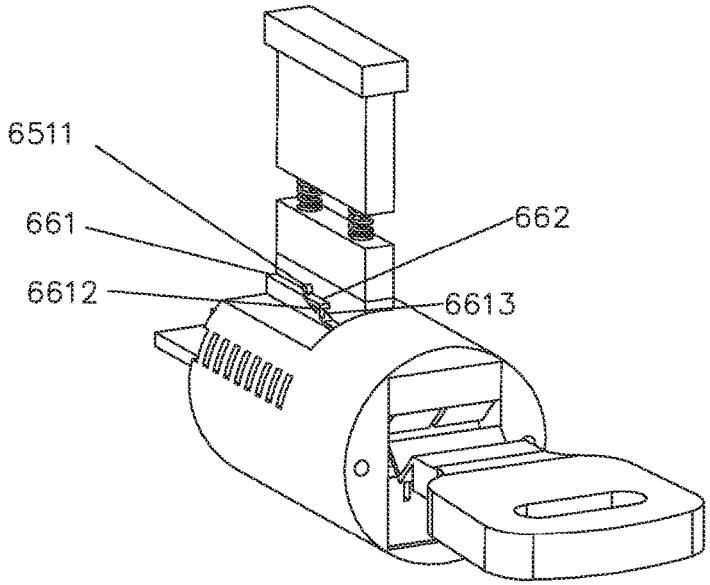
FIG. 83 illustrates a schematic diagram of the tumbler, the push rod and the front plug of the lock of the sixth embodiment that the rear plug does not push in after the key is inserted in in another view angle.
Figure 84:
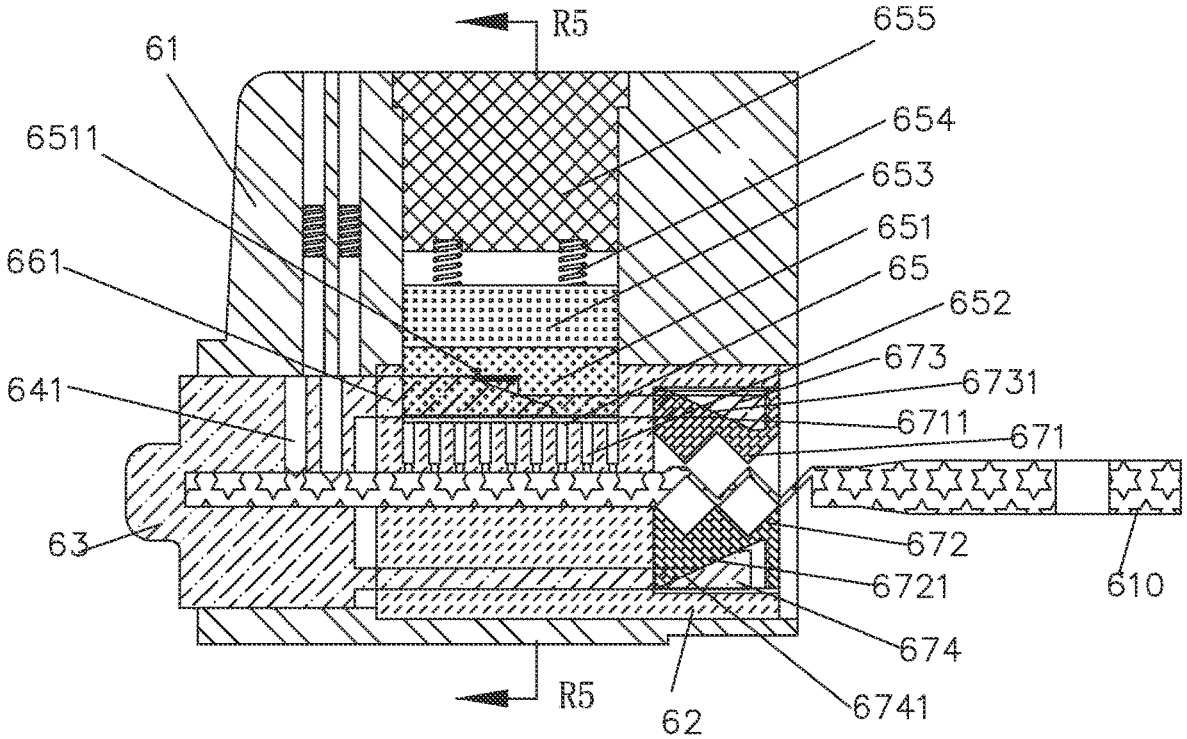
Figure 85:
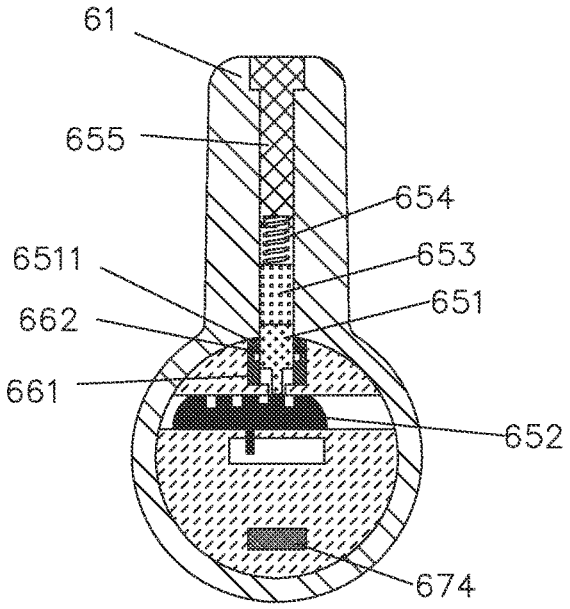
FIG. 85 illustrates a schematic diagram of R5-R5 line of FIG. 84.
Figure 86:
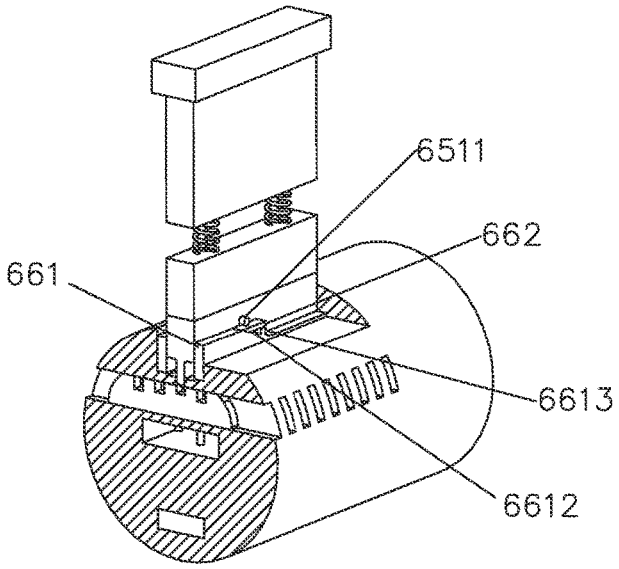
Figure 87:
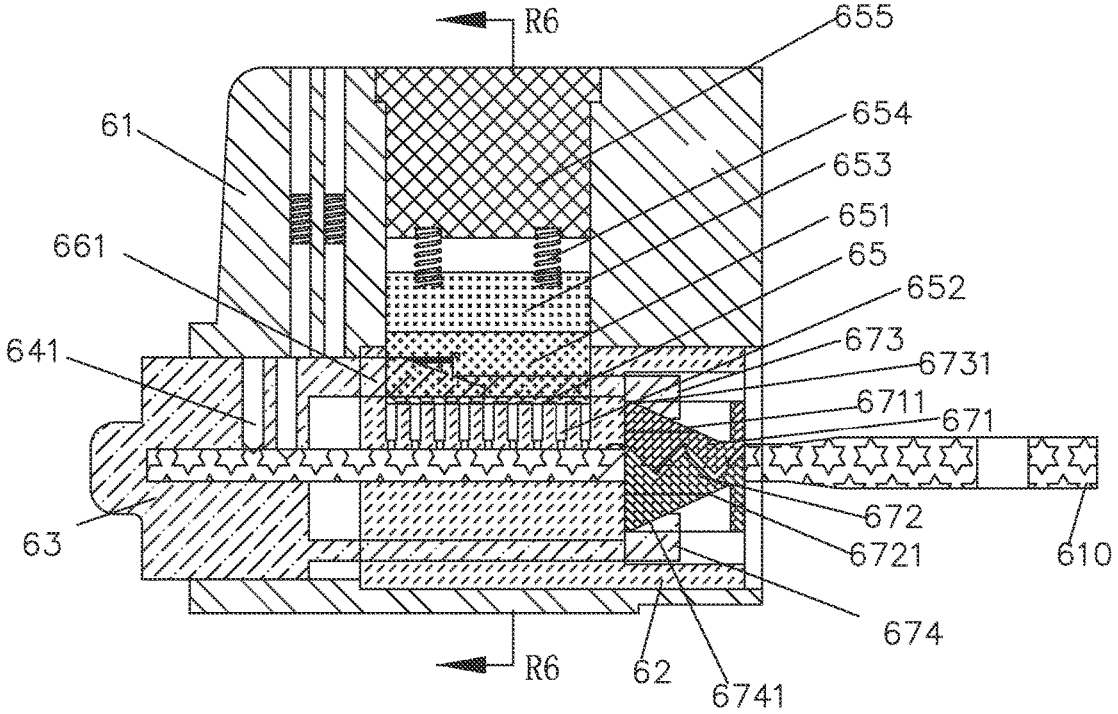
FIG. 87 illustrates a schematic diagram of the lock of the sixth embodiment at the moment that the rear plug pushes to the second position after the key is inserted in, and the tumbler doesn't fall down.
Figure 88:
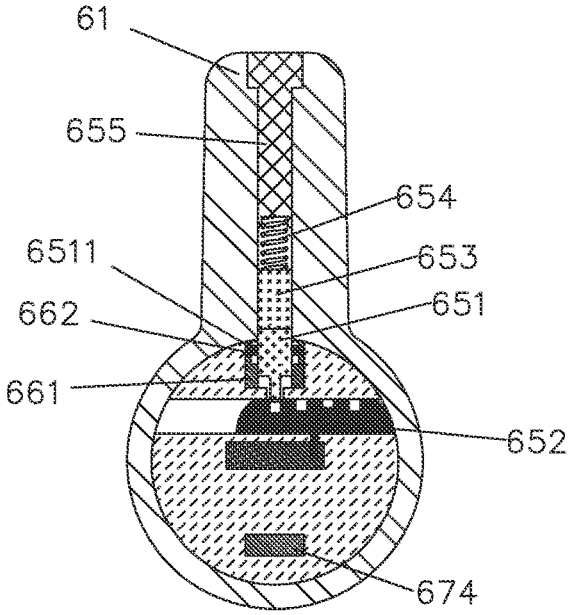
FIG. 88 illustrates a sectional diagram of R6-R6 line of FIG. 87.
Figure 89:
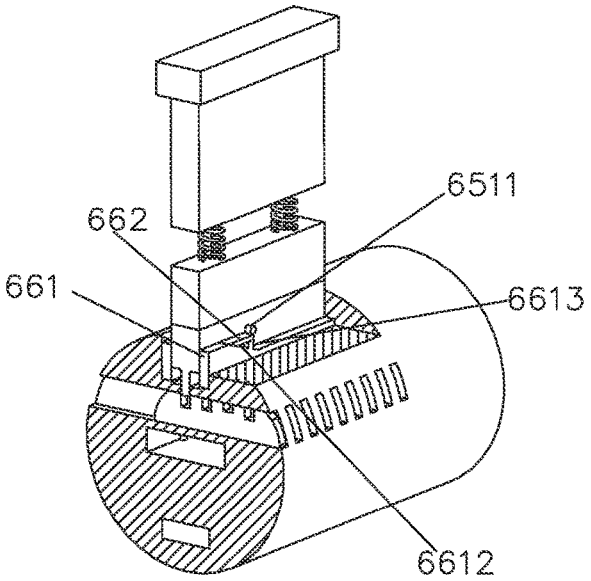
FIG. 89 illustrates a schematic diagram of the tumbler, the push rod and the front plug of the lock of the sixth embodiment at the moment that the rear plug pushes to the second position after the key is inserted in, and the tumbler doesn't fall down.
Figure 90:
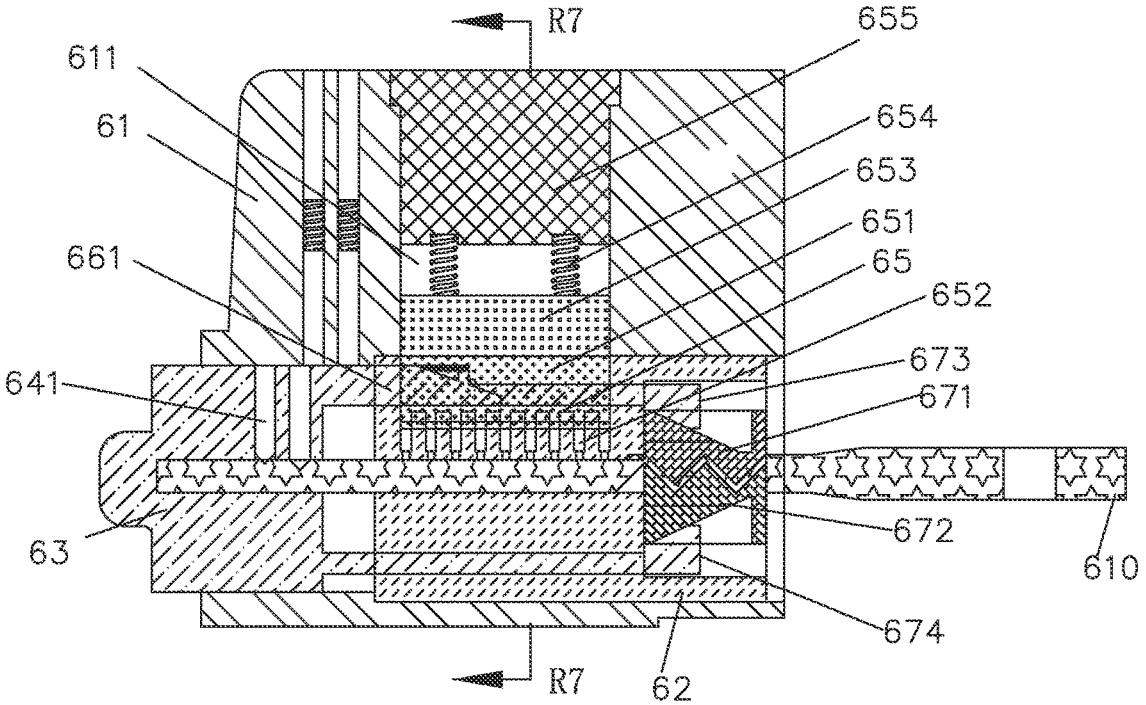
FIG. 90 illustrates a schematic diagram of the tumbler, the push rod and the front plug of the lock of the sixth embodiment at the moment that the rear plug pushes to the second position after the key is inserted in, and the tumbler drops down.
Figure 91:
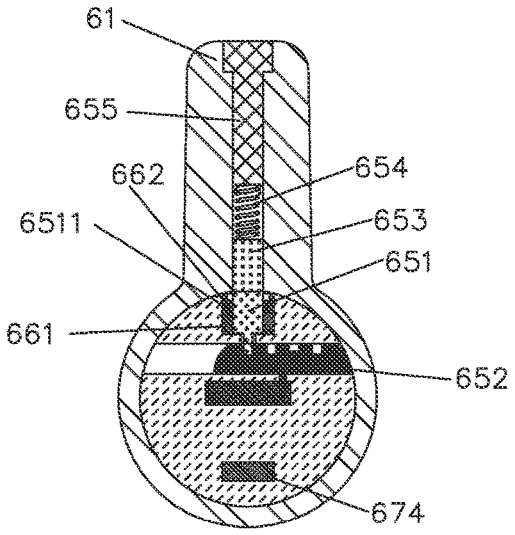
FIG. 91 illustrates a sectional diagram of R7-R7 of FIG. 90.
Figure 92:
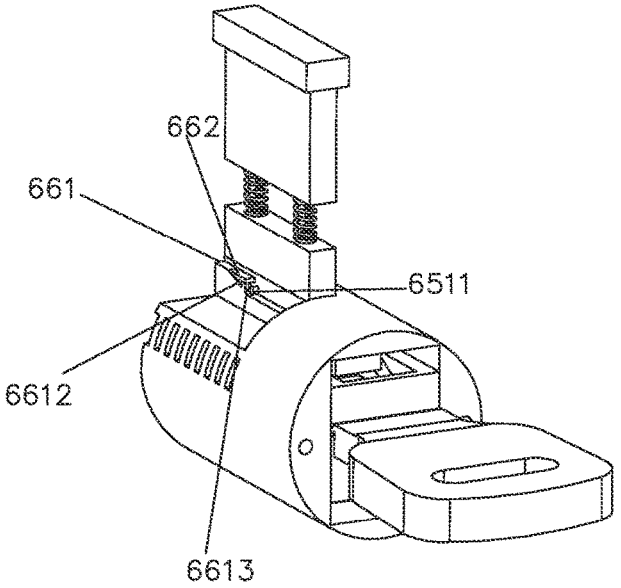
FIG. 92 illustrates a schematic diagram of the tumbler, the push rod and the front plug of the lock of the sixth embodiment at the moment that the rear plug pushes to the second position after the key is inserted in, and the tumbler drops down.
Figure 93:
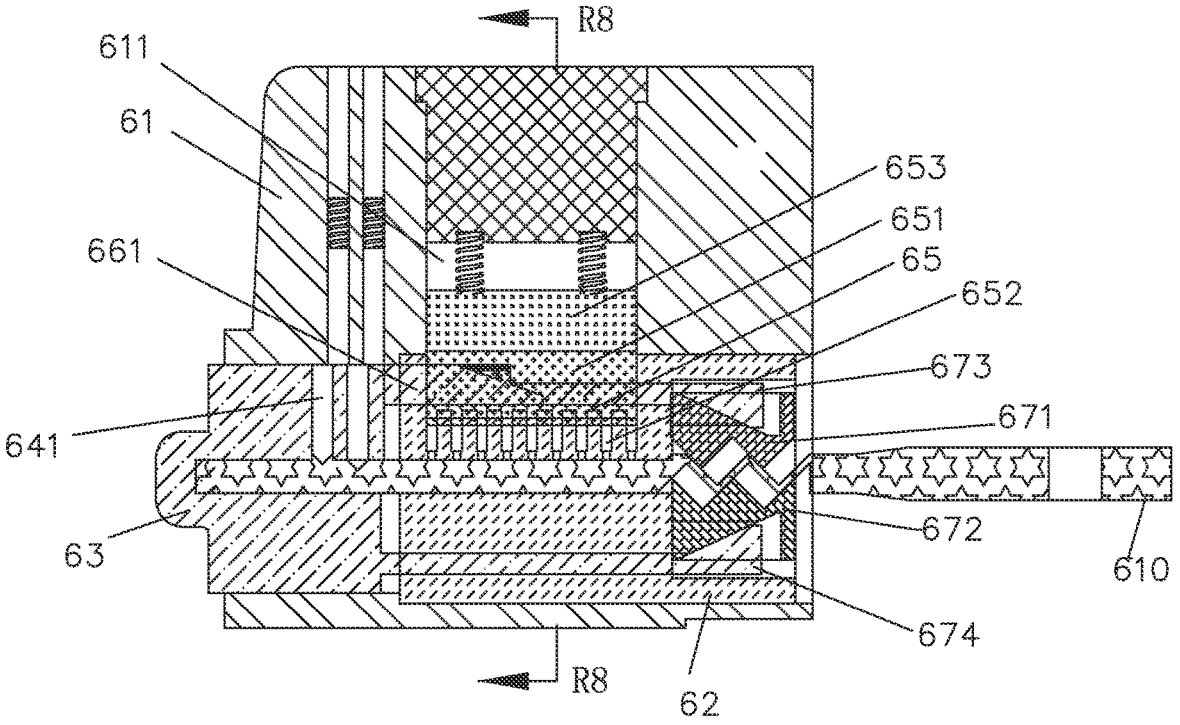
FIG. 93 illustrates a schematic diagram of the lock of the sixth embodiment that the key returns to the first step.
Figure 94:
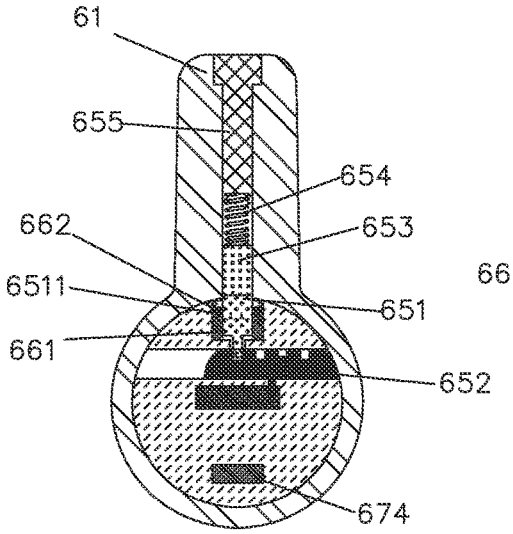
FIG. 94 illustrates a sectional diagram of R8-R8 line of FIG. 93.
Figure 95:
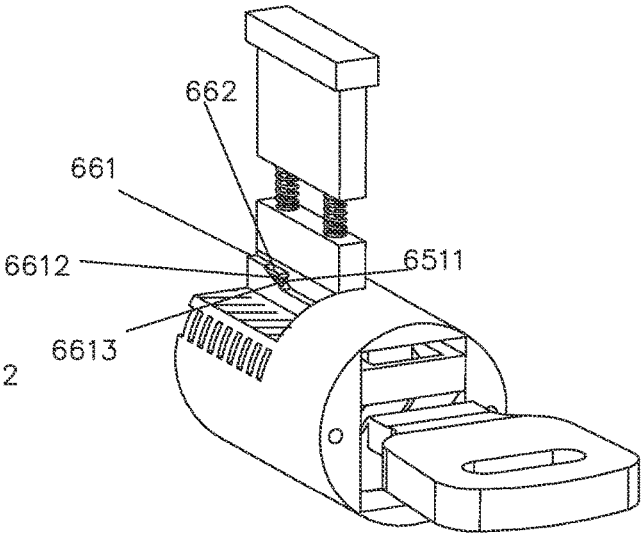
FIG. 95 illustrates a schematic diagram of the tumbler, the push rod and the front plug of the lock of the sixth embodiment that the key returns to the first step.
Figure 96:
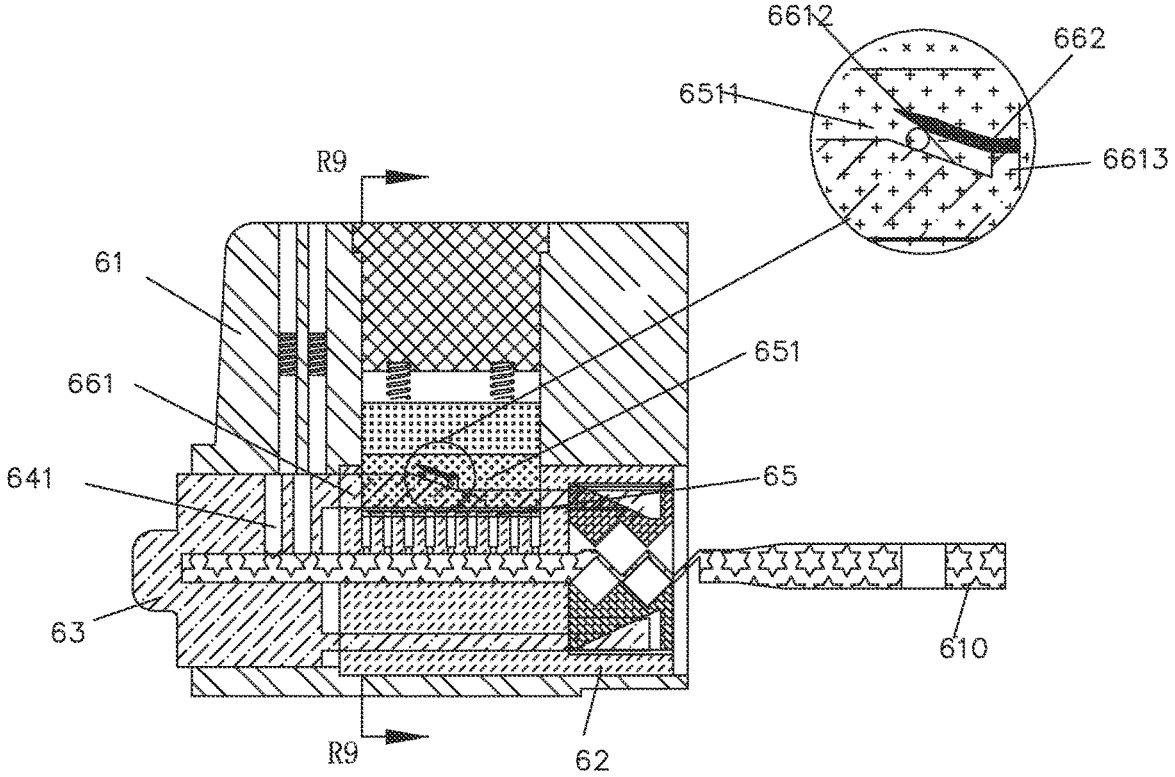
FIG. 96 illustrates a schematic diagram of the code of the sixth embodiment that the key returns to the second step.
Figure 97:
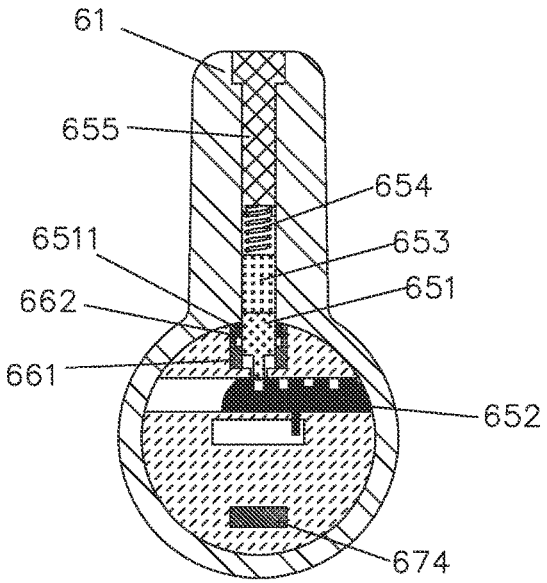
FIG. 97 illustrates a sectional diagram of R9-R9 line of FIG. 96.
Figure 98:
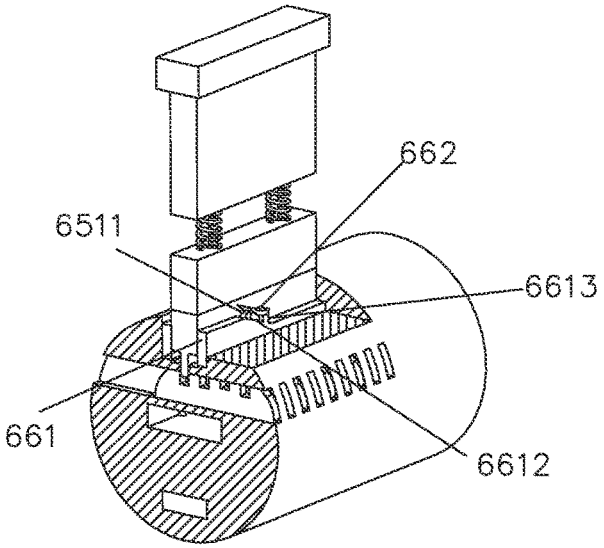
FIG. 98 illustrates a schematic diagram of the tumbler, the push rod and the front plug of the lock of the sixth embodiment that the key returns to the second step.
Figure 99:
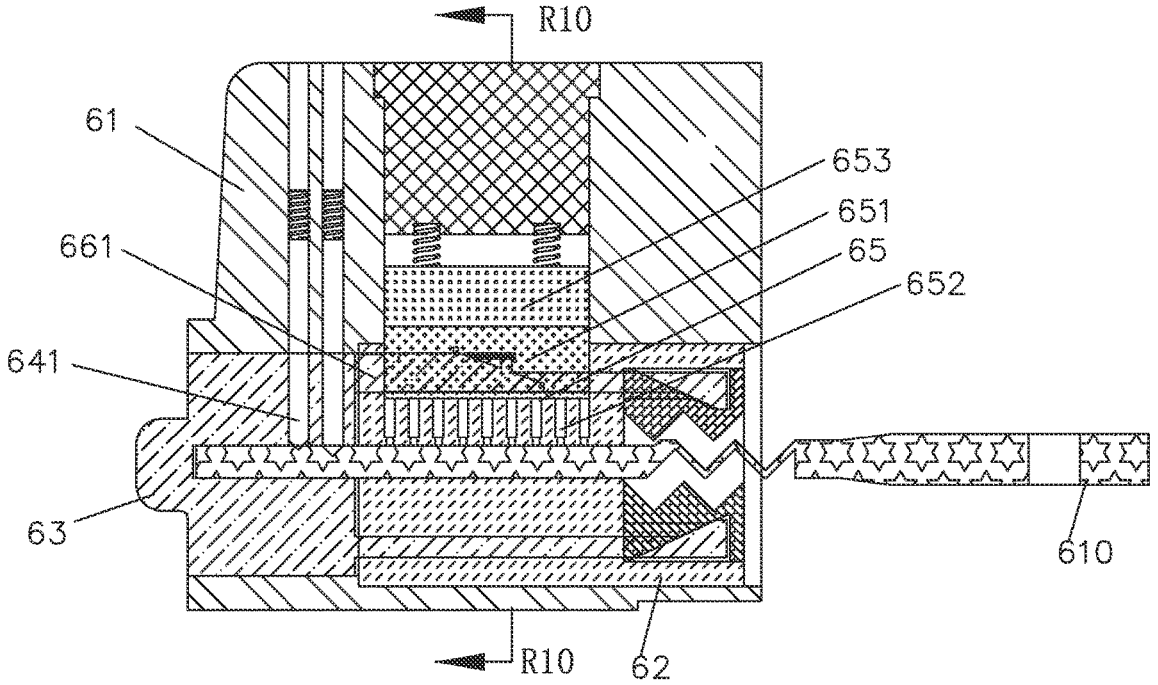
FIG. 99 illustrates a schematic diagram of the lock of the sixth embodiment when the key resets to the second position.
Figure 100:
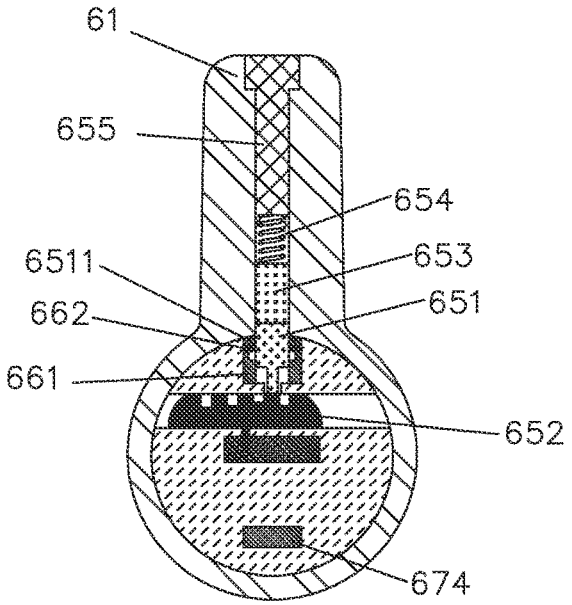
FIG. 100 illustrates a sectional diagram of R10-R10 line of FIG. 99.
Figure 101:
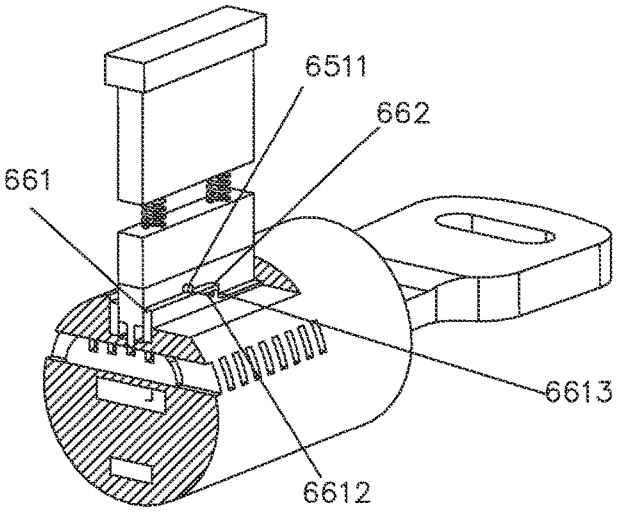
FIG. 101 illustrates a schematic diagram of the tumbler, the push rod and the front plug of the lock of the sixth embodiment when the key resets to the second position.

Referring to FIG. 1, an embodiment of the method according to the present invention is described using a first plug and a second plug utilizing a pin plug structure.

The lock of the present invention provides a dual plug, having a first plug 111 and a second plug 121. A first pin mechanism 112 is used to lock and unlock the first plug 111. When the first pin mechanism 112 locks, it locks between the first plug 111 and a lock body 110. The first plug 111 is unable to rotate. When the first pin mechanism 112 of the first plug 111 unlocks, assuming that there is no other lock, the first plug 111 is rotatable. Likewise, a second pin mechanism 122 is used to lock and unlock the second plug 121. When the second pin mechanism 122 locks, it locks between the second plug 121 and the lock body 110, the second plug 121 is unable to rotate. When the second pin mechanism 122 of the second plug 121 unlocks, assuming that there is no other lock, the second plug 121 is rotatable.

The method for mutually controlling and unlocking a dual plug in a lock according to the present invention comprises:

The first plug 111 is unlocked first. Before the first pin mechanism 112 is unlocked, the first plug 111 restricts the unlocking of the second plug 121 and the second plug 121 restricts the rotating of the first plug 111.

The code of the first plug 111 is unlocked first, namely the first pin mechanism 112 is unlocked. At this time, a valid unlocking device, i.e. a valid key 120, is used to unlock the first pin mechanism 112. The first plug 111 restricts the unlocking of the second plug 121 before the first plug is unlocked. The second plug 121 has a second pin mechanism 122, therefore, to restrict the unlocking of the second plug is to restrict the unlocking of the second pin mechanism. In this embodiment, the action part 113 of the first plug 111 is linked to the code of the second plug 121 (the second pin mechanism 122), the action part 113 of the first plug 111 restricts the second pin mechanism 122. In FIG. 1, the action part 113 locks one or more pins of the second pin mechanism to immobilize them, for example, the innermost pin 1221 of the second pin mechanism 122, causing the pin 1221 unable to move. Therefore, before the first plug 111 moves, the code of the second plug 121 (the second pin mechanism 122) cannot be unlocked by a valid unlocking device (the valid unlocking area of the key 120). The second plug 121 restricts the rotating of the first plug 111; the rotating of the second plug is linked to the rotating of the first plug, the implement method is that a solid part 123 is used to connect the first plug 111 and the second plug 121, and the solid part 123 is eccentrically arranged. Therefore, if the second plug cannot rotate, the first plug cannot rotate by itself, that is to say, if the first plug cannot rotate, the second plug 121 cannot rotate by itself. The first and second plugs rotate therefore synchronously.

After the code of the first plug 111 (the first pin mechanism 112) is unlocked, the first plug 111 can move but not rotate.

After the code of the first plug 111 is unlocked, that is, the key 120 matches the first pin mechanism 112 of the first plug. If there is no other restriction, the first plug 111 is rotatable. But in the present invention, the first plug 111 is movable but not rotatable at this time. An external condition restricts the rotating of the first plug 111 but does not restrict the translation of the first plug 111, so the first plug 111 can translate but not rotate. As the second plug 121 restricts the rotating of the first plug 111, the second plug is the external restriction. Another external restriction can be added to the first plug 111 itself using the structure between the first plug 111 and the lock body 110. For example, a key lever 114 is locked between the lock body 110 and the first plug 111, a ring groove 115 and an elongated groove 116 are arranged axially in the first plug 111. The key lever 114 is coupled to the ring groove 115 and the elongated groove 116, so that the first plug 111 cannot rotate after the code (the first pin mechanism 112) is unlocked, further restricting the rotating of the first plug 111 by itself; only when the first plug 111 translates to the second position (until the key lever 114 is coupled to the ring groove 115), the first plug 111 lifts its own restriction to rotation.

When the first plug 111 translates to the second position, it releases the restriction to the unlocking of the second plug, the second plug 121 still restricts the rotating of the first plug 111.

The movement of the first plug 111 causes the action part 113 to move; which may be designed as: before the action part 113 moves, the action part 113 locks the pin mechanism (the pin 1221) of the second plug, making the second pin mechanism 122 unable to move; after the action part 113 translates to the second position, it moves out the lock to the pin 1221, thus releasing the locking to the second pin mechanism 122 of the second plug 121, the second pin mechanism 122 moves. Therefore, when the first plug 111 translates to the second position, the first plug 111 releases the restriction to the unlocking the code of the second plug (the second pin mechanism 122). In other words, after the first plug 111 translates to the second position, the action part 113 of the first plug 111 releases the lock to the code of the second plug (the second pin mechanism 122), making the code of the second plug (the second pin mechanism 122) able to be unlocked by a valid unlock device (the key 120).

The code of the second plug 121 (the second pin mechanism) is then unlocked. After the code of the second plug (the second pin mechanism 122) is unlocked, the first plug 111 and the second plug 121 can rotate synchronously to unlock the lock.

To unlock the code of the second plug 121 (the second pin mechanism), a valid unlock device, a valid key 120, can unlock the second pin mechanism 122. After the second pin mechanism 122 of the second plug is unlocked, two plugs are unlocked, the first and second plug can rotate synchronously to unlock the lock.

The method for mutually controlling and unlocking a dual plug in a lock of the present invention can be further provided that, when the first plug 111 translates to the second position, an entrance (the key hole) of the second plug 121 for inserting of an unlock device is gradually partially closed or completely closed.

This solution makes the action part 113 of the first plug linked to the code of the second plug (the second pin mechanism 122); for example, controlling a pin 1222 at the external side of the second pin mechanism 122 to fall down to a lowest position to be locked. The gap between the bottom portion of the pin 1222 and the key 120 is as small as possible, so the key hole can be closed partially; before the first plug 111 takes action, the first plug 111 does not act on the second plug 121, that is, the action part 113 of the first plug 111 does not act on the pin 1222 of the pin mechanism of the second plug. After the first plug 111 translates to the second position, the code of the second plug 121 (the second pin mechanism 122) is acted by the action part 113 of the first plug 111, causing an entrance (the key hole) of the second plug 121 for a unlocking device to insert to be partially closed. In this embodiment, the second pin mechanism is locked, the pin 1222 of the second pin mechanism is inserted into the key hole to make the key hole become smaller.

The entrance (the key hole) of the second plug 121 for the unlocking device to insert is partially closed, and the code (i.e. the pin 1222) corresponding to the partially closed entrance (the key hole) is unlocked. That is, the pin 1222 inserted into the key hole is in an unlocked position that does not influence the use of the key 120. The solution can be achieved by designing the length and the correlation relationship with the key 120 of the pin 122.

The codes of the first and second plug may be unlocked by the same unlocking device (the key 120) using different unlocking areas. In the solution provided by the present invention, it uses the same key with corresponding unlocking areas for the first pin mechanism 112 and the second pin mechanism 122.

In a situation where the valid unlocking device (the key 120) is used, when the first plug 111 translates to the second position and releases the restriction on the second plug 121, the unlocking device (the key 120) unlocks the code of the second plug 121 (the second pin mechanism 122).

The method for mutually controlling and unlocking a dual plug according to the present invention utilizes the mutual control of two plugs to increase the difficulty of unlocking by techniques or by brute force, it improves the lock security. The code of the plug may be implemented using a pin mechanism and the unlocking device may be implemented using a key.

When the valid key 120 is not inserted into the key hole, the first pin mechanism 112 of the first plug and the second pin mechanism 122 of the second plug are in a closed state. At this time, the first pin mechanism 112 of the first plug restricts the first plug's 111 movement in relation to the lock body, the second pin mechanism 122 of the second plug restricts the second plug's 121 movement in relation to the lock body, and as the action part 113 of the first plug 111 is linked to the code of the second plug 121 (the second pin mechanism 122 of the second plug), the rotation of the second plug 121 is linked to the rotating of the first plug 111. Therefore, the first plug 111 restricts the unlocking of the pin mechanism of the second plug 121 and the second plug restricts the rotating of the first plug 111.

When the valid key 120 is inserted into the key hole, the first plug 111 is unlocked first. Afterwards, the first plug 111 can move but not rotate; at this time, the valid key makes the first pin mechanism 112 of the first plug release the lock to the first plug 111, making the first plug 111 move in relation to the lock body. The action is moving but not rotating, as the rotating of the second plug 121 is linked to the rotating of the first plug 111. The second plug 121 still restricts the rotating of the first plug 111.

When the first plug 111 translates to the second position, it releases its restriction on the unlocking to the code of the second plug 121 (the pin mechanism of the second plug), but the second plug 121 still restricts the rotating of the first plug 111; if a valid key 120 is used to make the first plug 111 to move, when the first plug 111 translates to the second position, the key unlocks the code of the second plug 121 (the pin mechanism of the second plug), the first and second plug can rotate synchronously to unlock the lock.

This embodiment is a front and rear plug structure.

Other structures such as stacked upper and lower plugs, or inner and outer plugs can also be implemented.

Second Embodiment

Referring to FIGS. 2-20, a lock with a dual plug comprises a lock head and a key 21; the lock head comprises a lock body 22, a first plug 24 and a second plug 23; the first and second plugs are rotatably assembled in the lock body 22; a first lock mechanism 26 and a second lock mechanism 25, which can be unlocked by the key, are respectively assembled between the first plug 24, the second plug 23 and the lock body 22 so as to restrict the rotating of the first plug 24 and the second plug 23 in relation to the lock body 22; the first plug 24 and the second plug 23 are mutually controllably connected; the first plug 24 is disposed with a control mechanism 27 to control the second plug 23, the first plug 24 is disposed with a preset position difference; before the first plug 24 translates to the second position, the second lock mechanism 25 is unable to be unlocked; when the key 21 is inserted into the key hole, the key unlocks the first lock mechanism 26 first, then the key 21 pushes the first plug 24 to translate to a second position from a first position using the preset position difference; when the first plug 24 translates to the second position, the control mechanism 27 releases translation on the second lock mechanism 25, making the key 21 be able to unlock the second lock mechanism 25; the first plug 24 and the second plug 23 rotate synchronously by the driving of the key 21 to unlock the lock.

The first plug 24 and the second plug 23 are located front to back, the first plug 24 is a rear plug and the second plug 23 is a front plug; the first lock mechanism 26 and the second lock mechanism 25 are respectively a rear lock mechanism and a front lock mechanism; the front plug 23 and the rear plug 24 are rotatably assembled in the lock body 22; the front lock mechanism 25 and the rear lock mechanism 26, which can be unlocked by the key, are respectively between the front and rear plug and the lock body 22 to restrict the rotating of the front and rear plug in relation to the lock body 22; the front plug 23 and the rear plug 24 are mutually controllably connected; the rear plug 24 is further assembled with the control mechanism 27 to control the front lock mechanism 25; before the rear plug 24 translates to the second position, the front lock mechanism 25 can not be unlocked; when the key 21 is inserted into the key hole, the key 21 unlocks the rear lock mechanism 26 first, and then pushes the rear plug 24 to move backward axially to the second position, the control mechanism 27 releases translation on the front lock mechanism 25, making the key 21 be able to unlock the front lock mechanism 25; the front and rear plug therefore rotate synchronously by the driving of the key to unlock the lock.

The front lock mechanism 25 between the front plug 23 and the lock body 22 is a pin mechanism, which is assembled radically between the front plug 23 and the lock body 22 to restrict the rotating of the front plug 23; the front lock mechanism 25 comprises a first upper pin 251, a first lower pin 252, a first pin spring 253, a first pin hole 254 disposed in the lock body 22 and a second pin hole 255 disposed at the front plug 23; the pin components of the front lock mechanism 25 can be more than one; the first pin hole 254 of the lock body 22 and the second pin hole 255 of the front plug 23 are in coupled positions; the first upper pin 251, the first pin spring 253 and the first lower pin 252 are assembled in the first pin hole 254 and the second pin hole 255; before the key unlocks, the first lower pin 252 is located in the first pin hole 254 and the second pin hole 255 at the same time, making the front plug 23 and the lock body 22 unable to rotate; when the key unlocks, the first upper pin 251 keeps in the first pin hole 254, the first lower pin 252 returns back to the second pin hole 255, making the front plug 23 and the lock body 22 rotatable. The front plug 23 further comprises a push rod slide groove 231 axially arranged and connected to the pin hole of the pin mechanism; the control mechanism comprises a pin push rod 271, which is assembled in the push rod slide groove 231 to control the first lower pin 252 of the pin mechanism, one end of the pin push rod 271 is linked to the rear plug 24, that is to say, moving of the rear plug 24 causes the movement of the pin push rod 271.

The pin push rod 271 is disposed with a sloping slide groove 2711, the first lower pin 252 of the pin mechanism is disposed with a protruding portion 2521 coupled to the sloping slide groove 2711 of the pin push rod; when the pin push rod 271 moves in the horizontal direction, with the coupling of the sloping slide groove 2711 of the pin push rod and the protruding portion of the pin, the first lower pin 252 is controlled to move up and down, making the first lower pin 252 switched between a position the key can not unlock and a position the key can unlock. That is to say, the movement of the pin push rod 271 controls the first lower pin 252 to move up and down; when the first lower pin 252 is in a proper position, the key can unlock the front lock mechanism 25; when the first lower pin 252 is in another position, the key can not unlock the front lock mechanism 25. Therefore, the control mechanism controls the unlock condition of the front lock mechanism 25.

The first lower pin 252 is disposed with two symmetrical protruding portions 2521, to which two sloping slide grooves of the pin push rod 271 coupled, so the first lower pin 252 can move up and down stably.

The lock further comprises a gate mechanism 28 disposed at the front portion of the key hole of the front plug, the gate mechanism 28 is linked to the rear plug directly or through the pin push rod of the control mechanism; when the rear plug 24 moves backward to the second position, the gate mechanism 28 closes the key hole.

The gate mechanism 28 comprises an upper gate, which is coupled to the other end of the pin push rod 271, at the upper side of the front portion of the key hole; the upper gate 281 is disposed with an incline surface 2811, the other end of the pin push rod is disposed with an incline surface 2712, two incline surface are coupled to each other. When the rear plug 24 drives the pin push rod 271 to move backward, with the coupled two incline surfaces, the upper gate 281 falls down to close a part of the key hole. When the rear plug 24 drives the pin push rod 271 to move forward, with the coupled two incline surfaces, the upper gate 281 lifts up that it does not close the key hole any longer.

The gate mechanism further comprises a lower gate 282 disposed at the lower side of the front portion of the key hole and a lower gate push rod 283. One end of the lower gate push rod 283 is fixed to the rear plug 24, the lower gate 282 is disposed with an incline surface 2821, the other end of the lower gate push rod 283 is disposed with an incline surface 2831, the incline surface 2821 is coupled to the incline surface 2831. When the rear plug 24 drives the lower gate push rod 283 to move backward, with the coupled two incline surfaces, the lower gate 282 lifts up to close a part of the key hole. When the rear plug 24 drives the lower gate push rod 283 to move forward, with the coupled two incline surfaces, the lower gate 282 falls down that it does not close the key hole any longer.

One end of the pin push rod 271 is disposed with a lock groove 2713; the rear plug 24 is disposed with a lock block fixing groove 241, a lock block 272 is inserted between the lock groove 2713 of the pin push rod and the lock block fixing groove 241 of the rear plug 24 to make the end of the pin push rod linked to the rear plug 24; when the rear plug 24 moves axially, the rear plug 24 drives the pin push rod 271 to move axially by the lock block 272.

The rear end of the front plug 23 is further disposed with a protruding portion 232, which is disposed between the lock block fixing groove 241 of the rear plug and the lock groove 2713 of the pin push rod. The protruding portion 232 of the front plug 23 is disposed with a lock block slide groove 2321, the lock block 272 passes through the lock block slide groove 2321 of the protruding portion of the front plug to couple between the lock groove 2713 of the pin push rod and the lock block fixing groove 241 of the rear plug; when the rear plug 24 drives the pin push rod 271 to move axially by the lock block, the lock block 272 moves in the lock block slide groove 2321 in the axial direction.

The lock block slide groove 2321 of the front plug 23 is disposed with a sloping slide groove 2322, which is coupled to the lock block 272 to make the lock block 272 move in the lock block slide groove 2321 axially and radically; when the rear plug 24 moves backward axially to the second position, the lock block 272 escapes from the lock groove 2713 of the pin push rod.

A spring 273 is assembled at the bottom end of the lock block 272; two sides of the lock block 272 are respectively disposed with a wing portion 2721; the sloping slide groove 2322 of the lock block slide groove is faced down; the lock block 272 is assembled in the lock block fixing groove 241 of the rear plug by the spring 273; the wing portions 2721 of the lock block abut against the sloping slide groove 2322 of the lock block slide groove.

The lock further comprises a delayer, which is a hydraulic delayer 29; the hydraulic delayer 29 is assembled between the lock body 22 and the end of the pin push rod 271; when the rear plug 24 translates to the second position, the pin push rod 271 pushes the delayer 29 to make the delayer 29 compressed to store energy; when the front and rear plug rotate, the delayer does not release energy to push the pin push rod 271 to return; if the front and rear plug do not rotate, the delayer 29 releases energy to push the pin push rod 271 to return to the position to control the front lock mechanism 25 in a preset period.

When the rear plug 24 returns to the initial position, all components return to the initial state.

The hydraulic delayer 29 comprises a main body 291, a piston 292, an inner tube 293, a spring 294 and a spindle 295. the inner tube 293 is fixed in the main body 291; an oil cavity is formed between the inner tube 293 and the main body 291; the piston 292 is slidably assembled in the inner tube 293 by the spring 294; an inner tube cavity disposed between the piston 292 and the inner tube 293 is connected to a damping hole of the oil cavity; one end of the spindle 295 is fixed to the piston 292, the other end is coupled to the end of the pin push rod 271; the inner tube 293 further comprises a check valve to achieve quick oil discharging from the inner tube cavity to the oil cavity;

The check valve of the hydraulic delayer 29 is a non-return valve, which is an unidirectional passage for the oil to discharge out of the inner tube in high volume; the damping hole is an adjustable small passage for the oil to flow in two ways through the inner tube. When the spindle 295 is acted by external force, the piston 292 is driven to squeeze the spring 294, oil in the inner tube 293 flows out through the check valve and the damping hole; when the external force disappears, the compressed spring 294 resets to squeeze the piston 292, the piston 292 moves to compress the oil, the oil then flows from the damping hole to the inner tube 293, (as the size of the damping hole is adjustable, the moving speed of the piston is controllable to achieve delay effect) the spring 294 pushes the piston 292 to the initial piston for next time's action. According to the principle, the delayer can delay reset a movable object.

In this embodiment, the rear lock mechanism between the rear plug 24 and the lock body 22 is a pin mechanism, which is assembled between the rear plug and the lock body radically to restrict the rotating and axially translation of the rear plug. In another case, the rear lock mechanism can be a blade mechanism.

The unlocking process of the present invention will be further described.

As figured in FIGS. 9-20, before the key is inserted to the key hole, the front lock mechanism 25 of the front plug 23 restricts the rotating of the front plug 23 in relation to the lock body 22, and the rear lock mechanism 26 of the rear plug 24 restricts the rotating of the rear plug 24 in relation to the lock body; the front plug controls the rotating of the rear plug, as with the pin push rod 271 and the lower gate push rod 283 between the front and rear plug; the rear plug 24 restricts the unlocking of the front plug 23 by the control mechanism 27; the upper gate 281 and the lower gate 282 are open.

When a valid key is inserted into the key hole to the unlocking position of the rear plug, no matter the rear lock mechanism of the rear plug is a pin mechanism or a blade mechanism, the valid key can unlock the rear lock mechanism 26; the rear plug 24 can move in relation to the lock body 22 after the rear lock mechanism 26 is unlocked.

Before the rear plug 24 moves backward, the front plug 23 can not be unlocked due to the control mechanism.

The rear plug 24 moves backward and drives the pin push rod 271 to move backward, thus making the first lower pin 252 gradually fall down. During the rear plug 24 moves backward, the lock block 272 gradually moves down.

When the rear plug 24 moves backward to the second position, the first lower pin 252 falls down to the second position, making the first lower pin 252 switched from a position the key can not unlock to a position the key can unlock; at this time, the front plug 23 can be unlocked. The lock block 272 completely escapes from the lock groove 2713 of the pin push rod 271. Due to the pin push rod 271 and the lower gate push rod 283, the upper gate 281 and the lower gate 282 are closed. When the rear plug 24 moves backward to the second position, the delayer 29 is compressed by the spindle 295 and stores energy.

As the valid key unlocks the front lock mechanism 25, the front and rear plug can rotate synchronously to unlock the lock. When the key is pulled out, the rear plug 24 returns to the initial position, all components return to the initial state.

If in a certain synchronously, the delayer 29 works, the spring of the delayer 29 resets, the delayer 29 makes the pin push rod 271 to move forward by the spindle 295, thereby driving the first lower pin 252 to lift up to switch to the position the key can not unlock from the position the key can unlock, the control mechanism re-controls the front lock mechanism 25.

Third Embodiment

Referring to FIGS. 21-33, the lock with dual plug of the present invention comprises a lock head and a key 310; the lock head comprises a lock body 31 and a plug; the plug is rotatably assembled in the lock body 31; the plug comprises an upper plug 321 (the second plug) and a lower plug 322 (the first plug), the lower plug 322 can move in the lock body 31 axially; an upper lock mechanism 33 (the second lock mechanism) is assembled between the upper plug 321 and the lock body 31; a lower lock mechanism 34 (the first lock mechanism) is assembled between the lower plug 322 and the lock body 31; the key 310 is disposed with an upper and lower key groove to respectively unlock the upper and lower lock mechanism; the lower plug 322 further comprises a control mechanism to control the upper lock mechanism 33; before the lower plug translates to the second position axially, the upper lock mechanism 33 can not be unlocked; when the key 310 is inserted into the key hole, the lower key groove of the key 310 unlocks the lower lock mechanism 34 first, then the key 310 pushes the lower plug 322 to move backward axially to the second position, at this time, the control mechanism releases translation on the upper lock mechanism 33, making the upper key groove of the key 310 able to unlock the upper lock mechanism; the upper plug 321 and the lower plug 322 can rotate synchronously by the driving of the key 310 to unlock the lock.

The upper lock mechanism 33 between the upper plug 321 and the lock body 31 is a pin mechanism, which is assembled radically between the upper plug 321 and the lock body 31 to restrict the rotating of the upper plug 321; the upper plug 321 is further disposed with a push rod slide groove 3211 axially arranged and connected to the pin hole of the pin mechanism; the control mechanism comprises a pin push rod 35, which is assembled to the push rod slide groove 3211 of the upper plug to control the pin 331 of the pin mechanism; the rear end of the pin push rod 35 is linked to the lower plug 322.

The pin push rod 35 is disposed with a sloping slide groove 351, the pin 331 of the pin mechanism is disposed with a protruding portion 3311 coupled to the sloping slide groove 351; during the pin push rod 35 moves axially, with the coupling of the sloping slide groove 351 of the pin push rod and the protruding portion 3311 of the pin, the pin 331 moves up and down, making the pin switched between a position the key can not unlock and a position the key can unlock.

The pin mechanism of the upper lock mechanism 33 of the present invention applies traditional pin components. The difference is that the pin 331 is further disposed with a protruding portion 3311, the corresponding pin hole is configured to couple to the moving of the protruding portion 3311.

The pin 331 is disposed with two symmetrical protruding portions 3311, the pin push rod 35 is disposed with two sloping slide grooves 351 coupled to the protruding portions 3311 of the pin.

The rear end of the pin push rod 35 is disposed with a lock groove 352, the lower plug 322 is disposed with a lock block fixing groove 3221, a first lock block 353 is connected between the lock groove 352 of the pin push rod and the lock block fixing groove 3221 of the lower plug to make the rear end of the pin push rod 35 linked to the lower plug 322; when the lower plug 322 moves axially, the lower plug 322 drives the pin push rod 35 to move axially through the lock block 353.

The groove bottom of the push rod slide groove 3211 of the upper plug 321 is further disposed with a lock block slide groove 3212 in the axial direction; the lock block slide groove 3212 of the upper plug is disposed between the lock block fixing groove 3221 of the lower plug and the lock groove 352 of the pin push rod; the lock block 353 passes through the lock block slide groove 3212 of the upper plug and is coupled between the lock groove 352 of the pin push rod and the lock block fixing groove 3221 of the lower plug; when the lower plug 322 drives the pin push rod 35 to move axially by the lock block, the lock block 353 moves axially in the lock block slide groove 3212.

The lock block slide groove 3212 is disposed with a sloping slide groove 3213, to which the lock block 353 is coupled to make the lock block 353 move axially in the lock block slide groove 3212 and further move radically; when the lower plug 322 translates to the second position in the axial direction, the lock block 353 escapes out of the lock groove 352 of the pin push rod.

The bottom end of the lock block 353 is disposed with a spring 354; two sides of the lock block 353 are disposed with a wing, the sloping slide groove 3213 of the lock block slide groove is faced down, the lock block 353 is assembled in the lock block fixing groove 3221 of the lower plug through the spring 354; the wings of the lock block 353 abut against the sloping slide groove 3213 of the lock block slide groove.

The lock further comprises a gate mechanism disposed at the front of the key hole, the gate mechanism is linked to the lower plug 322; the gate mechanism makes the key hole closed during the lower plug 322 moving backward axially to the second position.

The gate mechanism comprises a upper gate 361 at the upper side of the front portion of the key hole and a lower gate 362 at the lower side of the front portion of the key hole, the upper and lower gate are respectively coupled to the front end of the upper and lower gate push rod 363, 364; the rear end of the upper and lower gate push rod are respectively fixed to the lower plug 322.

The upper gate 361 is disposed with an incline surface 3611, the front end of the upper gate push rod 363 is disposed with an incline surface 3631, the incline surface 3611 of the upper gate is coupled to the incline surface 3631 of the upper gate push rod; the lower gate 362 is disposed with an incline surface 3621, the front end of the lower gate push rod 364 is disposed with an incline surface 3641, the incline surface 3621 is coupled to the incline surface 3641.

When the lower plug 322 returns to the initial position, all components return to initial state.

The lock further comprises a delayer 37, which is assembled between the lock body 31 and the rear end of the pin push rod 35; when the lower plug 322 translates to the second position backward, the pin push rod 35 pushes and compresses the delayer 37 to store energy; when the upper and lower plug rotate, the delayer 37 does not release energy to push the pin push rod 35 to return; if the front and rear plug do not rotate, the delayer 37 releases energy to push the pin push rod 35 to return to control the upper lock mechanism 33 in a preset period, namely re-locking the pin 331.

The delayer 37 can also apply with a similar structure to the second embodiment.

The lower lock mechanism between the lower plug 322 and the lock body 31 is a pin mechanism 341, which is assembled between the lower plug 322 and the lock body 31 radically to restrict the rotating and axially translation of the lower plug 322.

In another case, the pin mechanism 341 can be a traditional pin component.

The unlocking process of the present invention will be further described.

As figured in FIGS. 26-33, before the key is inserted into the key hole, the upper lock mechanism 33 of the upper plug 321 restricts the rotating of the upper plug 321 in relation to the lock body 31, and the lower lock mechanism 34 of the lower plug 322 restricts the rotating of the lower plug 322 in relation to the lock body 31; the upper plug 321 controls the rotating of the lower plug 322; the lower plug 322 controls the unlocking condition of the upper plug 321 by the control mechanism; the upper gate 361 and the lower gate 362 are open.

When a valid key is inserted into the key hole to align with the lower lock mechanism 34 of the lower plug 322, that is to say, the lower key groove of the key 310 aligns with the pin mechanism 341, the valid key can unlock the lower lock mechanism 34; after the lower lock mechanism 34 is unlocked, the lower plug 322 can rotate and axially move in relation to the lock body 31 theoretically. But due to the restrict of the upper plug 321, the lower plug 322 can only move axially; the key 310 can push the lower plug 322 to move backward axially.

Before the lower plug 322 moves backward, the upper plug 321 can not be unlocked due to the control mechanism.

The lower plug 322 moves backward and drives the pin push rod 35 to move backward, thus making the pin 331 gradually fall down. During the lower plug 322 moves backward, the lock block 353 gradually moves down.

When the lower plug 322 moves backward to the second position, the pin 331 falls down to the second position, making the pin 331 switched from a position the key can not unlock to a position the key can unlock; at this time, the upper plug 321 can be unlocked. The lock block 353 completely escapes from the lock groove 352 of the pin push rod 35. During the lower plug 322 moves backward, it drives the upper gate push rod 363 and the lower gate push rod 364 to move backward; with the coupling of the incline surfaces, the upper gate 361 and the lower gate 362 are gradually closed. When the lower plug 322 moves backward to the second position, the delayer 37 is compressed and stores energy.

As the valid key unlocks the upper lock mechanism 33, the upper and lower plug can rotate synchronously to unlock the lock. When the key exits, the lower plug 322 returns to the initial position, all components return to the initial state.

If in a certain period (which can be set by the delayer 37), the front and rear plug do not rotate synchronously, the delayer 37 works and resets to make the pin push rod 35 move forward, thereby driving the pin 331 to lift up to switch to a position the key can not unlock from the position the key can unlock, the control mechanism re-controls the upper lock mechanism 33.

Fourth Embodiment

As figured in FIGS. 34-53, this embodiment differs from the third embodiment in that: the upper lock mechanism 33 between the upper plug 321 and the lock body 31 is different, the corresponding control mechanism and other coupling parts are also different.

In this embodiment, the upper lock mechanism 33 between the upper plug 321 and the lock body 31 is a blade mechanism, the blade mechanism comprises a tumbler 332 radically assembled between the upper plug 321 and the lock body 31 to restrict the rotating of the upper plug 321 and a blade components 333 assembled in the upper plug and linked to the tumbler 332; the blade component 333 is assembled in the upper plug 321, the tumbler 332 is assembled between the upper plug 321 and the lock body 31 through a press block and a spring; the upper plug 321 is further disposed with a push rod slide groove 3214 axially arranged and connected to the tumbler; the control mechanism comprises a tumbler push rod 38, which is assembled to the push rod slide groove 3214 of the upper plug to control the tumbler 332 of the blade mechanism, the rear end of the tumbler push rod 38 of the control mechanism is linked to the lower plug 322.

The tumbler push rod 38 is disposed with a slide groove 381 axially movable in relation to the tumbler; the slide groove 381 of the tumbler push rod of the control mechanism is disposed with an incline surface 3811; the tumbler 332 is disposed with a protruding portion 3321; the incline surface 3811 of the tumbler push rod is faced up and is coupled to the protruding portion 3321 of the tumbler so as to restrict the tumbler 332 from falling down radically before the tumbler push rod 38 moves backward to the position The tumbler 332 is disposed with two symmetrical protruding portions 3321, the slide groove 381 of the tumbler push rod is disposed with two incline surfaces 3811 respectively coupled to the protruding portions 3321 of the tumbler.

The rear end of the tumbler push rod 38 is disposed with a lock groove 382; the lower plug 322 is disposed with a lock block fixing groove 3222, a lock block 383 is inserted between the lock groove 382 of the tumbler push rod and the lock block fixing groove 3222 of the lower plug to make the rear end of the tumbler push rod 38 linked to the lower plug; when the lower plug 322 moves axially, the lower plug 322 drives the tumbler push rod 38 to move axially by the lock block.

The groove bottom of the push rod slide groove 3214 of the upper plug is further disposed with a lock block slide groove 3215 in the axial direction; the lock block slide groove 3215 of the upper plug is disposed between the lock block fixing groove 3222 of the lower plug and the lock groove 382 of the tumbler push rod; the lock block 383 passes through the lock block slide groove 3215 of the upper plug and is coupled between the lock groove 382 of the tumbler push rod and the lock block fixing groove 3222 of the lower plug; when the lower plug 322 drives the tumbler push rod 38 to move axially by the lock block 383, the lock block 383 moves axially in the lock block slide groove 3215.

The lock block slide groove 3215 is disposed with a sloping slide groove 3216, to which the lock block 383 is coupled to make the lock block 383 move axially in the lock block slide groove 3215 and further move radically; when the lower plug 322 translates to the second position backward in the axial direction, the lock block 383 escapes out of the lock groove 382 of the tumbler push rod 38.

The bottom end of the lock block 383 is disposed with a spring 384, two sides of the lock block 383 are disposed with a wing, the sloping slide groove 3216 of the lock block slide groove is faced down, the lock block 383 is assembled in the lock block fixing groove 3222 of the lower plug through the spring 384; the wings of the lock block 383 abut against the sloping slide groove 3216 of the lock block slide groove.

The unlocking process of the present invention will be further described.

As figured in FIGS. 38-53, when the key does not insert to the key hole, the upper lock mechanism 33 of the upper plug 321 restricts the upper plug 321 to rotate in relation to the lock body 31, and the lower lock mechanism 34 of the lower plug 322 restricts the lower plug 322 to rotate or axially move in relation to the lock body 31; the upper plug 321 controls the rotating of the lower plug 322, the lower plug 322 controls the unlocking condition of the upper plug 321 by the control mechanism 27; the upper gate 361 and the lower gate 362 are open.

When a valid key is inserted into the key hole to align with the lower lock mechanism 34 of the lower plug 322, that is to say, the lower key groove of the key 310 aligns with the pin mechanism 341, the valid key can unlock the lower lock mechanism 34; after the lower lock mechanism 34 is unlocked, the lower plug 322 can rotate and axially move in relation to the lock body 31 theoretically. But due to the restrict of the upper plug 321, the lower plug 322 can only move axially; the key 310 can push the lower plug 322 to move backward axially.

Before the lower plug 322 moves backward, the upper plug 321 can not be unlocked due to the control mechanism.

The lower plug 322 moves backward and drives the tumbler push rod 38 to move backward, thus gradually releasing the lock to the protruding portion 3321 of the tumbler 332. During the lower plug 322 moves backward, the lock block 383 gradually moves down.

When the lower plug 322 moves backward to the second position, the incline surface 3811 of the tumbler push rod 38 does not lock the protruding portion 3321 of the tumbler 332 any longer; at this time, the upper plug 321 can be unlocked. The lock block 383 completely escapes from the lock groove 382 of the tumbler push rod 38. During the lower plug 322 moves backward, it drives the upper gate push rod 363 and the lower gate push rod 364 to move backward; with the coupling of the incline surfaces, the upper gate 361 and the lower gate 362 are gradually closed. When the lower plug 322 moves backward to the second position, the delayer 37 is compressed to store energy.

when the valid key unlocks the upper lock mechanism 33, the upper and lower plug can rotate synchronously to unlock the lock. When the key is pulled out, the lower plug 322 returns to the initial position, all components return to the initial state.

If in a certain period (which can be set by the delayer 37), the front and rear plug do not rotate synchronously, the delayer 37 works, the delayer 37 resets, the delayer 37 makes the tumbler push rod 38 to move forward, thereby driving the incline surface 3811 of the tumbler push rod 38 to re-lock to the protruding portion 3321 of the tumbler 332, the control mechanism re-controls the upper lock mechanism 33.

Fifth Embodiment

As figured in FIGS. 54-73, the lock with a dual plug of the present invention comprises a lock head and a key 59; the lock head comprise a lock body 51, an inner plug 52 (the first plug) and an outer plug 53 (the second plug); the outer plug 53 is rotatably assembled in the lock body 51, the outer lock mechanism 55 (the second lock mechanism), which can be unlocked by the key 59, is assembled between the outer plug 53 and the lock body 51 to restrict the rotating of the outer plug 53 in relation to the lock body 51; the inner plug 52 is rotatably assembled in the outer plug 53, the inner lock mechanism 54 (the first lock mechanism), which can be unlocked by the key 59, is assembled between the inner plug and the lock body to restrict the rotating of the inner plug in relation to the lock body 51; the inner and outer plug are mutually controllably connected; the inner plug 52 is assembled with the control mechanism 56 to control the outer lock mechanism 55; before the inner plug 52 rotates to the second position, the outer lock mechanism 55 can not be unlocked; when the key 59 is inserted into the key hole, the key 59 unlocks the inner lock mechanism 54 first, then pushes the inner plug 52 to rotate; when the inner plug 52 rotates to the second position, the control mechanism 56 releases translation on the outer lock mechanism 55 to be unlocked; the inner and outer plug rotate synchronously by the driving of the key 59 to unlock the lock.

The outer lock mechanism 55 between the outer plug 53 and the lock body 51 is a first pin mechanism 551, which is assembled radically between the outer plug 53 and the lock body 51 to restrict the rotating of the outer plug 53; the outer lock mechanism 55 comprises a first upper pin 5511, a first lower pin 5512, a first spring 5513, a first pin hole 513 disposed in the lock body 51 and a second pin hole 532 disposed at the outer plug 53; the pin components of the outer lock mechanism 55 can be more than one; the first pin hole 513 of the lock body 51 and the second pin hole 532 of the outer plug 53 are in coupled positions; the first upper pin 5511 and the first lower pin 5512 are assembled in the first pin hole 513 and the second pin hole 532 by the first spring 5513; when the outer plug 53 is not unlocked, the first lower pin 5512 is both located in the first pin hole 513 and the second pin hole 532 to restrict the rotating of the outer plug 53 and the lock body 51; when the outer plug 53 is unlocked, the first lower pin 5512 returns to the second pin hole 532, making the outer plug 53 and the lock body 51 rotatable relatively. The outer plug 53 further disposed with a push rod slide groove 531 axially arranged and connected to the pin hole of the first pin mechanism 551; the control mechanism 56 comprises a pin push rod 561 and the spring bolt slide block 562, the pin push rod 561 is assembled in the push rod slide groove 531 of the outer plug 53 to control the first lower pin 5512 of the first pin mechanism 551; the spring bolt slide block 562 is assembled at the rear portion of the outer plug 53; the rear end of the pin push rod 561 is linked to the spring bolt slide block 562; that is to say, the moving of the spring bolt slide block 562 drives the pin push rod 561 to move.

The front end face of the spring bolt slide block 562 of the control mechanism 56 is disposed with an incline surface 5622; the inner plug 52 is disposed with a protruding portion 521 protruding axially; the incline surface 5622 of the spring bolt slide block 562 of the control mechanism is coupled to the protruding portion 521 of the inner plug 52, making that when the inner plug 52 is rotated, the spring bolt slide block 562 moves a position axially accordingly so as to drive the pin push rod 561 of the control mechanism to move axially.

The pin push rod 561 is disposed with a sloping slide groove 5611, the first lower pin 5512 of the first pin mechanism 551 is disposed with a protruding portion 55121 coupled to the sloping slide groove 5611 of the pin push rod 561; when the pin push rod 561 moves in the axial direction, with the coupling of the sloping slide groove 5611 of the pin push rod 561 and the protruding portion 55121 of the first lower pin 5512, the pin is controlled to move up and down, making the pin switched between a position the key can not unlock and a position the key can unlock. That is to say, the moving of the pin push rod 561 controls the first lower pin 5512 to move up and down; when the first lower pin 5512 in a proper position, the key 59 can unlock the outer lock mechanism 55, which, at this time, can be unlocked; when the first lower pin 5512 is in another position, the key 59 can not unlock the outer lock mechanism 55, which, at this time, can not be unlocked. Therefore, the control mechanism 56 controls the unlock condition of the outer lock mechanism 55.

The first lower pin 5512 is disposed with two symmetrical protruding portions 55121, to which two sloping slide grooves 5611 of the pin push rod 561 are coupled, so the first lower pin 5512 can move up and down stably.

The lock further comprises a gate mechanism 57 disposed at the front portion of the key hole of the outer plug 53, the gate mechanism 57 comprises an upper gate 571 and a lower gate 572; when the inner plug 52 rotates to the second position, the gate mechanism 57 closes the key hole.

The upper gate 571 of the gate mechanism 57 is radically slidably coupled to the inner plug 52; the upper gate 571 is disposed with a first protruding shaft 5711, the outer plug 53 is disposed with a first rail groove 533; the first protruding shaft 5711 of the upper gate is coupled to the first rail groove 533 of the outer plug 53, so when the inner plug 52 rotates, the upper gate 571 moves radically; at the same time, the lower gate 572 of the gate mechanism 57 is radically slidably coupled to the inner plug, the lower gate 572 is disposed with a second protruding shaft 5721, the outer plug 53 is disposed with a second rail groove 534, the second protruding shaft 5721 of the lower gate 572 is coupled to the second rail groove 534 of the outer plug 53, so when the inner plug 52 rotates, the lower gate 572 moves radically. When the inner plug 52 drives the gate mechanism 57 to rotate forward in a certain angle, with the coupling of the first protruding shaft 5711 and the first rail groove 533 of the outer plug 53, the upper gate 571 falls down to close part of the key hole; conversely, the inner plug 52 drives the gate mechanism 57 to rotate reversely in a certain angle to make the upper gate 571 lift up to open the key hole.

The inner plug 52 drives the gate mechanism 57 to rotate forward in a certain angle; with the coupling of the second protruding shaft 5721 of the lower gate 572 and the second rail groove 534 of the outer plug 53, the lower gate 572 lifts up to close part of the key hole; conversely, the inner plug 52 drives the gate mechanism 57 to rotate reversely in a certain angle to make the lower gate 572 fall down to open the key hole. The upper and lower gate move synchronously to open or close the key hole.

One end of the pin push rod 561 is disposed with a lock groove 5612; the spring bolt slide block 562 is disposed with a lock block fixing groove 5621, a lock block 563 is connected between the lock groove 5612 of the pin push rod 561 and the lock block fixing groove 5621 of the spring bolt slide block 562 to make the end of the pin push rod 561 linked to the spring bolt slide block 562; when the spring bolt slide block 562 moves axially, the spring bolt slide block 562 drives the pin push rod 561 to move axially by the lock block.

The rear end of the lock body 51 is further disposed with a sloping slide groove 514, the lock block 563 is coupled to the sloping slide groove 514 of the lock body 51, making the lock block move axially with the pushing of the spring bolt slide block 562 and move radically; when the spring bolt slide block 562 moves axially backward to the second position, the lock block escapes from the lock groove 5612 of the pin push rod 561.

A spring 5632 is assembled at the bottom end of the lock block 563; two sides of the lock block 563 are respectively disposed with a wing portion 5631; the sloping slide groove 514 of the lock body 51 is faced down; the head portion of the lock block abuts against the sloping slide groove 514 of the lock body; the wing portion 5631 of the lock block is coupled to the lock groove 5612 of the pin push rod.

The lock further comprises a delayer 58, which is assembled between the lock body 51 and the end of the pin push rod 561; when the inner plug 52 rotates to the second position and pushes the spring bolt slide block 562 to move backward to the second position, the pin push rod 561 pushes the delayer to make the delayer compressed to store energy; when the outer plug 53 rotates, the delayer does not release energy to push the pin push rod 561 to return; if the outer plug 53 does not rotate, the delayer 58 releases energy to push the pin push rod 561 to return to the position to control the outer lock mechanism 55 in a preset period.

When inner plug 52 returns to the initial position, all components return to the initial state.

The delayer 58 applies the structure of the second embodiment.

The inner lock mechanism 54 between the inner plug 52 and the outer plug 53 is a second pin mechanism 541, which is assembled between the inner plug 52 and the outer plug 53 radically to restrict the rotating of the inner plug 52. The inner lock mechanism 54 between the inner and outer plug applies traditional structure, which will not further described.

The unlocking process of the present invention will be further described.

As figured in FIGS. 57-73, before the key 59 is inserted to the key hole, the outer lock mechanism 55 of the outer plug 53 restricts the rotating of the outer plug 53 in relation to the lock body 51, and the inner lock mechanism 54 of the inner plug 52 restricts the rotating of the inner plug 52 in relation to the outer plug 53; only the outer plug 53 can drive the spring bolt slide block 562 to rotate to be unlocked, the inner plug 52 restricts the unlocking of the outer plug 53 by the control mechanism 56; the upper gate 571 and the lower gate 572 are open before the key 59 is inserted in.

When a valid key 59 is inserted into the key hole to align with the inner plug 52, that is to say, no mater the inner lock mechanism 54 is, the key 59 can unlock the inner lock mechanism 54; after the inner lock mechanism 54 unlocks, the inner plug 52 can rotate in relation to the outer plug 53 to drive the spring bolt slide block 562 to move axially; the spring bolt slide block 562 can be assembled in the lock body 51 axially by a spring; so that the key 59 can push the spring bolt slide block 562 to move towards the inner side by the inner plug 52, equivalent to the inner plug 52 moving backward in the position relationship.

Before the spring bolt slide block 562 moves backward, the outer plug 53 can not be unlocked due to the control of the pin push rod 561.

The spring bolt slide block 562 moves backward to drive the pin push rod 561 to move backward, thus making the first lower pin 5512 gradually fall down and thus the lock block 563 gradually fall down.

The inner plug 52 rotates to the second position to drive the spring bolt slide block 562 to move backward, the first lower pin 5512 falls down to the second position, making the first lower pin 5512 switched from locking position to unlocking position. At this time, the outer plug 53 can be unlocked. The lock block 563 completely escapes from the lock groove 5612 of the pin push rod 561. The inner plug 52 drives the gate mechanism 57 to rotate to the position; the upper gate 571 and the lower gate 572 close synchronously due to the rail groove of the outer plug 53. When the inner plug 52 rotates to the position, the delayer 58 is compressed to store energy.

when the valid key 59 unlock the outer lock mechanism 55, the outer and inner plug can rotate synchronously to unlock the lock. When the key 59 is pulled out, the inner plug 52 returns to the initial position, all components return to the initial state.

If in a certain period (which can be set by the delayer), the outer and inner plug do not rotate synchronously, the delayer works and resets, the delayer makes the pin push rod 561 to move forward, thereby driving the first lower pin 5512 to lift up to switch to a position the key can not unlock from the position the key can unlock, the control mechanism 56 re-controls the outer lock mechanism 55.

Sixth Embodiment

Referring to FIGS. 74-101, the lock with a dual plug of the present invention comprises a lock head and a key 610; the lock head comprise a lock body 61, a front plug 62 and a rear plug 63; the front plug 62 and the rear plug 63 are rotatably assembled in the lock body; the rear plug 63 can move axially; the front lock mechanism 65 and the rear lock mechanism 64, which can be unlocked by the key 610, are respectively assembled between the front and rear plug. The front lock mechanism 65 is a blade mechanism, which comprises a tumbler 651 and a plurality of blades 652 coupled to a protruding portion 6512 at the bottom portion of the tumbler; the blade 652 is disposed with a plurality of blade grooves 6521, of which only one blade groove is a key groove and others are trap grooves; the rear plug 63 is further assembled with a control mechanism 66 to control the tumbler; before the rear plug 63 translates to the second position, the tumbler 651 can not fall down; when the key 610 is inserted into the key hole, the key 610 unlocks the rear lock mechanism 64 first, then the key 610 pushes the rear plug 63 to move axially backward to the second position to make the tumbler 651 fall down; when the protruding portion 6512 of the tumbler drops to the key groove of the blade 652, the front lock mechanism 65 is unlocked, the front and rear plug can rotate synchronously by the key 610 to unlock the lock; when the protruding portion 6512 of the tumbler drops to the trap groove of the blade 652, the front lock mechanism 65 can not be unlocked and the blade 652 can not move.

The rear lock mechanism 64 between the rear plug 63 and the lock body 61 is a pin mechanism 641, which is radically assembled between the rear plug 63 and the lock body 61 to restrict the rotating and axial moving of the rear plug 63.

The lock body 61 is disposed with a first tumbler groove 611, the front plug 62 is disposed with a second tumbler groove 621; when the tumbler 651 is disposed both in the first tumbler groove 611 of the lock body 61 and the second tumbler groove 621 of the front plug 62, the front plug 62 can not rotate in relation to the lock body 61; when the tumbler 651 leaves from the first tumbler groove 611 of the lock body 61 and completely enters the second tumbler groove 621 of the front plug 62, the front plug 62 can rotate in relation to the lock body 61.

The control mechanism 66 comprises the tumbler push rod 661 and a coupling mechanism disposed between the tumbler push rod 661 and the tumbler 651; the front plug 62 is disposed with a push rod groove 622 arranged axially; the push rod groove 622 of the front plug 62 is connected to the second tumbler groove 621, which is used to assemble the tumbler; the tumbler push rod 661 is slidably assembled in the push rod groove 622 of the front plug 62 and is coupled to the tumbler 651; the rear end of the tumbler push rod 661 is linked to the rear plug 63, the linkage mechanism can be a lock fixing or an once-formed fixing; before the rear lock mechanism 64 is unlocked, the tumbler push rod 661 can not move; before the tumbler push rod 661 translates to the second position, the tumbler 651 can not fall down.

The coupling mechanism between the tumbler push rod 661 and the tumbler 651 comprises:

a slide groove 6611 disposed at the tumbler push rod for slidably coupling of the tumbler 651 to make the tumbler push rod 661 of the control mechanism and the tumbler 651 move in a cross way; and a first raised column 6511 disposed at the tumbler 651, a first incline surface 6612 disposed at the slide groove 6611 of the tumbler push rod, and a first clip 662 coupled to the incline surface 6612 and arranged in the horizontal direction; the bottom section of the incline surface 6612 being disposed with a second raised column 6613 used to make the first clip 662 horizontally arranged; one end of the first clip 662 being fixed to the second raised column 6613, the other end being freely put on the top portion of the incline surface 6612.

The sum of the raising size of the first raised column 6511 of the tumbler 651 and the width of the second raised column 6613 is not larger than the width of the first incline surface 6612; the width of the first clip 662 is equal to the width of the first incline surface 6612. The coupling size makes the first raised column 6511 able to keep away from the second raised column 6613 and move along the first incline surface 6612.

Before the tumbler push rod 661 translates backward to the second position, the first raised column 6511 of the tumbler 651 is restricted by the first clip 662 to make the tumbler 651 unable to fall down; when the tumbler push rod 661 translates to the second position, the first raised column 6511 of the tumbler escapes the restriction of the first clip 662 to make the tumbler 651 fall down; when the tumbler push rod 661 of the control mechanism moves forward, the first raised column 6511 of the tumbler 651 moves upwardly along the first incline surface 6612 of the slide groove 6611 of the tumbler push rod; when the tumbler push rod 661 moves forward to the second position, the first raised column 6511 of the tumbler pushes the free end of the first clip 662 away and resets to the upper end of the first clip 662.

The top portion of the tumbler 651 is assembled with a press block 653; the top portion of the press block 653 is assembled with a first spring 654, the first spring 654 abuts between the top portion of the press block 653 and the lock body 61. When assembling the lock, a cap 655 is assembled to the first tumbler groove 611 of the lock body 61, the first spring 654 abuts between the top portion of the press block 653 and the cap 655 of the lock body 61.

The section of the key groove and the trap groove are rectangle shaped.

The lock further comprises a gate mechanism 67 disposed at the front portion of the key hole of the front plug 62, the gate mechanism 67 is linked to the rear plug 63; when the rear plug 63 moves backward to its portion, the gate mechanism 67 closes the gate mechanism 67.

The gate mechanism comprises an upper gate 671 and a lower gate 672; an upper gate push rod 673 and a lower gate push rod 674 are disposed between the upper and lower gate and the rear plug 63; one end of the upper and lower gate push rod is fixed to the rear plug 63; the other end is coupled to the upper and lower gate; when the key 610 pushes the rear plug 63 and the upper and lower gate push rod to move backward, the upper and lower gate close the key hole.

The upper gate push rod 673 can be an independent part, or it can be manufactured to the tumbler push rod 661; the extending portion of the tumbler push rod 661 forms the upper gate push rod 673.

The upper gate 671 is disposed at the front upper portion of the key hole of the front plug 62; the upper gate 671 is disposed with a second incline surface 6711 faced up, the front end of the upper gate push rod 673 is disposed with a third incline surface 6731 faced down; the second incline surface 6711 of the upper gate is coupled to the third incline surface 6731 of the upper gate push rod, so when the upper gate push rod 673 moves backward, it drives the upper gate 671 to move downwardly.

The lower gate 672 is disposed at the front lower portion of the key hole of the front plug 62; the lower gate 672 is disposed with a fourth incline surface 6721 faced down, the front end of the lower gate push rod 674 is disposed with a fifth incline surface 6741 faced up; the forth incline surface is coupled to the fifth incline surface, so when the lower gate push rod 674 moves backward, it drives the lower gate 672 to move upwardly.

When the rear plug 3 returns to the initial position, all components return to the initial state.

When the key 610 does not insert to the key hole, the front and rear lock mechanism are not unlocked, the pin mechanism 641 of the rear lock mechanism 64 is locked between the rear plug 63 and the lock body 61; the tumbler 651 of the front lock mechanism 65 is locked between the front plug 62 and the lock body 61, the tumbler push rod 661 does not move, the first raised column 6511 of the tumbler 651 is located at the first clip 665, the first clip 662 prevents the tumbler 651 from falling down. At this time, the gate mechanism 67 is open, that is to say, the upper gate 671 and the lower gate 672 are respectively located above and below the key hole.

When the key 610 is inserted into the key hole and is coupled to the rear lock mechanism, the pin mechanism of the rear lock mechanism 64 is unlocked; at this time, due to the front plug 62, the rear plug 63 can only move axially but not rotate, the tumbler 651 of the front lock mechanism 65 is still locked between the front plug 62 and the lock body 61, the tumbler push rod 661 does not move, the first raised column 6511 is still located in the first clip 662, the first clip 662 prevents the tumbler 651 from falling down. At this time, the gate mechanism is still open, that is to say, the upper and lower gate are respectively located above and below the key hole.

When the key 610 pushes backward, the rear plug 63 moves backward to drive the tumbler push rod 661 to move backward, the tumbler 651 and the tumbler push rod 661 move relatively, the raised column 6511 of the tumbler 651 moves at the first clip 662, the first clip 662 still prevents the tumbler 651 falling down. With the rear plug moving backward, the upper gate 671 and the lower gate 672 move to close due to the action of the upper gate push rod 673 and the lower gate push rod 674.

When the key 610 pushes backward to the second position, the rear plug 63 drives the tumbler push rod 661 to move backward to the position, the first raised column of the tumbler 651 moves away from the first clip 662, the tumbler 651 falls down. If at this time, the key 610 is coupled to the front lock mechanism 65, the protruding portion 6512 at the bottom portion of the tumbler 651 drops to the key groove, the tumbler 651 completely escapes from the first tumbler groove 611 of the lock body 61, making the front plug 62 and the lock body 61 rotatable relatively. By the driving of the key 610, the front and rear plug rotate synchronously to unlock the lock. Under the action of the upper gate push rod 673 and the lower gate push rod 674, the upper and lower gate close. If at this time, the key 610 is not coupled to the front lock mechanism 65, (for example, the rear plug is broke by other tool in an abnormal unlocking situation), although the tumbler 651 drops down, the protruding portion 6512 at the bottom portion of the tumbler 651 drops to the trap groove, the tumbler 651 does not completely escape from the first tumbler groove 611 of the lock body 61, the front plug 62 and the lock body can not rotate relatively. In addition, the trap groove restricts the moving of the blade, other tool can not break the front plug. When the protruding portion 6512 at the bottom portion of the tumbler 651 drops to the trap groove, the blade corresponding to the tumbler 651 is restricted that the blade can not move. Only by resetting the rear plug 63, the tumbler push rod 661 reset to lift the tumbler 651 up again, the protruding portion 6512 at the bottom portion of the tumbler 651 can escape from the trap groove and the blade can move. Therefore, the front plug 62 can be unlocked only if the position of the blade is known and the blade is put to the right position.

To reset the lock, after the key 610 moves out, the rear plug 63 is pulled by the axial spring or the key to move forward to reset. By the driving of the rear plug 63, the tumbler push rod 661 moves forward, equivalent that the tumbler 651 moves backward in relation to the tumbler push rod 661; the first raised column 6511 of the tumbler 651 moves up along the first incline surface 6612, equivalent that the tumbler push rod 661 lifts the tumbler 651 up; the upper and lower gate gradually leave away due to the upper gate push rod 673 and the lower gate push rod 674. When the rear plug 63 returns to the initial position, the first raised column 6511 of the tumbler pushes the free end of the first clip 662 away to reset to the upper end of the first clip 662, the bottom portion of the tumbler 651 is not coupled to the blade; the upper gate 671 and lower gate 672 are open.

Seventh Embodiment

Figure 102:
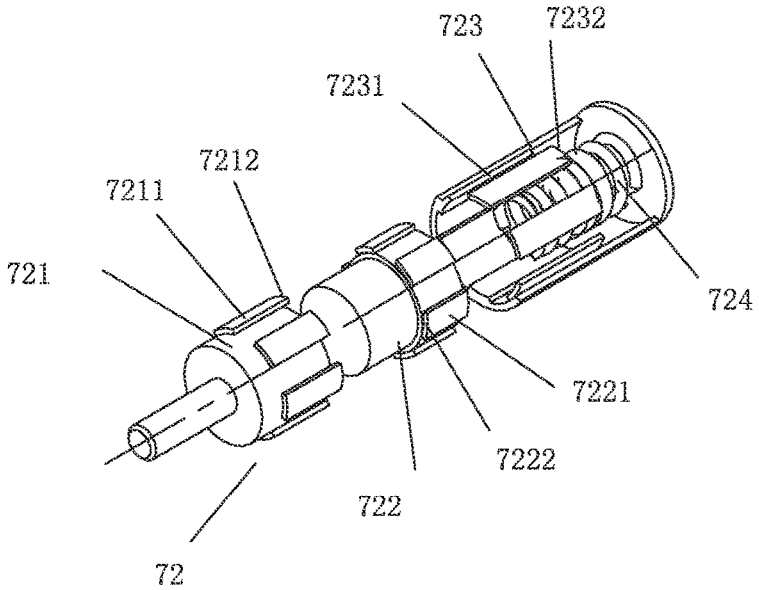
FIG. 102 illustrates a schematic diagram of a delayer of a lock with dual plug of a seventh embodiment of the present invention.

As figured in FIG. 102, the lock with a dual plug of this embodiment differs from the first embodiment in that: the delayer is a mechanical friction delayer 72, the mechanical friction delayer 72 comprises a push rod 721, a transition block 722, a fixing base 723 and a compressed spring 724; the push rod 721, the transition block 722 and the compressed spring 724 are slidably assembled in the inner chamber of the fixing base 723; a boss 7211 of the push rod is slidably assembled in a slide rail 7231 of the fixing base; a rear end of the compressed spring 724 abuts against the inner wall of the rear end of the fixing base 723, the front end abuts against the end of the inner hole of the rear end of the transition block 722; the front end of the transition block 722 is movably assembled to the end of the inner hole of the rear end of the push rod 721; the boss 7221 of the transition block is coupled to the slide rail 7231 of the fixing base; the push rod 721 is pushed to drive the transition block to move backward and the compressed spring 724 is compressed to store energy; when the transition block 722 drops out of the slide rail 7231 of the fixing base, the incline surface 7222 of the transition block 722 is coupled to the incline surface 7212 of the push rod and the incline surface of the fixing base, resulting in the transition block rotating a certain angle; the rotation speed of the transition block 722 is controllable by adjusting the inclination of the incline surface and fixing base and the friction coefficient, the transition block thus delays. When the boss 7221 of the transition block 722 rotates to the next slide rail of the fixing base, if no external force acts on the push rod 721, the compressed spring 724 releases energy to push the transition block 722 and the push rod to the initial position. According to this principle, the delayer 72 can delay and reset a movable object.

Eighth Embodiment

Figure 103:
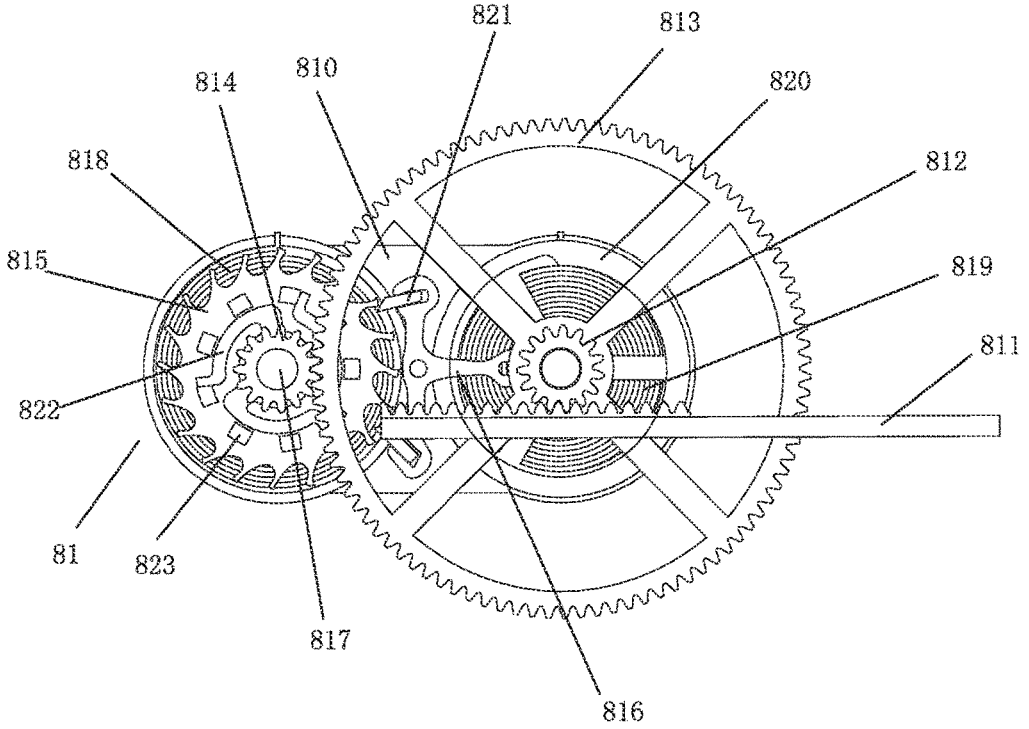
FIG. 103 illustrates a schematic diagram of a delayer of a lock with dual plug of an eighth embodiment of the present invention.

As figured in FIG. 103, the lock with a dual plug of this embodiment differs from the first embodiment in that: the delayer is different. The delayer of this embodiment is a clock delayer 81, which comprises a rack 811, a reducing mechanism, an escape mechanism, a shock mechanism, an energy storing mechanism, a unidirectional transmission mechanism and a fixing base 810, the fixing base 810 is used to assemble the corresponding mechanism; one end of the rack 811 is connected to the control mechanism, the rack 811 is coupled to the reducing mechanism; the reducing mechanism is linked to the escape mechanism; the energy mechanism is linked to the escape mechanism; the unidirectional transmission mechanism is assembled between the escape mechanism and the reducing mechanism; the escape mechanism is coupled to the shock mechanism;

The reducing mechanism comprise a small gear 812, a reducing gear 813 and a driving gear 814; the small gear 812 is coaxially fixed to the reducing gear 813; the teeth structure of the rack 811 is coupled to the small gear 812, the reducing gear 813 is engaged to the driving gear 814. As the reducing gear 813 is designed large and the driving gear is designed small, the rotating speed of the reducing mechanism can be reduced. The escape mechanism comprises an escape wheel 815 and an escape fork 816, the driving gear 814 and the escape wheel 815 are fixed to the same rotating shaft 817; the energy storing mechanism comprises an energy storage torsion spring 818, which is assembled to the rotating shaft 817; the shock mechanism comprises a swing torsion spring 819 and an inertial wheel 820, the swing torsion spring 819 is assembled to the inertial wheel 820; the escape fork 816 is assembled to the inertial wheel 820 by a roller jewel, making one end of the escape fork 816 swing with the swinging of the inertial wheel 820. The end of the escape fork 816 is assembled with a jewel, the escape fork 816 is coupled to the escape wheel 815 by the jewel 821, thereby controlling the escape wheel 815 rotate intermittently in high speed. The unidirectional transmission mechanism comprises an elastic piece 822 and a wedge boss 823 disposed at the escape wheel; one end of the elastic piece 822 is fixed to the driving gear 814, while the other end is coupled to the wedge boss 823 of the escape wheel 815.

The control mechanism (or the rear plug) moves backward and drives the rack 811 to move backward, the rack 811 drives the small gear 812 to rotate, the small gear 812 drives the reducing gear 813 to rotate, the reducing gear 813 drives the driving gear 814 to rotate, making the energy storage torsion spring 818 store energy. The control mechanism (or the rear plug) translates to the position, the energy storage torsion spring 818 finishes the energy storing, at the same time, the control mechanism escapes its control to the rack 811, the rack 811 starts to reset and the rack 811 moves forwardly by the driving gear 814, at the same time, the driving gear 814 is fixed to the escape wheel 815, therefore, the escape fork 816 starts to control the rotating of the escape wheel 815, each time the escape fork 816 swings, the escape wheel 815 only rotates a certain angle, the driving gear 814 only rotates a certain angle, and the rack 811 moves forward a certain distance; the escape fork 816 swings in a fixed frequency to control the rack 811 to reset slowly, thus achieving delay effect. The escape fork 816 and the swing torsion spring 819 and the inertial wheel 820 jointly act on the escape fork 816 to swing in a fixed frequency. The inertial wheel 820 swings forth and back in a fixed frequency under the action of the swing torsion spring 819; the roller jewel of the inertial wheel 820 controls the escape fork 816 to swing synchronously. As one end of the elastic piece 822 is fixed to the driving gear 814 and the other end is coupled to the wedge boss 823 of the escape wheel 815, the driving gear 814 is coupled to the escape wheel 815 in unidirectional way.

Ninth Embodiment

Figure 104:
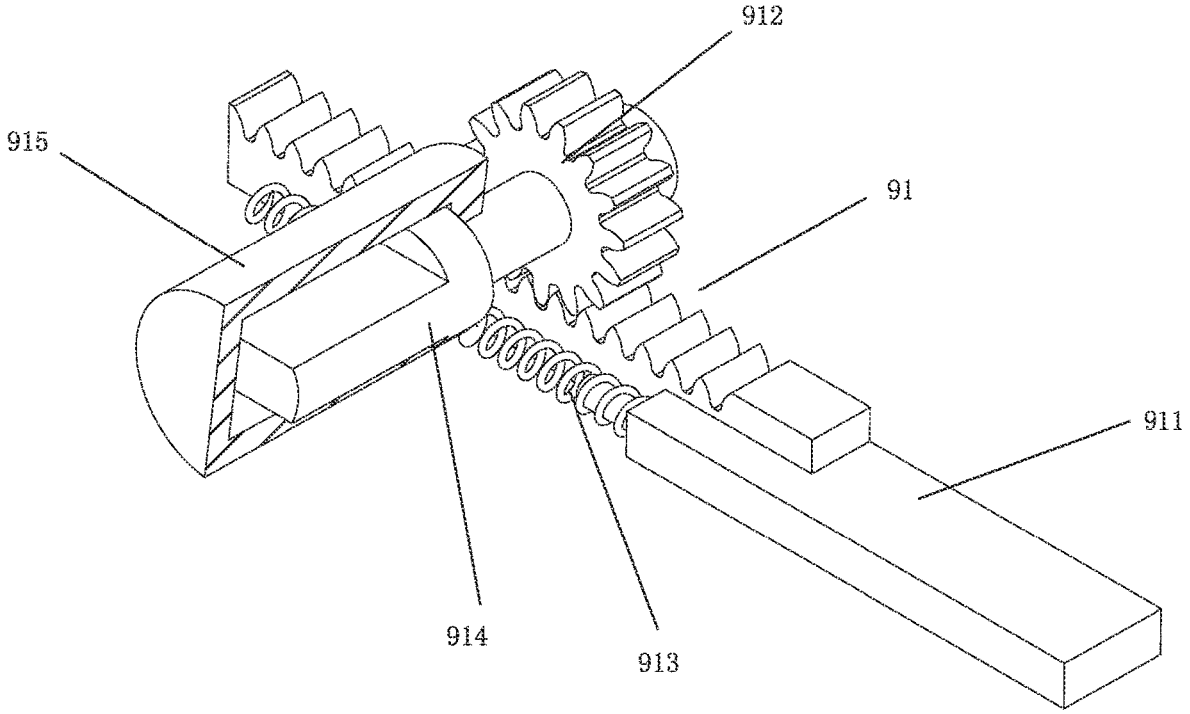
FIG. 104 illustrates a schematic diagram of a delayer of a lock with dual plug of a ninth embodiment of the present invention.

Referring to FIG. 104, the lock with dual plug of this embodiment differs from the first embodiment in that: the delayer is different. The delayer of this embodiment is a damping delayer 91, which comprises a rack 911, a damping gear 912, a compressed spring 913 and a damper; one end of the rack 911 is connected to the control mechanism; the compressed spring 913 abuts against the other end of the rack 911; the teeth of the rack 911 is coupled to the damping gear 912; the damper comprises a damping valve spindle 914 and a housing 915, the valve spindle 914 is assembled in the housing 915 and is coaxially connected to the damping gear 912.

The control mechanism (or the rear plug) moves backward to drive the rack 911 to move backward, making the compressed spring 913 compressed to store energy. When the control mechanism translates to the position, the compressed spring 913 finishes energy storing, at the same time, the control mechanism leaves its control to the rack 911, the rack 911 starts to reset, the rack 911 also drives the damping gear 912 to rotate, the rack 911 can only move in a slow rate; therefore the rack 911 delays and resets. The damper comprises the valve spindle 914 and the housing, between which glue fills up, restricting the rotating of the housing 915. Due to the glue, more quickly the valve spindle 914 rotates, larger the viscous force of the glue is.

INDUSTRIAL APPLICABILITY

The present invention is provided that two plugs are mutually controlled; the first plug restricts the unlocking of the second plug before the code of the first plug is unlocked; after the first plug is unlocked, the first plug can move but not rotate; when the first plug translates to the second position, the first plug releases its restriction on the second plug, but the second plug still restricts the rotating of the first plug; after the second plug is unlocked, the first plug and the second plug can rotate synchronously to unlock the lock. The time the first plug takes to translate a position difference is time difference. The present invention not only applies mutually controlling between the two plugs, but also applies some restriction conditions by time difference to prevent unlocking by techniques. The dual plug and the mutually control structure of the dual plug are easily implemented in the industry. The components of the present invention are also easily manufactured.

Although the present invention has been described with reference to the preferred embodiment thereof for carrying out the patent for invention, it is apparent to those skilled in the art that a variety of modifications and changes may be made without departing from the scope of the patent for invention which is intended to be defined by the appended claims.

What is claimed is:

1. A method for mutually controlling and unlocking a dual plug in a lock, comprising:

unlocking a code of a first plug of the dual plug restricting unlocking of a second plug of the dual plug, wherein rotation of the first plug is restricted by the second plug until the code of the first plug is unlocked, after unlocking the code of the first plug, translating the first plug from a first position to a second position separated from the first position by a preset position difference, after translating the first plug to the second position, enabling unlocking of the second plug while restricting rotation of the first plug by the second plug, unlocking a code of the second plug, and rotating the first plug and the second plug synchronously after unlocking the code of the second plug so as to unlock the lock.

2. The method for mutually controlling and unlocking the dual plug in the lock according to claim 1, wherein, while translating the first plug from the first position to the second position:

utilizing a time difference generated by translation from the first position to the second position to enable an entrance of the second plug for insertion of an unlock device to gradually define a partially closed state or a complete closed state.

3. The method for mutually controlling and unlocking the dual plug in the lock according to claim 1, comprising:

using different unlocking areas of an unlock device to unlock the code of the first plug and the code of the second plug.

4. The method for mutually controlling and unlocking the dual plug in the lock according to claim 3, wherein, when the unlock device is valid:

enabling unlocking of the second plug comprises enabling unlocking of the second plug by the first plug, and unlocking the code of the second plug comprises unlocking the code of the second plug by the unlock device.

5. The method for mutually controlling and unlocking the dual plug in the lock according to claim 1, wherein:

the rotation of the first plug is restricted after the code of the first plug is unlocked, and the method comprises:

restricting the first plug from self-rotating, and releasing the first plug so as to enable the self-rotating only when the first plug translates to the second position.

6. The method for mutually controlling and unlocking the dual plug in the lock according to claim 1, wherein:

the method comprises utilizing an action part of the first plug associated with the code of the second plug to restrict the unlocking of the second plug, the second plug is unable to be unlocked by a valid unlock device before the first plug is translated from the first position to the second position, after translating the first plug to the second position, enabling unlocking of the second plug comprises enabling unlocking of the second plug from the action part of the first plug, and unlocking the code of the second plug comprises unlocking the code of the second plug by the valid unlock device.

7. The method for mutually controlling and unlocking the dual plug in the lock according to claim 1, wherein:

rotation of the second plug is associated with the rotation of the first plug to restrict the rotation of the first plug, and the first plug is unable to rotate when the second plug is unable to rotate.

8. The method for mutually controlling and unlocking the dual plug in the lock according to claim 6, wherein:

while translating the first plug from the first position to the second position, an entrance of the second plug for insertion of the valid unlock device is partially closed or completely closed by the first plug, the method comprises associating the action part of the first plug with the code of the second plug, the first plug does not act on the second plug before the first plug translates from the first position to the second position, and after translating the first plug to the second position, affecting the code of the second plug by the action part of the first plug, so that the entrance of the second plug is partially closed or completely closed.

9. The method for mutually controlling and unlocking the dual plug in the lock according to claim 2, comprising:

using different unlocking areas of the unlock device to unlock the code of the first plug and the code of the second plug.

10. The method for mutually controlling and unlocking the dual plug in the lock according to claim 9, wherein, when the unlock device is valid:

enabling unlocking of the second plug comprises enabling unlocking of the second plug by the first plug, and unlocking the code of the second plug comprises unlocking the code of the second plug by the unlock device.

* * * * *